US012691340B2

(12) United States Patent
Yi et al.

(10) Patent No.: US 12,691,340 B2
(45) Date of Patent: Jul. 28, 2026

(54) GOLF CLUB HEAD HAVING SUPPORTED STRIKING FACE

(71) Applicant: Acushnet Company, Fairhaven, MA (US)

(72) Inventors: Sang Yi, Carlsbad, CA (US); Kyle Carr, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 318 days.

(21) Appl. No.: 18/542,143

(22) Filed: Dec. 15, 2023

(65) Prior Publication Data

US 2024/0115914 A1 Apr. 11, 2024

Related U.S. Application Data

(63) Continuation-in-part of application No. 18/501,944, filed on Nov. 3, 2023, which is a continuation-in-part of application No. 17/692,576, filed on Mar. 11, 2022, now Pat. No. 11,850,461.

(51) Int. Cl.
*A63B 53/04* (2015.01)

(52) U.S. Cl.
CPC ..... *A63B 53/0475* (2013.01); *A63B 53/0412* (2020.08)

(58) Field of Classification Search
CPC ..... A63B 53/0475; A63B 53/0412; A63B 2209/00; A63B 53/047; A63B 60/54; A63B 53/0408
See application file for complete search history.

(56) References Cited

U.S. PATENT DOCUMENTS

| | | | | |
|---|---|---|---|---|
| 2,030,135 | A | 2/1936 | Carpenter | |
| 3,257,677 | A | 6/1966 | Batchelder et al. | |
| 3,869,333 | A | 3/1975 | Mcmaster | |
| 4,811,950 | A | 3/1989 | Kobayashi | |
| 4,928,972 | A | 5/1990 | Nakanishi et al. | |
| 5,306,450 | A | 4/1994 | Okumoto et al. | |
| 5,467,983 | A | 11/1995 | Chen | |
| 5,505,453 | A | 4/1996 | Mack | |
| 5,547,194 | A | 8/1996 | Aizawa et al. | |
| 5,586,947 | A | 12/1996 | Hutin | |
| 5,899,821 | A * | 5/1999 | Hsu | A63B 53/047 473/332 |
| 6,403,188 | B1 | 6/2002 | Donahue | |

(Continued)

*Primary Examiner* — William M Pierce
(74) *Attorney, Agent, or Firm* — Womble Bond Dickinson (US) LLP

(57) ABSTRACT

A golf club head includes: a striking face; a top portion; a sole extending; a support bar protruding rearwardly from the striking face; an intermediate wall extending between the sole and the support bar; and a front cavity between the striking face and the intermediate wall, wherein, when the golf club head is in an address position on a ground plane, a greatest cavity height distance in a cross-sectional plane, as measured along a first direction perpendicular to the ground plane and from the ground plane to a top of the front cavity closest to the top portion is less than 70% of a greatest club height distance in the cross-sectional plane, as measured along the first direction and from the ground plane to the top portion, wherein the cross-sectional plane is perpendicular to the ground plane and taken at Face Center.

13 Claims, 45 Drawing Sheets

(56) References Cited

U.S. PATENT DOCUMENTS 6,649,239 B2 11/2003 Donahue
7,087,699 B2 8/2006 Kuntimaddi
7,383,954 B2 6/2008 Morrison
7,506,450 B2 3/2009 Spaulding et al.
7,892,106 B2 2/2011 Matsunaga
8,088,025 B2 1/2012 Wahl et al.
8,821,313 B1 * 9/2014 Dawson ..... A63B 53/047 473/335
8,870,682 B2 10/2014 Roach
8,876,630 B2 11/2014 Takechi
8,936,518 B2 * 1/2015 Takechi ..... A63B 53/047 473/335
9,033,819 B2 5/2015 Wahl et al.
9,192,824 B1 11/2015 Frame et al.
9,199,141 B2 12/2015 Cardani et al.
10,150,020 B2 12/2018 Cole et al.
10,279,225 B2 5/2019 Jertson et al.
10,350,468 B2 7/2019 Jonathan et al.
10,478,683 B2 11/2019 Stokke et al.
10,507,366 B2 12/2019 Jonathan et al.
10,722,765 B2 7/2020 Schweigert et al.
10,737,151 B2 8/2020 Jonathan et al.
10,828,538 B2 11/2020 Parsons et al.
11,058,931 B2 7/2021 Clarke et al.
11,235,212 B2 * 2/2022 Clarke ..... A63B 53/0475
11,291,890 B2 4/2022 Parsons et al.
11,369,847 B2 6/2022 Parsons et al.
11,565,158 B1 1/2023 Parsons et al.
11,707,653 B2 7/2023 Parsons et al.
11,839,799 B2 12/2023 Kroloff et al.
11,839,800 B2 12/2023 Parsons et al.
11,850,461 B2 12/2023 Carr et al.
11,918,867 B2 * 3/2024 Hebreo ..... A63B 53/047
11,969,630 B2 4/2024 Carr
12,109,464 B2 10/2024 Parsons et al.
12,194,349 B2 1/2025 Parsons et al.
12,194,351 B1 * 1/2025 Nicolette ..... A63B 60/002
12,285,661 B2 4/2025 Carr et al.
12,324,967 B2 6/2025 Parsons et al.
12,350,559 B1 * 7/2025 Nicolette ..... A63B 60/02
12,370,420 B2 7/2025 Nicolette et al.
12,377,325 B2 * 8/2025 Nicolette ..... A63B 60/02
12,453,907 B2 10/2025 Kawaguchi et al.
12,453,911 B2 10/2025 Kroloff et al.
2004/0033846 A1 * 2/2004 Caldwell ..... A63B 53/0466 473/345
2004/0053704 A1 3/2004 Gilbert
2004/0242339 A1 12/2004 Gilbert et al.
2005/0107183 A1 5/2005 Takeda et al.
2005/0266931 A1 * 12/2005 Hou ..... A63B 53/0466 473/345
2007/0129165 A1 6/2007 Matsunaga et al.
2007/0129166 A1 * 6/2007 Shimazaki ..... A63B 53/0475 473/345
2007/0155534 A1 * 7/2007 Tsai ..... A63B 60/02 473/335
2007/0249431 A1 10/2007 Lin
2008/0058119 A1 3/2008 Soracco et al.
2008/0305888 A1 * 12/2008 Tseng ..... A63B 53/0475 473/332
2009/0118037 A1 5/2009 Roach et al.
2011/0028240 A1 * 2/2011 Wahl ..... A63B 53/047 473/346
2013/0288823 A1 10/2013 Jonathan
2018/0028882 A1 2/2018 Hebreo et al.
2018/0185717 A1 * 7/2018 Demkowski ..... A63B 60/00
2019/0255397 A1 8/2019 Jonathan et al.

* cited by examiner

GOLF CLUB HEAD HAVING SUPPORTED STRIKING FACE

CROSS-REFERENCE TO RELATED APPLICATION

This application is a continuation-in-part of U.S. application Ser. No. 18/501,944, filed on Nov. 3, 2023, which is a continuation-in-part of U.S. application Ser. No. 17/692,576, filed on Mar. 11, 2022, the entire content of each of which is incorporated herein by reference. To the extent appropriate, this application claims priority to each of these applications.

FIELD

The present invention relates generally to a golf club head having a polymer supported striking face.

BACKGROUND

Modem day golf club design has evolved since the early days of golf. The good news of all the technological advancements in golf club technology is that it makes the game of golf easier for golfers of all skill levels. However, all these advancements come with tremendous challenges for the golf club engineer.

One of the latest trends in golf club design is the utilization of multiple different materials in the same golf club head to take advantage of the individual performance characteristics of the base material, and combining them to create a better performing golf club head. U.S. Pat. No. 5,316,298 to Hutin et al. discloses a club head with a front strike face with a vibration damper on the rear surface. The vibration damper includes a constraining layer connected to the rear surface through an interposed visco-elastic material.

U.S. Pat. No. 9,844,230 to Snyder shows an iron body and a ball striking plate engaged with the iron body. The ball striking plate may include a face layer and a backing layer of a polymeric material to isolate the face layer from the iron body.

It should be noted that although the utilization of multi-material golf club head has been around, the industry has always been perplexed by the utilization of multi-material around the striking face portion of the golf club head due to the high amount of stress when impacting a golf ball. An aspect of the present invention relates to a golf club head having a front cavity positioned behind the striking face of the golf club head and that may be at least partially filled with one or more polymer materials.

SUMMARY

According to an aspect of the present disclosure, the technology relates to an iron type golf club head, including: a striking face having a substantially flat outermost surface, and having a lower leading edge and an opposite upper topline edge; a top portion extending rearward from the upper topline edge; a sole extending rearward from the lower leading edge; a support bar protruding rearwardly from the striking face and extending in a toe-heel direction of the golf club head; an intermediate wall extending between the sole and the support bar; a front cavity defined at least in part by the striking face, the intermediate wall, the support bar, and the sole, wherein, when the golf club head is in an address position on a ground plane, a greatest cavity height distance in a cross-sectional plane, as measured along a first direction perpendicular to the ground plane and from the ground plane to a top of the front cavity closest to the top portion is less than 70% of a greatest club height distance in the cross-sectional plane, as measured along the first direction and from the ground plane to the top portion, wherein the cross-sectional plane is perpendicular to the ground plane and taken at Face Center.

In some examples, the iron type golf club head further includes one or more polymer materials at least partially filling the front cavity. In some examples, a volume of the front cavity is less than 8,500 $mm^3$. In some examples, the volume of the front cavity is less than 7,000 $mm^3$. In some examples, the iron type golf club head further includes a cradle defining at least part of the sole, and a rear cavity positioned rearward to the front cavity, and defined at least partially by the cradle and the intermediate wall, wherein the intermediate wall fluidically separates the front and rear cavities. In some examples, an opening is defined in a toe or a heel of the golf club head and exposes the front cavity to an exterior of the golf club head, and the opening is at least partially filled with a first polymer material. In some examples, a sole slot is defined at least partly in the sole and exposes the front cavity to an exterior of the golf club head, and the sole slot is at least partially filled with a first polymer material. In some examples, a top slot is defined at least partly in the support bar and exposes the front cavity to the exterior of the golf club head, and the top slot is at least partially filled with the first polymer material or a second polymer material different from the first polymer material.

According to an aspect of the present disclosure, the technology relates to an iron type golf club head, including: a striking face having a lower leading edge and an upper topline edge; a top portion extending rearward from the upper topline edge; a sole extending rearward from the lower leading edge; a support bar protruding rearwardly from the striking face, extending in a toe-heel direction of the golf club head, and positioned between the sole and the top portion; an intermediate wall extending between the sole and the support bar; a front cavity defined at least in part by the striking face, the intermediate wall, the support bar, and the sole, and having a volume of less than 8,500 $mm^3$.

In some examples, the volume of the front cavity is less than 7,000 $mm^3$. In some examples, a sole slot is defined at least partly in the sole that exposes the front cavity to an exterior of the golf club head. In some examples, the support bar covers an entire top of the front cavity. In some examples, a top slot is defined in the support bar and exposes a top of the front cavity to the exterior of the golf club head, and the top slot is at least partially filled with a first polymer material. In some examples, the sole slot is at least partially filled with a second polymer material different from the first polymer material. In some examples, the sole slot is filled with the first polymer material. In some examples, the iron type golf club head further includes one or more polymer materials at least partially filling the front cavity. In some examples, the front cavity is partially filled by the one or more polymer materials, and part of the front cavity is void.

According to an aspect of the present disclosure, the technology relates to an iron type golf club head, including: a striking face having a substantially flat outermost surface, and having a lower leading edge and an opposite upper topline edge; a top portion extending rearward from the upper topline edge; a sole extending rearward from the lower leading edge; a support bar protruding rearwardly from the striking face and extending in a toe-heel direction of the golf club head; an intermediate wall extending between the sole and the support bar; a front cavity defined at least in part by the striking face, the intermediate wall, the support bar, and the sole; and one or more polymer materials at least partially filling the front cavity, wherein, when the golf club head is in an address position on a ground plane, a greatest cavity height distance in a cross-sectional plane, as measured along a first direction perpendicular to the ground plane and from the ground plane to a top of the front cavity closest to the top portion is less than 75% of a greatest club height distance in the cross-sectional plane, as measured along the first direction and from the ground plane to the top portion, wherein the cross-sectional plane is perpendicular to the ground plane and taken at Face Center, and wherein an opening is defined in a toe or a heel of the golf club head that exposes the front cavity to an exterior of the golf club head.

In some examples, a volume of the front cavity is less than 8,500 $mm^3$. In some examples, the opening is in the toe of the golf club head, and a first polymer material at least partially fills the opening and at least partially fills the front cavity.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION

Figure 1:
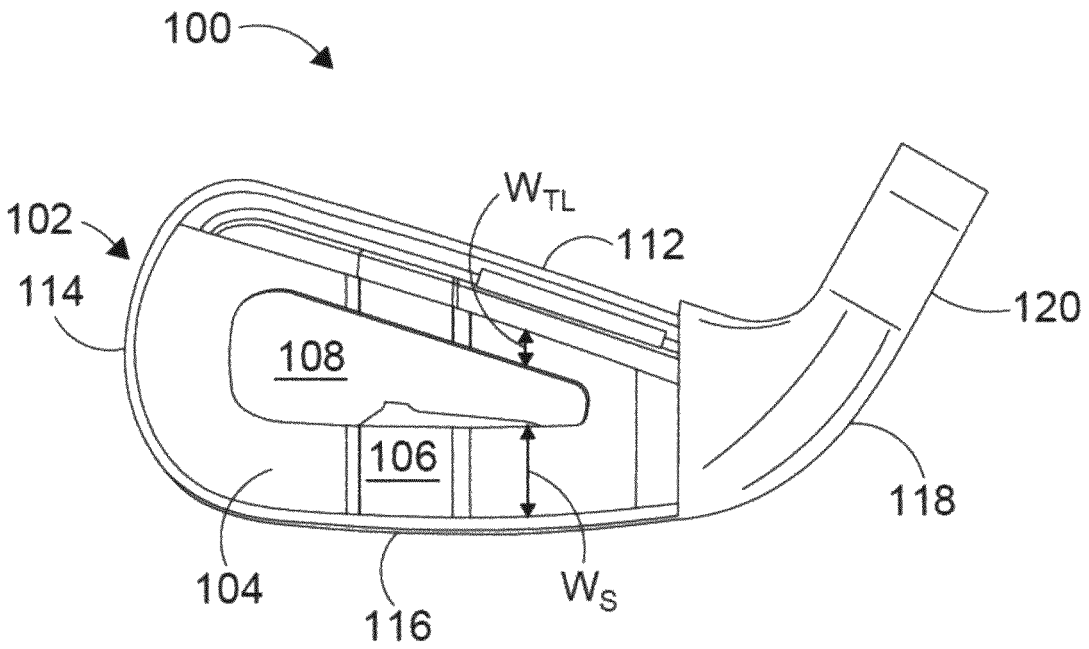
FIG. 1 of the accompanying drawings shows a frontal view of a golf club head body portion in accordance with an embodiment of the present invention.

The following detailed description describes the best currently contemplated modes of carrying out the invention. The description is not to be taken as limiting the invention and is provided for the sole purpose of illustrating the general principles of the invention. The scope of the invention is best defined by the appended claims. Various inventive features are described below, and each can be used independently of one another or in combination with other features.

FIGS. 1-4 of the accompanying drawings shows a golf club head 100 in accordance with an exemplary embodiment of the present invention. Golf club head 100 shown here an aft body portion or body portion 102, including a topline portion 112, a toe portion 114, a sole portion 116, a heel portion 118 and a hosel 120. The body portion 102 is further comprised of an internal face support 104 that includes a perimeter support portion 106 and a center portion 108. The perimeter support portion 106 is solid steel and preferably cast with the body portion 102 such that it is rigid with the body portion 102. The perimeter support portion further surrounds the hollow center portion 108.

Figure 2:
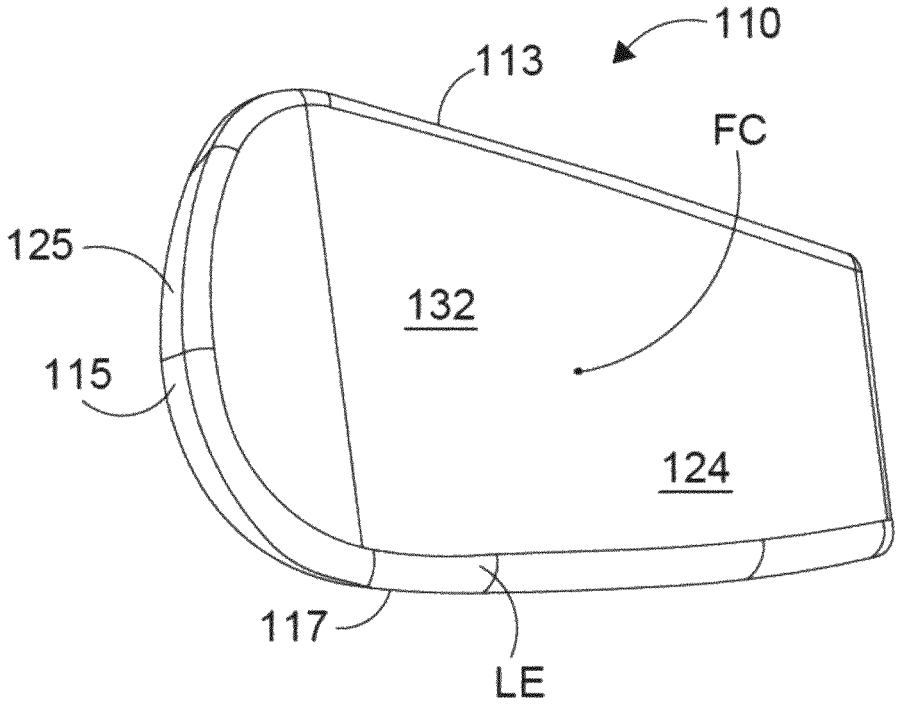
FIG. 2 of the accompanying drawings shows a frontal view of a golf club head face cup that couples to the body portion disclosed in FIG. 1.

The striking face portion 110 shown in FIG. 2 includes a frontal face portion 124 a return portion 125, and a face center FC. Furthermore, FIG. 2 illustrates the striking face portion 110 can be formed as a face cup such that it forms the leading-edge LE and has a toe portion 115, topline portion 113 and a sole portion 117 that couple to the body portion's toe portion 114, topline portion 112 and sole portion 116, respectively. When the striking face portion 110 is coupled to the body portion 102, preferably by welding around the striking face portion 110, the striking face portion 110 and the body portion 102 form a cavity between the frontal face portion 124 and the internal face support 104.

Figure 3:
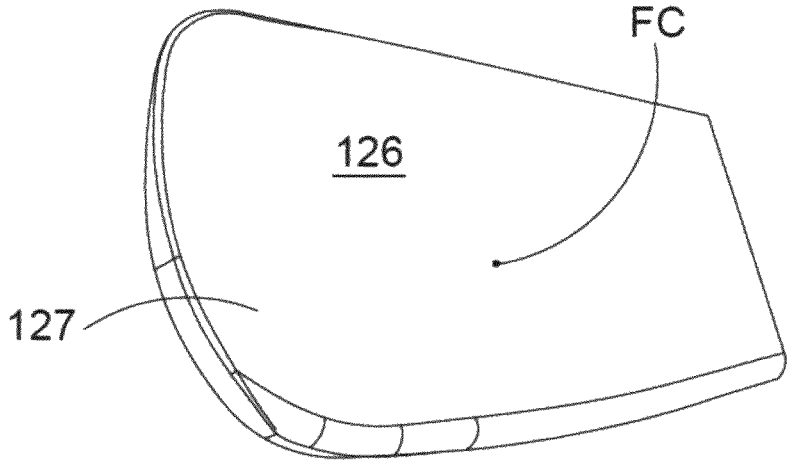
FIG. 3 of the accompanying drawings shows a golf club head intermediary layer that is juxtaposed the body portion of FIG. 1 and the face cup of FIG. 2.
Figure 4:
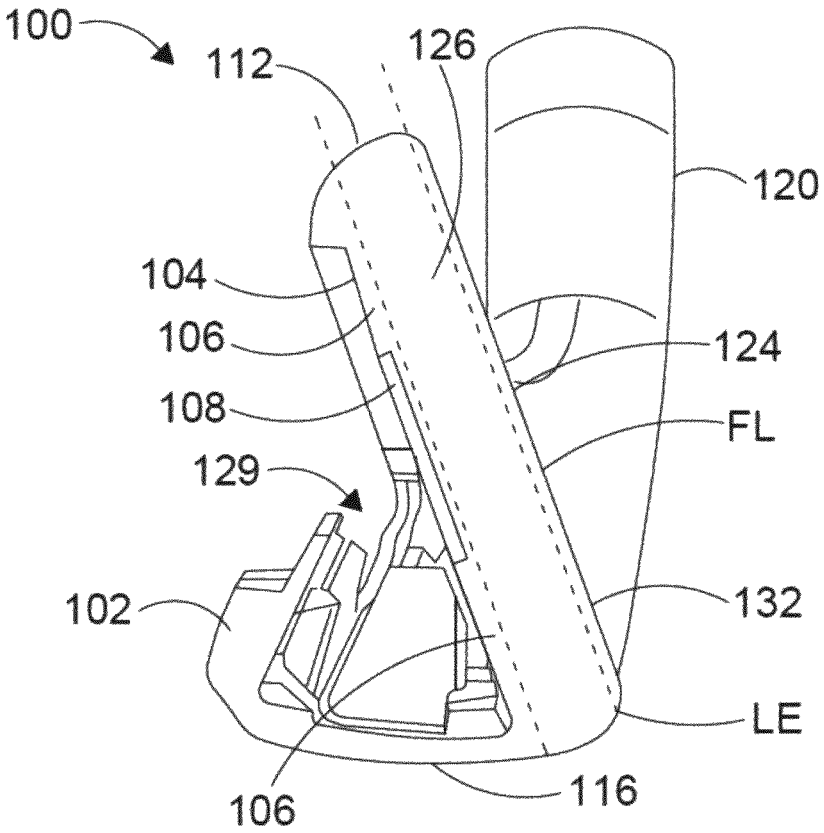
FIG. 4 of the accompanying drawings shows a cross-sectional view of the golf club head in accordance with FIGS. 1-3.

FIG. 3 shows an intermediary sandwiched layer 126 that is sandwiched in the cavity between a back surface of the frontal face portion 124 and the internal face support 104. The intermediary sandwiched layer 126 has a frontal facing surface 127 that is substantially the same area as the back surface of the frontal face portion 124. Preferably, intermediary sandwiched layer 126 is supported by the internal face support 104 around its perimeter, i.e., the intermediary sandwiched layer 126 is supported by the internal face support perimeter support portion 106 near the topline portion 112, the toe portion 114, the sole portion 116, and the heel portion 118. However, the internal face support 104 has a hollow center portion 108 that doesn't support the intermediary sandwiched layer 126 like the perimeter support portion 106 does. Preferably, the center portion 108 circumscribes the face center FC projection to allow the face center FC of the external frontal face portion 124 to deflect at impact to improve the overall striking face COR.

The external frontal face portion 124 is preferably formed of steel and located at an external frontal portion of the striking face portion 110. The external frontal face portion 124 has a substantially planar striking outer surface 132 that includes a plurality of grooves, not shown. More preferably, the external frontal face portion 124 is formed of a high strength steel having an Ultimate Tensile Strength of greater than 2000 MPa and more preferably greater than 2300 MPa. Most preferably, the external frontal face portion 124 is formed from AerMet 340 or the like. Moreover, it is preferred that the external frontal face portion 124 has a uniform thickness of about 0.6 mm to about 2.4 mm. Most preferably, the external frontal face portion 124 has a uniform thickness of about 1.4 mm to about 1.8 mm. This thin external frontal face portion 124 and its high strength assist in creating the high COR of the golf club head 100.

The internal face support 104 is formed in an internal hollow portion 129 of the golf club head 100. The internal face support 104 is preferably formed from steel having a tensile strength of about 400 MPa or greater and can be cast as a portion of the golf club head body portion 102 or formed of sheet metal, stamped or forged to shape and welded to the golf club head body 102. Preferably, the internal face support 104 has a thickness that is between about 0.5 mm and 5 mm, and more preferably, between about 0.8 mm and 2 mm.

The striking face portion 110 is abutted by the intermediary sandwiched layer 126, which is juxtaposed between the frontal face portion 124 and the internal face support 104. Preferably, intermediary sandwiched layer 126 is supported by the internal face support 104 around its perimeter, i.e., the intermediary sandwiched layer 126 is supported along the topline portion, the toe portion, the sole portion and the heel portion. This helps improve the overall striking face COR.

The intermediary sandwiched layer 126 is a polymeric material having a tensile strength within the range of about 4 MPa and 20 MPa and more preferably, 6 MPa and 12 MPa, when measured according to ASTM D412. The intermediary sandwiched layer 126 can be pre-formed and inserted into the cavity or can be injection molded into the cavity between the back surface of the frontal face portion 124 and the internal face support 104. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 126 is comprised of a silicone material, and more preferably, a silicone rubber such as SH9151U sold by KCC Silicone Corporation. Furthermore, the intermediary sandwiched layer 126 preferably has a substantially uniform thickness of about 1 mm to 10 mm, and more preferably, between about 3 mm and 7 mm. The intermediary sandwiched layer 126 is also preferably at least twice as thick as the external frontal face portion thickness at the face center FC.

As stated above, the intermediary sandwiched layer 126 is supported by the internal face support perimeter support portion 106 near the topline portion 112, the toe portion 114, the sole portion 116, and the heel portion 118. The perimeter support portion 106 preferably has a width of between about 2 mm and 20 mm. More preferably, the perimeter support portion 106 has a first topline width $W_{TL}$ adjacent the topline portion 112 that is between about 2 mm and 5 mm and a second sole width $W_S$ that is adjacent the sole portion 116 that is between about 6 mm and 20 mm and is at least 1.5 times greater than the first width $W_{TL}$. Moreover, the internal face support 104 has a hollow center portion 108 that doesn't support the intermediary sandwiched layer 126 and abuts between 25% and 75% of the intermediary sandwiched layer back surface while the intermediary sandwiched layer 126 engages or covers between 90% and 100% of the back surface of the frontal face portion 124. Thus, the frontal face portion 124 is substantially dampened by the intermediary sandwiched layer 126, but 75% to 25% of the intermediary sandwiched layer 126 is unconstrained by the internal face support 104. Preferably, the center portion 108 circumscribes the face center FC projection to allow the face center FC of the external frontal face portion 124 to deflect at impact to improve the overall striking face COR.

Figure 5:
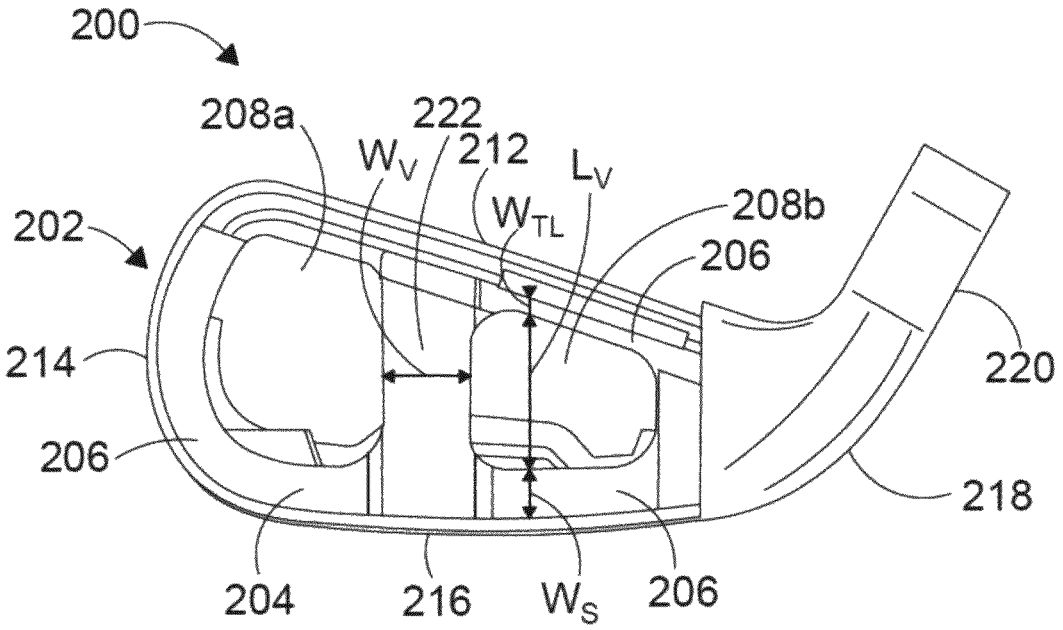
FIG. 5 of the accompanying drawings shows a frontal view of an alternate embodiment of the golf club head body in FIG. 1.

FIG. 5 discloses an alternate embodiment of the body disclosed in FIG. 1 and can be used with the striking face portion 110 and intermediary sandwiched layer 126 as discussed above and with reference to FIGS. 2 and 3, respectively. Golf club head 200 shown here has an aft body portion or body portion 202, including a topline portion 212, a toe portion 214, a sole portion 216, a heel portion 218 and hosel 220. The body portion 202 is further comprised of an internal face support 204 that includes a perimeter support portion 206 and a center portion 208. The perimeter support portion 206 is solid steel and preferably cast with the body portion 202 such that it is rigid with the body portion 202. The perimeter support portion 206 further surrounds the hollow center portion 208. This embodiment is further comprised of a vertical support portion 222 that divides the hollow center portion 208 into a hollow toe side portion 208*a* and a hollow heel side portion 208*b*. In this embodiment, the vertical support portion 222 is solid steel and is also preferably cast with the body portion 202.

As discussed above, the intermediary sandwiched layer 126 is supported by the internal face support 204 perimeter support portion 206 near the topline portion 212, the toe portion 214, the sole portion 216, and the heel portion 218. The intermediary sandwiched layer 126 is also supported by the vertical support portion 222 of the internal face support 204 behind the face center FC. The perimeter support portion 206 preferably has a width of between about 2 mm and 20 mm. More preferably, the perimeter support portion has a first topline width $W_{TL}$ adjacent the topline portion 212 that is between about 2 mm and 5 mm and a second sole width $W_S$ that is adjacent the sole portion 216 that is between about 6 mm and 20 mm and is at least 1.5 times greater than the first topline width $W_{TL}$. Moreover, the internal face support 204 has hollow center portions 208*a* and 208*b* that don't support the intermediary sandwiched layer 126, and the internal face support 204 abuts between 25% and 75% of the back surface of the intermediary sandwiched layer 126 such that 75% to 25% of the intermediary sandwiched layer 126 is unconstrained. In this embodiment, the vertical support portion 222 has vertical support length $L_V$ and a vertical support width $W_V$. The vertical support length $L_V$ is measured from the topline section of the perimeter support portion 206 to the sole section of the perimeter support portion 206. Preferably, the vertical support length $L_V$ is between about 15 mm and 30 mm and the vertical support width $W_V$ is between about 8 mm and 15 mm. Most preferably, the vertical support width $W_V$ is between about 30% and 70% of the vertical support length $L_V$. In this manner, the COR of the striking face portion 110 at face center FC can be controlled to be similar to the COR at ½ inch from face center FC towards the toe and ½ inch from face center FC towards the heel.

Figure 6:
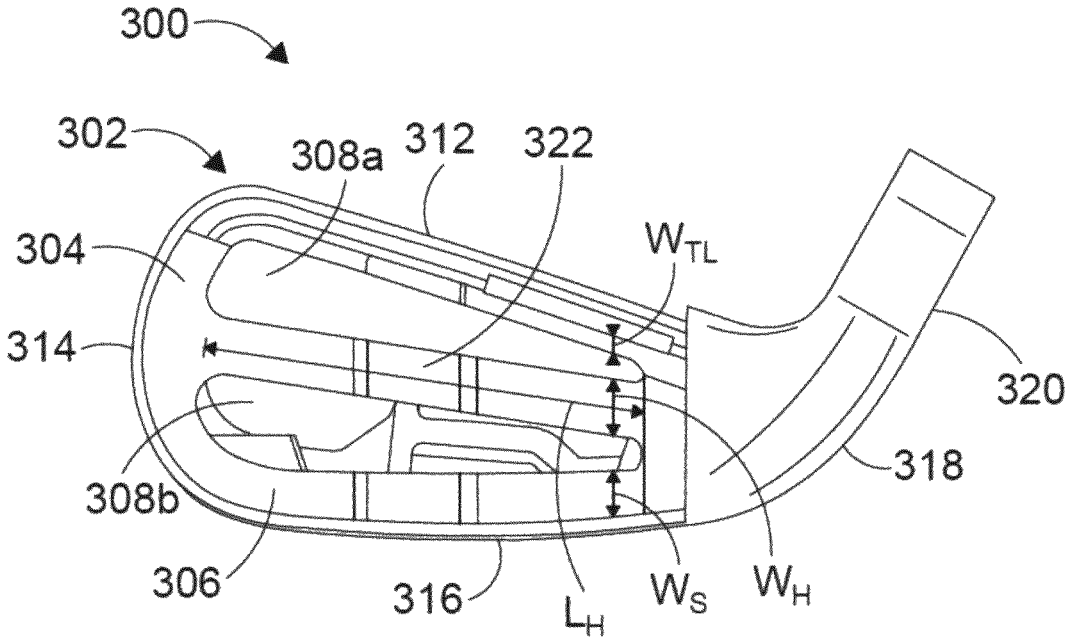
FIG. 6 of the accompanying drawings shows a frontal view of an alternate embodiment of the golf club head body in FIG. 1.

FIG. 6 discloses an alternate embodiment of the body disclosed in FIG. 1 and can be used with the striking face portion 110 and intermediary sandwiched layer 126 as discussed above and with reference to FIGS. 2 and 3, respectively. Golf club head 300 shown here has an aft body portion or body portion 302, including a topline portion 312, a toe portion 314, a sole portion 316, a heel portion 318 and hosel 320. The body portion 302 is further comprised of an internal face support 304 that includes a perimeter support portion 306 and a center portion 308. The perimeter support portion 306 is solid steel and preferably cast with the body portion 302 such that it is rigid with the body portion. The perimeter support portion 306 further surrounds the hollow center portion 308. This embodiment is further comprised of a horizontal support portion 322 that divides the hollow center portion 308 into a hollow top portion 308*a* and a hollow bottom portion 308*b*. In this embodiment, the horizontal support portion 322 is solid steel and is also preferably cast with the body portion 302.

As discussed above, the intermediary sandwiched layer 126 is supported by the internal face support 304 perimeter support portion 306 near the topline portion 312, the toe portion 314, the sole portion 316, and the heel portion 318. The intermediary sandwiched layer 126 is also supported by the horizontal support portion 322 of the internal face support 304 behind the face center FC. The perimeter support portion 306 preferably has a width of between about 2 mm and 20 mm. More preferably, the perimeter support portion has a first topline width $W_{TL}$ adjacent the topline portion 312 that is between about 2 mm and 5 mm and a second sole width $W_S$ that is adjacent the sole portion 316 that is between about 6 mm and 20 mm and is at least 1.5 times greater than the first topline width $W_{TL}$. Moreover, the internal face support 304 has hollow center portions 308*a* and 308*b* that don't support the intermediary sandwiched layer 126, and the internal face support 304 abuts between 25% and 75% of the back surface of the intermediary sandwiched layer 126 such that 75% to 25% of the intermediary sandwiched layer 126 is unconstrained. In this embodiment, the horizontal support portion 322 has horizontal support length $L_H$ and a horizontal support width $W_H$. The horizontal support length $L_H$ is measured from the heel portion of the perimeter support portion 306 to the toe portion of the perimeter support portion 306. Preferably, the horizontal support length $L_H$ is between about 40 mm and 80 mm and the horizontal support width $W_H$ is between about 5 mm and 10 mm. Most preferably, the horizontal support width $W_H$ is between about 5% and 25% of the horizontal support length $L_H$. In this manner, the COR of the striking face portion 110 at face center FC can be controlled across the striking face portion 110 and a solid feel can be achieved.

Figure 7:
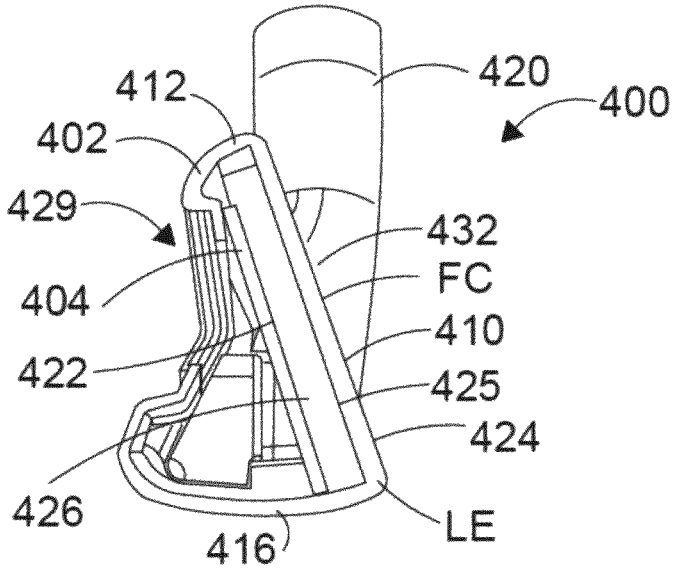
FIG. 7 of the accompanying drawings shows a cross-sectional view of an alternative embodiment of the golf club head in accordance with the present invention.
Figure 8:
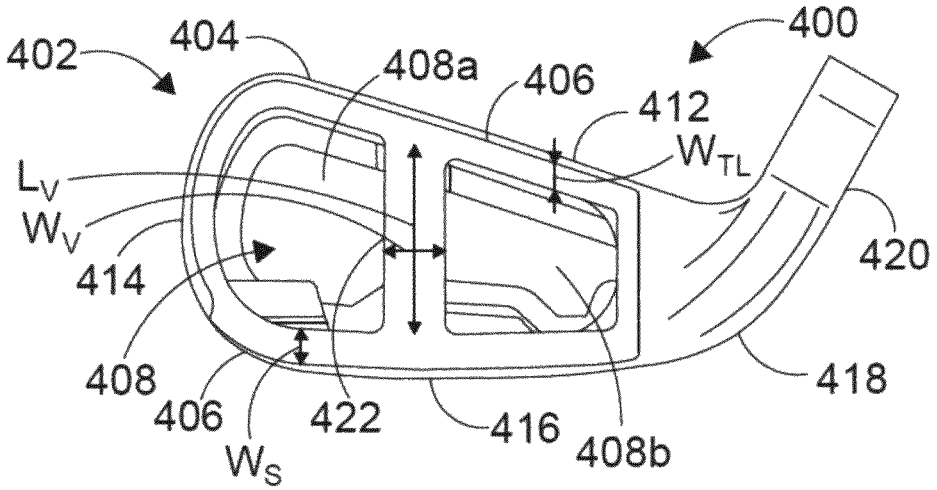
FIG. 8 of the accompanying drawings shows a frontal view of an alternate embodiment of the golf club head body in FIGS. 1 and 7.

FIGS. 7 and 8 of the accompanying drawings shows a golf club head 400 in accordance with an exemplary embodiment of the present invention. Golf club head 400 shown has an aft body portion or body portion 402, including a topline portion 412, a toe portion 414, a sole portion 416, a heel portion 418 and hosel 420. Golf club head 400 is further comprised of a striking face portion 410 which is coupled, preferably by welding to or by integrally casting with the body portion 402 to form a cavity therebetween. The golf club head 400 is further comprised of an internal face support 404 that includes a perimeter support portion 406 and a center portion 408. The perimeter support portion 406 is preferably a thermoplastic insert that is positioned within the body portion 402 such that it is rigid with the body portion 402. The perimeter support portion 406 further surrounds the hollow center portion 408. This embodiment is further comprised of a vertical support portion 422 that divides the hollow center portion 408 into a hollow toe side portion 408*a* and a hollow heel side portion 408*b*.

The striking face portion 410 shown in FIG. 7 includes a frontal face portion 424 having a face center FC. The frontal face portion 424 can be formed as a face cup such that it forms the leading-edge LE and has a toe portion, topline portion and a sole portion that couple to the body portion's toe portion 414, topline portion 412 and sole portion 416, respectively, preferably by welding. The external frontal face portion 424 is preferably formed of steel and located at an external frontal portion of the striking face portion 410. The external frontal face portion 424 has a substantially planar striking outer surface 432 that includes a plurality of grooves, not shown. More preferably, the external frontal face portion 424 is formed of a high strength steel having an Ultimate Tensile Strength of greater than 2000 MPa and more preferably greater than 2300 MPa. Most preferably, the external frontal face portion 424 is formed from AerMet 340 or the like. Moreover, it is preferred that the external frontal face portion 424 has a uniform thickness of about 0.6 mm to about 2.4 mm. Most preferably, the external frontal face portion 424 has a uniform thickness of about 1.4 mm to about 1.8 mm. This thin external frontal face portion 424 and its high strength assist in creating the high COR of the golf club head 400. Alternatively, the striking face portion 410 can be integrally cast with and be formed out of the same steel as the body portion 402.

An intermediary sandwiched layer such as 426 shown in FIG. 7 is sandwiched in the cavity between a back surface of the frontal face portion 424 and the internal face support 404. The intermediary sandwiched layer 426 has a frontal facing surface 425 that is substantially the same area as the back surface of the frontal face portion 424. Preferably, intermediary sandwiched layer 426 is supported by the internal face support 404 around its perimeter, i.e., the intermediary sandwiched layer 426 is supported by the internal face support perimeter support portion 406 near the topline portion 412, the toe portion 414, the sole portion 416, and the heel portion 418. However, the internal face support 404 has a hollow center portion 408 that doesn't support the intermediary sandwiched layer 426 like the perimeter support portion 406 does such that the intermediary sandwiched layer 426 is at least partially unconstrained.

The internal face support 404 is secured in an internal hollow portion 429 of the golf club head 400. The internal face support 404 is preferably formed from a thermoplastic material or thermoplastic composite having a tensile strength of about 60 MPa to 300 MPa and a flexural modulus of between about 2000 MPa and 8000 MPa. Preferably, the internal face support 404 has a thickness that is between about 0.5 mm and 5 mm, and more preferably, between about 0.8 mm and 2 mm.

As discussed above, the intermediary sandwiched layer 426 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 426 is comprised of a silicone material, and more preferably, a silicone rubber such as SH9151U sold by KCC Silicone Corporation. Furthermore, the intermediary sandwiched layer 426 preferably has a substantially uniform thickness of about 1 mm to 10 mm, and more preferably, between about 3 mm and 7 mm. The intermediary sandwiched layer 426 is also preferably at least twice as thick as the external frontal face portion thickness at the face center FC.

As stated above, the perimeter support portion 406 preferably has a width of between about 2 mm and 20 mm. More preferably, the perimeter support portion has a first topline width $W_{TL}$ adjacent the topline portion 412 that is between about 2 mm and 5 mm and a second sole width $W_S$ that is adjacent the sole portion 416 that is between about 6 mm and 20 mm and is at least 1.5 times greater than the first width $W_{TL}$. Moreover, the internal face support 404 has a hollow center portion 408 that doesn't support the intermediary sandwiched layer 426 and abuts between 25% and 75% of the intermediary sandwiched layer back surface while the intermediary sandwiched layer 426 engages or covers between 90% and 100% of the back surface of the external frontal face portion 424. Thus, the external frontal face portion 424 is substantially dampened by the intermediary sandwiched layer 426, but 75% to 25% of the intermediary sandwiched layer 426 is unconstrained by the internal face support 404. In this embodiment, the vertical support portion 422 has vertical support length $L_V$ and a vertical support width $W_V$. The vertical support length $L_V$ is measured from the topline section of the perimeter support portion 406 to the sole section of the perimeter support portion 406. Preferably, the vertical support length $L_V$ is between about 15 mm and 30 mm and the vertical support width $W_V$ is between about 8 mm and 15 mm. Most preferably, the vertical support width $W_V$ is between about 30% and 70% of the vertical support length $L_V$. In this manner, the COR of the striking face portion 410 at face center FC can be controlled to be similar to the COR at ½ inch from face center FC towards the toe and ½ inch from face center FC towards the heel.

Figure 9:
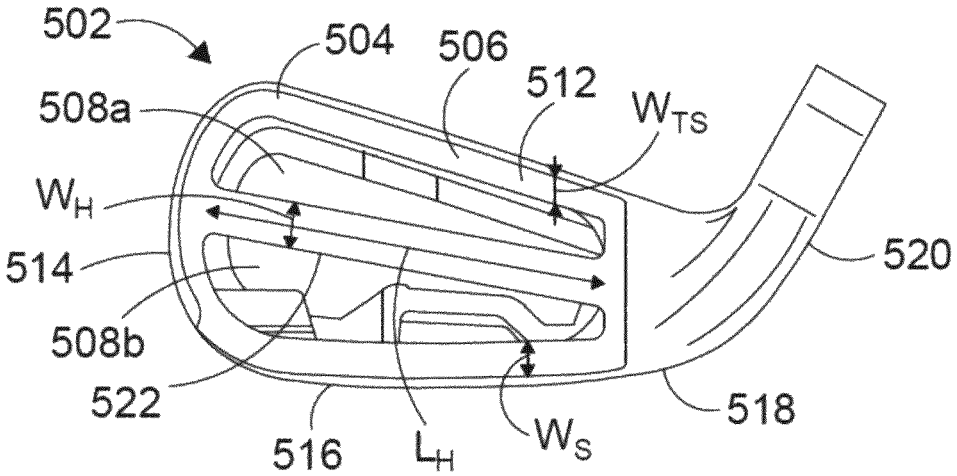
FIG. 9 of the accompanying drawings shows a frontal view of an alternate embodiment of the golf club head body in FIGS. 1 and 7.

FIG. 9 of the accompanying drawings shows a golf club head body portion 502 that can be combined with the striking face portion 110 disclosed in FIG. 2. In accordance with an exemplary embodiment of the present invention, aft body portion or body portion 502, including a topline portion 512, a toe portion 514, a sole portion 516, a heel portion 518 and hosel 520. The golf club head is further comprised of the striking face portion 110 which is coupled, preferably by welding to or by integrally casting with the body portion 502 to form a cavity therebetween. The golf club head is further comprised of an internal face support 504 that includes a perimeter support portion 506 and a center portion 508. The perimeter support portion 506 is preferably a thermoplastic insert that is positioned within the body portion 502 such that it is rigid with the body portion 502. The perimeter support portion 506 further surrounds the hollow center portion 508. This embodiment is further comprised of a horizontal support portion 522 that divides the hollow center portion 508 into a hollow toe side portion 508*a* and a hollow heel side portion 508*b*.

Again, the striking face portion 110 shown in FIG. 2 includes a frontal face portion 124 having a face center FC. The frontal face portion 124 can be formed as a face cup such that it forms the leading-edge LE and has a toe portion, topline portion and a sole portion that couple to the body portion's toe portion 514, topline portion 512 and sole portion 516, respectively, preferably by welding. The external frontal face portion 124 is preferably formed of steel and located at an external frontal portion of the striking face portion 110. The external frontal face portion 124 has a substantially planar striking outer surface 132 that includes a plurality of grooves, not shown. More preferably, the external frontal face portion 124 is formed of a high strength steel having an Ultimate Tensile Strength of greater than 2000 MPa and more preferably greater than 2300 MPa. Most preferably, the external frontal face portion 124 is formed from AerMet 340 or the like. Moreover, it is preferred that the external frontal face portion 124 has a uniform thickness of about 0.6 mm to about 2.4 mm. Most preferably, the external frontal face portion 124 has a uniform thickness of about 1.4 mm to about 1.8 mm. This thin external frontal face portion 124 and its high strength assist in creating the high COR of the golf club head. Alternatively, the striking face portion 110 can be integrally cast with and be formed out of the same steel as the body portion 102.

An intermediary sandwiched layer such as 126 shown in FIG. 3 is sandwiched in the cavity between a back surface of the frontal face portion 124 and the internal face support 504. The intermediary sandwiched layer 126 has a frontal facing surface 127 that is substantially the same area as the back surface of the frontal face portion 124. Preferably, intermediary sandwiched layer 126 is supported by the internal face support 504 around its perimeter, i.e., the intermediary sandwiched layer 126 is supported by the internal face support perimeter support portion 506 near the topline portion 512, the toe portion 514, the sole portion 516, and the heel portion 518. However, the internal face support 504 has a hollow center portion 508 that doesn't support the intermediary sandwiched layer 126 like the perimeter support portion 506 does such that the intermediary sandwiched layer 126 is at least partially unconstrained.

The internal face support 504 is secured in an internal hollow portion of the golf club head. The internal face support 504 is preferably formed from a thermoplastic material or thermoplastic composite having a tensile strength of about 60 MPa to 300 MPa and a flexural modulus of between about 2000 MPa and 8000 MPa. Preferably, the internal face support 504 has a thickness that is between about 0.5 mm and 5 mm, and more preferably, between about 0.8 mm and 2 mm.

As discussed above, the intermediary sandwiched layer 126 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 126 is comprised of a silicone material, and more preferably, a silicone rubber such as SH9151U sold by KCC Silicone Corporation. Furthermore, the intermediary sandwiched layer 126 preferably has a substantially uniform thickness of about 1 mm to 10 mm, and more preferably, between about 3 mm and 7 mm. The intermediary sandwiched layer 126 is also preferably at least twice as thick as the external frontal face portion thickness at the face center FC.

As stated above, the perimeter support portion 506 preferably has a width of between about 2 mm and 20 mm. More preferably, the perimeter support portion has a first topline width $W_{TL}$ adjacent the topline portion 512 that is between about 2 mm and 5 mm and a second sole width $W_S$ that is adjacent the sole portion 516 that is between about 6 mm and 20 mm and is at least 1.5 times greater than the first width $W_{TL}$. Moreover, the internal face support 504 has a hollow center portion 508 that doesn't support the intermediary sandwiched layer 126 and abuts between 25% and 75% of the intermediary sandwiched layer back surface while the intermediary sandwiched layer 126 engages or covers between 90% and 100% of the back surface of the external frontal face portion 124. Thus, the external frontal face portion 124 is substantially dampened by the intermediary sandwiched layer 126, but 75% to 25% of the intermediary sandwiched layer 126 is unconstrained by the internal face support 504. In this embodiment, the horizontal support portion 522 has horizontal support length $L_H$ and a horizontal support width $W_H$. The horizontal support length $L_H$ is measured from the heel portion of the perimeter support portion 506 to the toe portion of the perimeter support portion 506. Preferably, the horizontal support length $L_H$ is between about 40 mm and 80 mm and the horizontal support width $W_H$ is between about 5 mm and 10 mm. Most preferably, the horizontal support width $W_H$ is between about 5% and 25% of the horizontal support length $L_H$. In this manner, the COR of the striking face portion 110 at face center FC can be controlled across the striking face portion 110 and a solid feel can be achieved.

Figure 10:
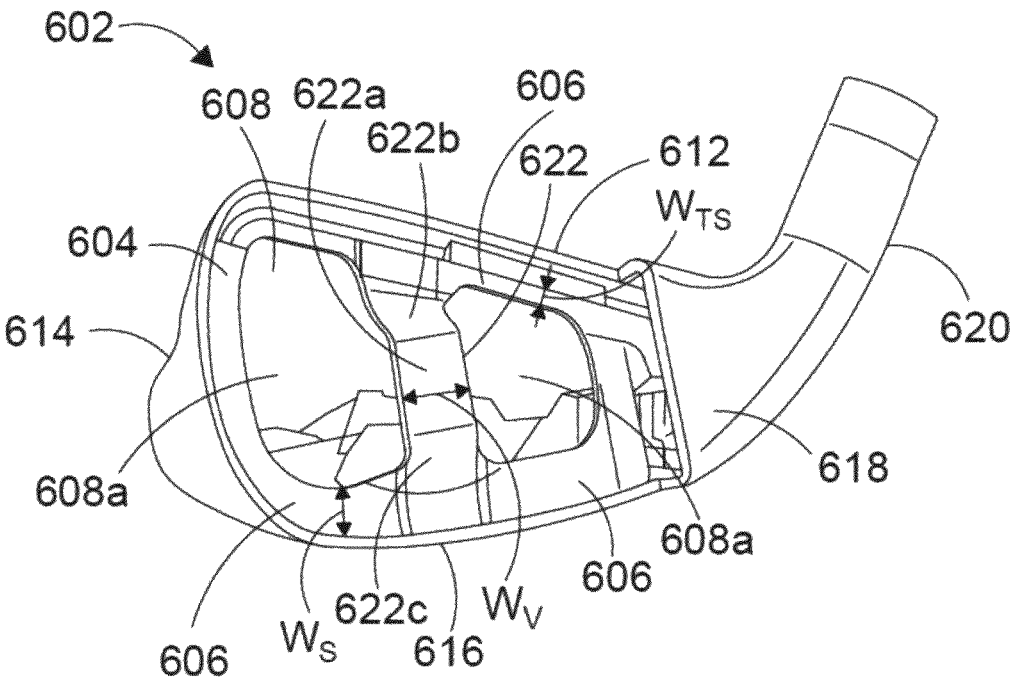
FIG. 10 of the accompanying drawings shows a frontal view the golf club head body portion in accordance with an alternate embodiment of the present invention in FIG. 6.
Figure 11:
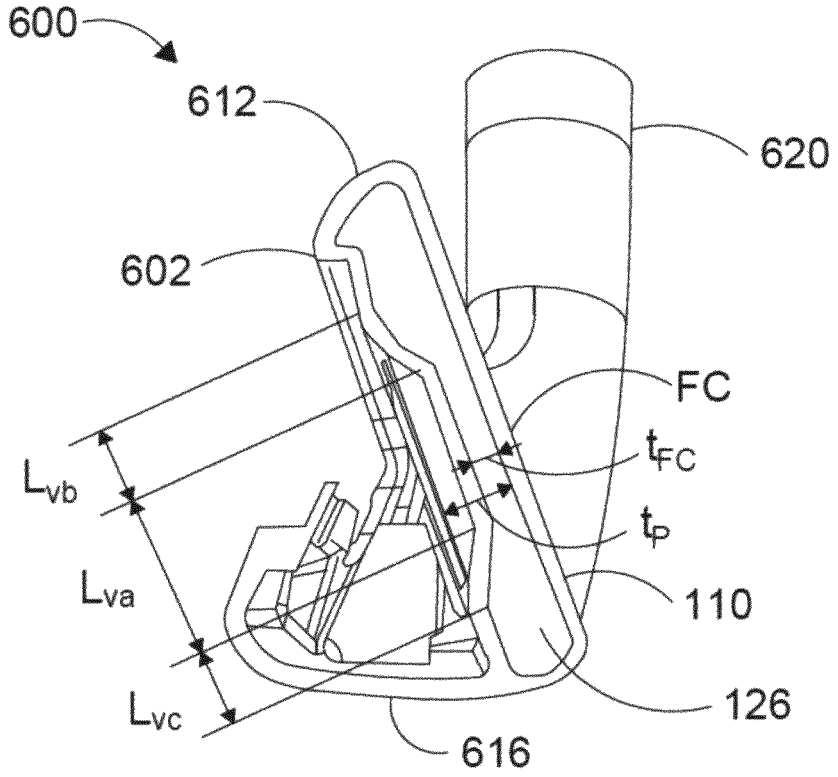
FIG. 11 of the accompanying drawings shows a cross-sectional view of a portion of the golf club head in the embodiment in FIG. 10.

FIGS. 10 and 11 discloses an alternate embodiment of the golf club head body disclosed in FIG. 5 and can be interchanged for the body portion 202 and used with the striking face portion 110 and intermediary sandwiched layer 126 as discussed above and with reference to FIGS. 2 and 3, respectively, as discussed above. Golf club head 600 shown here has an aft body portion or body portion 602, including a topline portion 612, a toe portion 614, a sole portion 616, a heel portion 618 and hosel 620. The body portion 602 is further comprised of an internal face support 604 that includes a perimeter support portion 606 and a center portion 608. The perimeter support portion 606 is solid steel and preferably cast with the body portion 602 such that it is rigid with the body portion 602. The perimeter support portion 606 further surrounds the hollow center portion 608. This embodiment is further comprised of a vertical support portion 622 that divides the hollow center portion 608 into a hollow toe side portion 608*a* and a hollow heel side portion 608*b*. In this embodiment, the vertical support portion 622 is solid steel and is also preferably cast with the body portion 602.

As discussed above, the intermediary sandwiched layer 126 is supported by the internal face support 604 perimeter support portion 606 near the topline portion 612, the toe portion 614, the sole portion 616, and the heel portion 618. The intermediary sandwiched layer 126 is also supported by the vertical support portion 622 of the internal face support 604 behind the face center FC. The perimeter support portion 606 preferably has a width of between about 2 mm and 20 mm. More preferably, the perimeter support portion has a first topline width $W_{TL}$ adjacent the topline portion 612 that is between about 2 mm and 5 mm and a second sole width $W_S$ that is adjacent the sole portion 616 that is between about 6 mm and 20 mm and is at least 1.5 times greater than the first topline width $W_{TL}$. Moreover, the internal face support 604 has hollow center portions 608*a* and 608*b* that don't support the intermediary sandwiched layer 126, and the internal face support 604 abuts between 25% and 75% of the back surface of the intermediary sandwiched layer 126 such that 75% to 25% of the intermediary sandwiched layer 126 is unconstrained. In this embodiment, the vertical support portion 622 has vertical support length $L_{VA}$, $L_{VB}$, and $L_{VC}$ and a vertical support width $W_V$. The vertical support length $L_{VA}$, $L_{VB}$, and $L_{VC}$ is measured from the topline section of the perimeter support portion 606 to the sole section of the perimeter support portion 606. Preferably, the vertical support length $L_{VA}$, $L_{VB}$, and $L_{VC}$ is between about 15 mm and 30 mm and the vertical support width $W_V$ is between about 8 mm and 15 mm. Most preferably, the vertical support width $W_V$ is between about 30% and 70% of the vertical support length $L_{VA}$, $L_{VB}$, and $L_{VC}$. In this manner, the COR of the striking face portion 110 at face center FC can be controlled to be similar to the COR at ½ inch from face center FC towards the toe and ½ inch from face center FC towards the heel. In this embodiment, the vertical support portion 622 is further divided into three portions, the center vertical support portion 622*a*, the top vertical support portion 622*b* and the bottom vertical support portion 622*c*. Preferably, the center vertical support portion 622*a* is substantially closer to the striking face portion 110 such that the intermediary sandwiched layer 126 has a first thickness at the face center $t_{FC}$ that is less than second perimeter thickness surrounding the face center $t_P$. As shown, the top vertical support portion 622*b* and the bottom vertical support portion 622*c* couple the center vertical portion 622 to the perimeter support portion 606 but are angled from the perimeter support portion 606 toward the striking face portion 110. In this manner, the first thickness at the face center $t_{FC}$ is between about 80% and 40% of the second perimeter thickness $t_P$ ½ inch from face center toward the toe portion 614 and heel portion 618. Preferably, the center vertical support portion 622*a* has a center vertical support length $L_{VA}$, the top vertical support portion 622*b* has a top vertical support length $L_{VB}$ and the bottom vertical support portion 622*c* has a bottom vertical support length $L_{VC}$. In the preferred embodiment, the center vertical support length $L_{VA}$ is at least 20% greater than both the top vertical support length $L_{VB}$ and the bottom vertical support length $L_{VC}$. In this manner, the COR of the striking face portion 110 can be held more constant in the areas around the face center FC.

Figure 12:
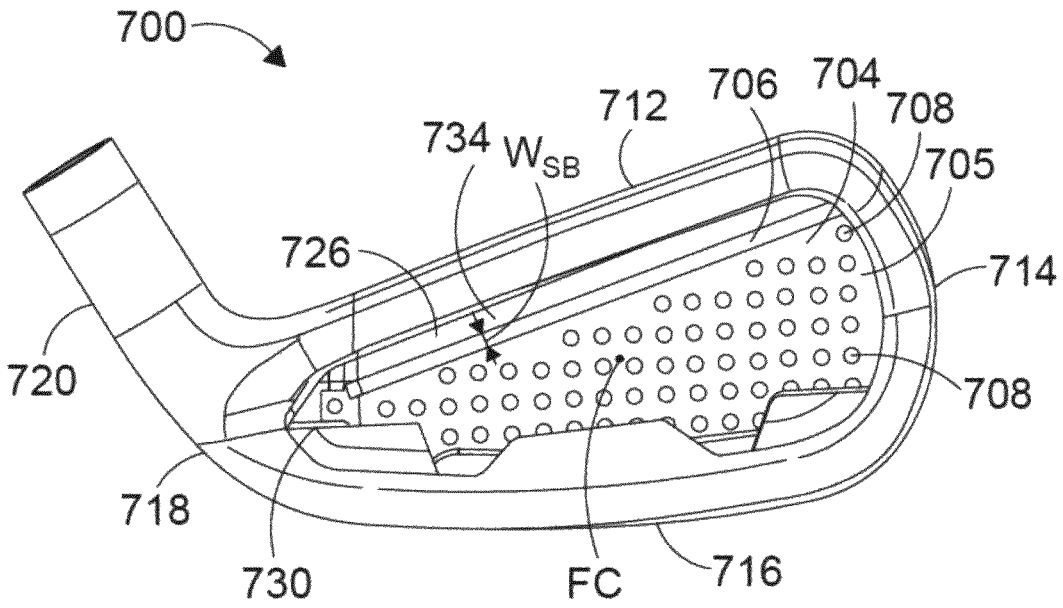
FIG. 12 of the accompanying drawings shows a back view of a golf club head in accordance with an embodiment of the present invention.
Figure 13:
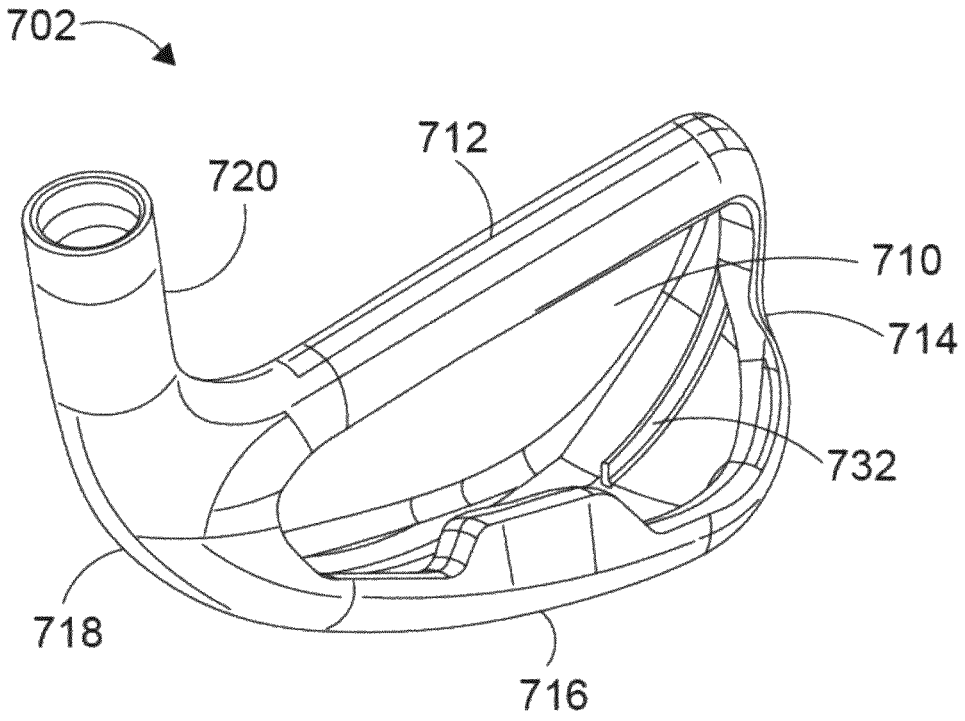
FIG. 13 of the accompanying drawings shows a perspective view of the aft body portion of the golf club head in FIG. 12.

FIGS. 12 and 13 of the accompanying drawings shows a golf club head 700 and golf club head body portion 702, respectively. In accordance with an exemplary embodiment of the present invention, aft body portion or body portion 702, including a topline portion 712, a toe portion 714, a sole portion 716, a heel portion 718 and hosel 720 can be integrally cast with the striking face portion 710. The golf club head is further comprised of an internal face support 704 that includes a support bar portion 706, a center support portion 705 and a plurality of apertures 708. The internal face support 704 is preferably a thermoplastic insert, having a support layer tensile strength of between 60 MPa and 300 MP and a flexural modulus of between about 2000 MPa and 8000 MPa, that is positioned within the body portion 702 such that it is rigid with the body portion 702. The internal face support 704 is preferably coupled to the body portion 702 by abutting or snap fitting onto a plurality of lip portions 732 inside the body portion 702 and by a fastener 730 located near the heel portion 718. The support bar portion 706 is spaced from the topline portion 712 for easy insertion into the body portion 702, and therefore, creates a gap 734 between the topline portion 712 and the support bar portion 706. Preferably, the center support portion 705 has a thickness that is between about 0.5 mm and 5 mm, and more preferably, between about 0.8 mm and 2 mm. For structural stability, the support bar portion 706 has a width $W_{SB}$ that is between about 2 mm and 5 mm and a thickness that is at least 1.5 times the thickness of the center support portion 705.

An intermediary sandwiched layer such as 726 shown in FIG. 12 is sandwiched in the cavity between a back surface of the striking face portion 710 and the internal face support 704. The intermediary sandwiched layer 726 has a frontal facing surface that is substantially the same area as the back surface of the striking face portion 710. Preferably, the internal face support 704 has a plurality of apertures 708 and the gap 734 that do not support the intermediary sandwiched layer 726. Thus, the internal face support 704 only abuts between 25% and 75% of the intermediary sandwiched layer back surface while the intermediary sandwiched layer 726 engages or covers between 90% and 100% of the back surface of the striking face portion 710.

As discussed above, the intermediary sandwiched layer 726 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the golf club head 700 from being too heavy, the specific gravity of the polymer is preferably between about 0.95 and 1.2 and the polymer has a Shore A hardness of less than 75, and preferably between about 30 and 60. Preferably, the intermediary sandwiched layer 726 is comprised of a silicone material, and more preferably, a silicone rubber such as SH9151U sold by KCC Silicone Corporation. Furthermore, the intermediary sandwiched layer 726 preferably has a substantially uniform thickness of about 1 mm to 10 mm, and more preferably, between about 3 mm and 7 mm. The intermediary sandwiched layer 726 is also preferably at least twice as thick as the striking face portion 710 thickness at the face center FC.

Figure 14:
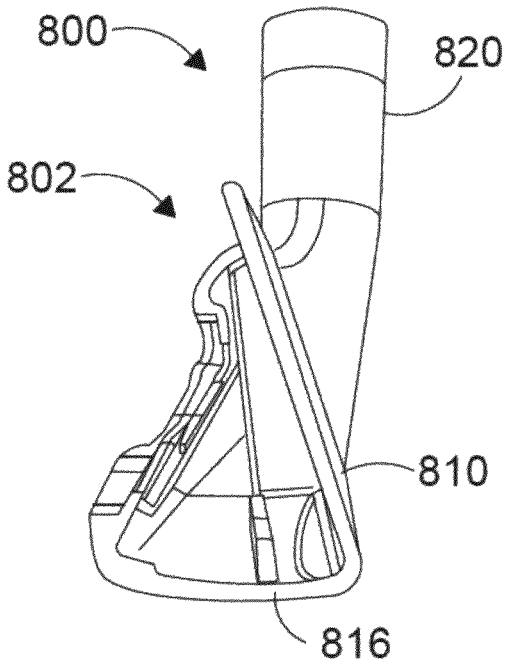
FIG. 14 of the accompanying drawings shows a cross-sectional view of an aft body portion of a golf club head in accordance with an embodiment of the present invention.
Figure 15:
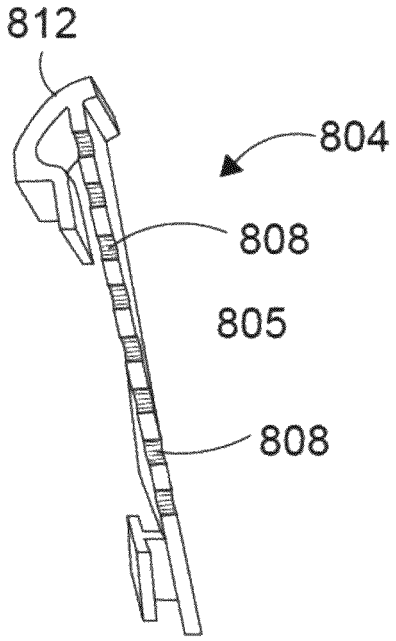
FIG. 15 of the accompanying drawings shows a cross-sectional view of an internal support layer of the golf club head in FIG. 14.
Figure 16:
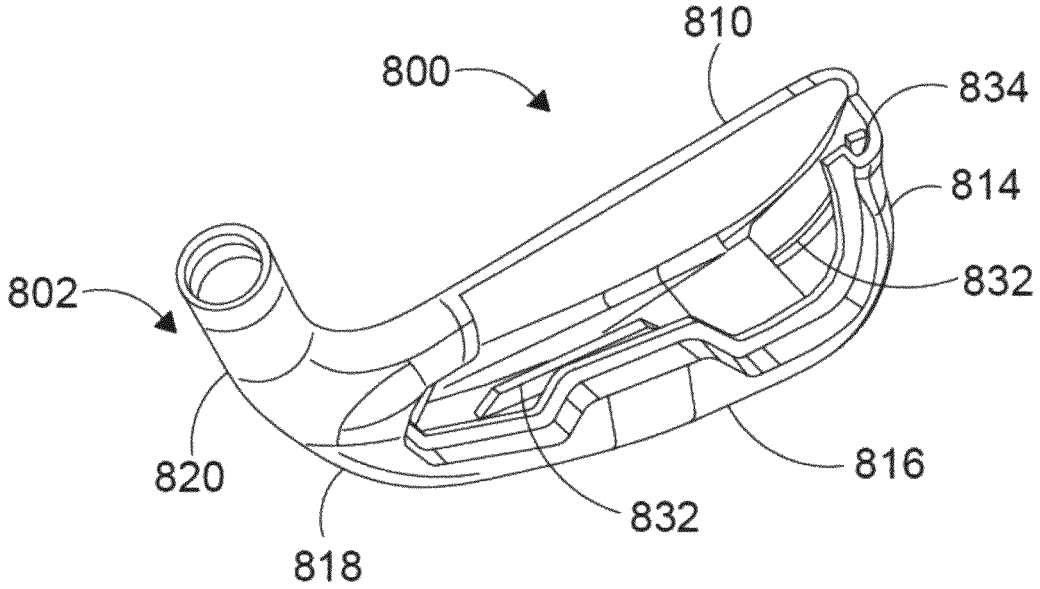
FIG. 16 of the accompanying drawings shows a rear, perspective view of the body portion of the golf club head in FIGS. 14-15.

FIGS. 14-16 of the accompanying drawings show portions of a golf club head 800. In accordance with an exemplary embodiment of the present invention, aft body portion or body portion 802, includes a toe portion 814, a sole portion 816, a heel portion 818 and hosel 820 that can be integrally cast with the striking face portion 810. The golf club head is further comprised of an internal face support 804 that includes a topline portion 812, a center support portion 805 and a plurality of apertures 808. Like above, the internal face support 804 is preferably a thermoplastic insert, having a support layer tensile strength of between 60 MPa and 300 MP and a flexural modulus of between about 2000 MPa and 8000 MPa, that is positioned within the body portion 802 such that it is rigid with the body portion 802. The internal face support 804 is preferably coupled to the body portion 802 by abutting or snap fitting onto a plurality of lip portions 832 inside the body portion 802 and ledge portions 834 at the toe portion 814 and heel portion 818. Fasteners can also be incorporated if necessary. Preferably, the center support portion 805 has a thickness that is between about 0.5 mm and 5 mm, and more preferably, between about 0.8 mm and 2 mm.

An intermediary sandwiched layer such as 726 shown in FIG. 12 is sandwiched in the cavity between a back surface of the striking face portion 810 and the internal face support 804. Preferably, the internal face support 804 has a plurality of apertures 808 that do not support the intermediary sandwiched layer 726. The internal face support 804 preferably only abuts between 25% and 75% of the intermediary sandwiched layer back surface while the intermediary sandwiched layer 726 engages or covers between 90% and 100% of the back surface of the striking face portion 810.

Figure 17:
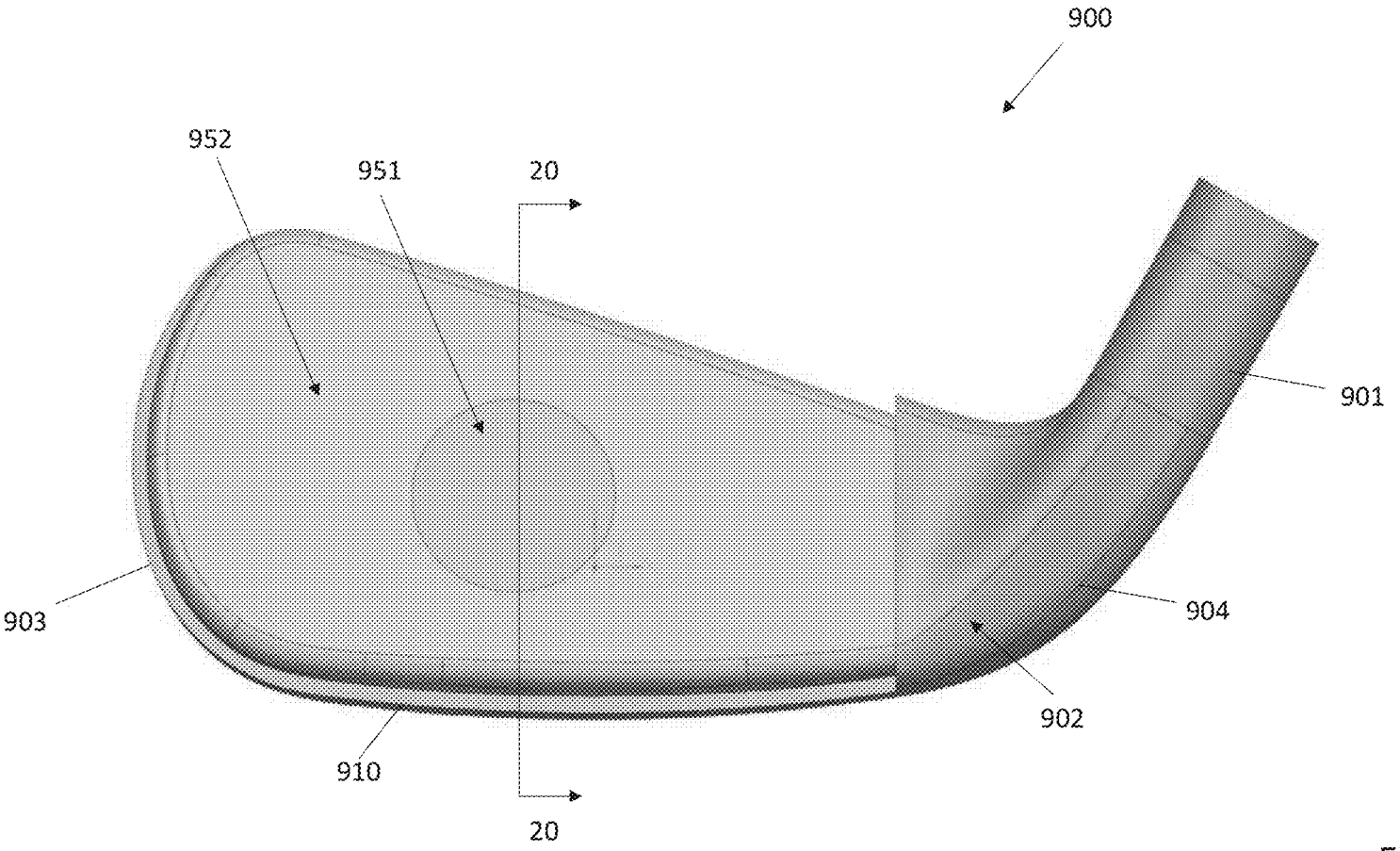
FIG. 17 of the accompanying drawings shows a front view of another golf club head without a striking face cup of the golf club head, according to some examples.
Figure 18:
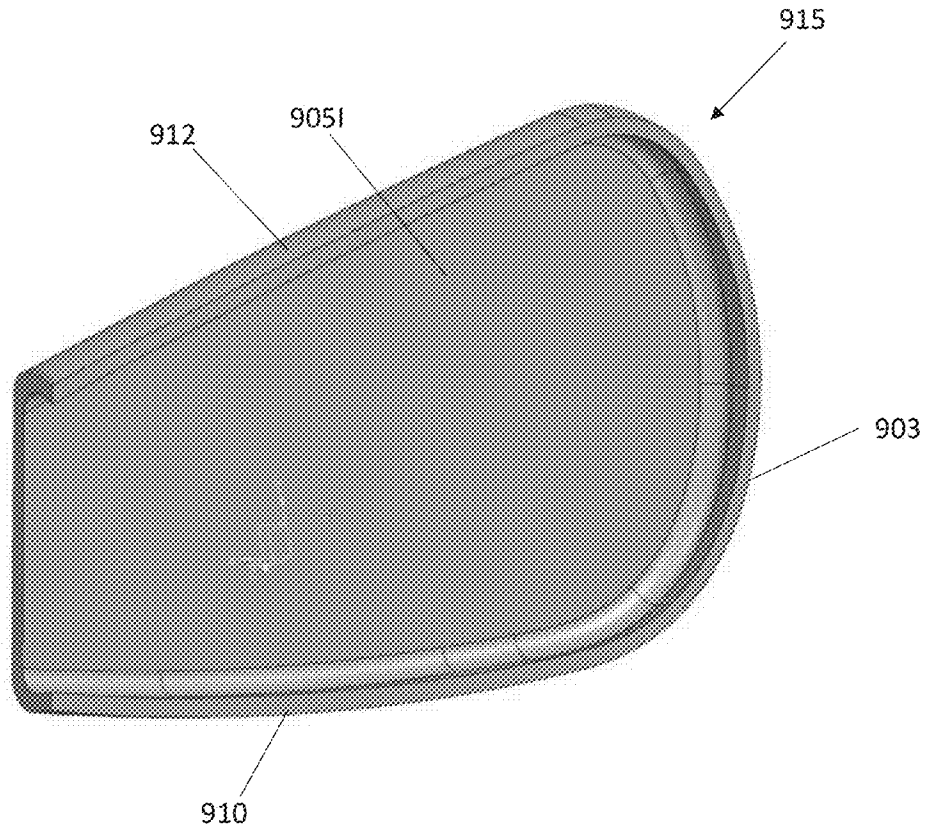
FIG. 18 of the accompanying drawings shows a rear, perspective view of the striking face cup of the golf club head of FIG. 17.
Figure 19:
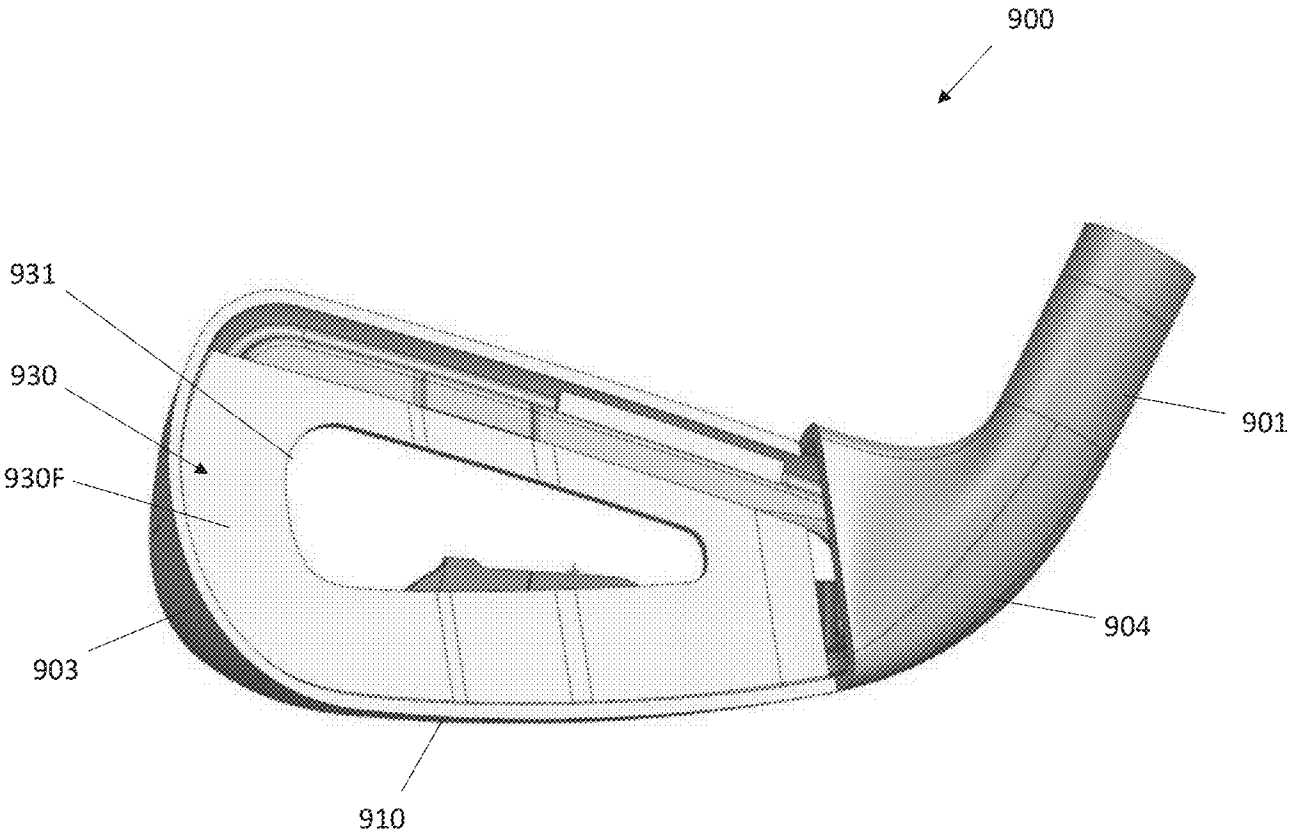
FIG. 19 of the accompanying drawings shows a front, perspective view of the golf club head of FIG. 17 without the striking face cup of the golf club head and without any polymers in a front cavity of the golf club head.
Figure 20:
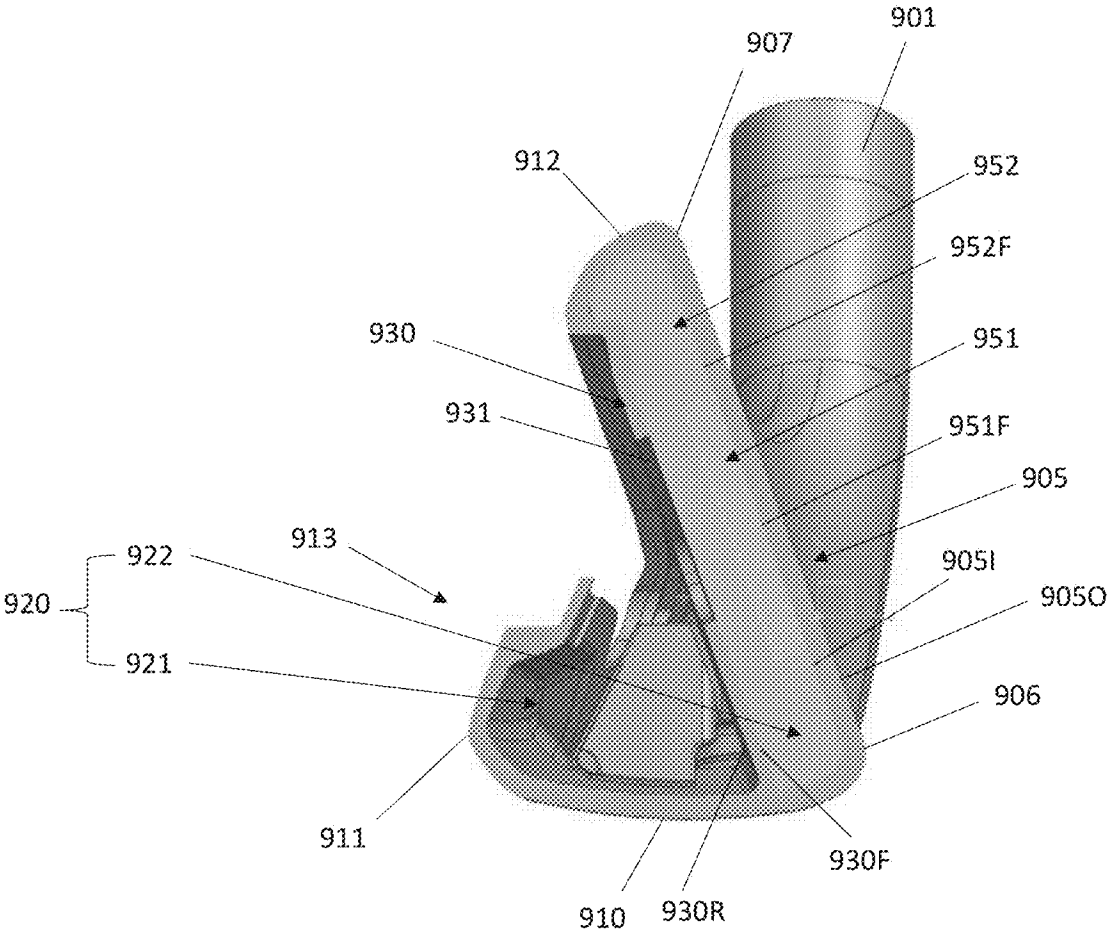
FIG. 20 of the accompanying drawings shows a cross-sectional view of the golf club head of FIG. 17 along line 20-20 in FIG. 17.

FIG. 17 of the accompanying drawings shows a front view of another golf club head 900 without a striking face portion of the golf club head 900, according to some examples. In the depicted example, the golf club head 900 is an iron type golf club head. FIG. 18 of the accompanying drawings shows a rear, perspective view of the striking face portion (in this example, a striking face cup 915) of the golf club head 900 of FIG. 17. FIG. 19 of the accompanying drawings shows a front, perspective view of the golf club head 900 of FIG. 17 without the striking face cup 915 of the golf club head 900 and without any polymers in a front cavity 922 of the golf club head 900. FIG. 20 of the accompanying drawings shows a cross-sectional view of the golf club head 900 of FIG. 17 along line 20-20 in FIG. 17.

Referring concurrently to FIGS. 17-20, the golf club head 900 may include a body 902 including a toe 903, a heel 904, a striking face 905 extending between the toe 903 and the heel 904 and having a lower leading edge 906 and an opposite upper topline edge 907, a sole 910 extending rearward from the lower leading edge 906 to a rearward portion 911, and a top portion 912 extending rearward from the upper topline edge 907. In the depicted example, the toe 903, the sole 910, and the top portion 912 may be comprised partly by a return portion of the striking face cup 915. The golf club head 900 may include a hosel 901 disposed at the heel 904 of the golf club head 900. The hosel 901 may be configured to attach to a golf club shaft (not shown).

The striking face 905 may have an outermost surface 905O facing the exterior of the golf club head 900, and an opposite interior surface 905I facing inwardly into the golf club head 900. The outermost surface 905O may be substantially flat and have defined therein one or more grooves (not shown) configured to, among other things, impart spin on a golf ball when struck by the striking face 905. For example, the outermost surface 905O may define a striking face plane that is tangential to an entire portion of a strip of the outermost surface 905O that is between a pair of adjacent grooves and that extends between a toe end of striking face 905 and a heel end of the striking face 905. The striking face plane may be tangential to a plurality of portions (e.g., to the entirety of each of the plurality of portions) of the outermost surface 905O that are separated by one or more of the grooves.

The golf club head 900 may include a striking face cup 915 that defines at least part of the striking face 905, and which may further define at least one of at least part of the top portion 912, at least part of the sole 910, or at least part of the toe 903. In some examples, during the manufacture of the golf club head 900, the striking face cup 915 may be fabricated separately from the remainder of the body 902, and the striking face cup 915 may be welded, adhered, or otherwise attached to the remainder of the body 902. The striking face cup 915 may include a different material (e.g., a material having a greater hardness) than that of the remainder of the body 902.

The golf club head 900 may include an intermediate wall 930 that at least partly defines a front cavity 922 between the striking face 905 and the intermediate wall 930. For example, the body 902 may at least partly surround (e.g., partly surround or entirely surround) a primary cavity 920, and the intermediate wall 930 may divide the primary cavity 920 into the front cavity 922 and a rear cavity 921 positioned rearward to the intermediate wall 930. The intermediate wall 930 may extend at least partly through the primary cavity 920, for example, between the sole 910 and the top portion 912.

The intermediate wall 930 may include a metal. In some examples, the material of the intermediate wall 930 is the same as the material of the striking face cup 915 and/or of the remainder of the body 902. During the manufacture of the golf club head 900, the intermediate wall 930 may be fabricated separated from the striking face cup 915 and/or from the remainder of the body 902, and the intermediate wall 930 may be welded, adhered, or otherwise attached to the body 902 and/or to the striking face cup 915.

The front cavity 922 may have a volume of less than about 15,000 $mm^3$, about 13,000 $mm^3$, or about 11,000 $mm^3$. In some examples, the front cavity 922 has a volume of more than about 5,000 $mm^3$, about 7,000 $mm^3$, or about 9,000 $mm^3$. The volume of the front cavity 922 may be at least about 20%, about 25%, about 30%, about 35%, about 45%, or about 50% of the total volume of the primary cavity 920 (e.g., the sum of the volume of the front cavity 922 and the volume of the rear cavity 921). In some examples, the volume of the front cavity 922 is less than about 75%, about 70%, about 65%, about 60%, about 55%, about 50%, about 45%, or about 40% of the total volume of the primary cavity 920.

The intermediate wall 930 may have a front surface 930F facing the striking face 905 and an opposite rear surface 930R facing away from the striking face 905. The front surface 930F may be substantially parallel to the interior surface 905I of the striking face 905. For example, a first virtual plane tangential to the front surface 930F of the intermediate wall 930 may be within 10 degrees, 7 degrees, 5 degrees, 3 degrees, 2 degrees, or 1 degree of being parallel to a second virtual plane tangential to the interior surface 905I of the striking face 905. In some examples, a distance between the front surface 930F of the intermediate wall 930 and the interior surface 905I of the striking face 905 (e.g., along a direction normal to at least one of the front surface 930F of the intermediate wall 930 or the interior surface 905I of the striking face) is substantially uniform (e.g., within 10%, 7%, 5%, 3%, 2%, or 1% of the average distance) across the front surface 930F of the intermediate wall 930. In some other examples, the front surface 930F and the interior surface 905I may be angled relative to one another. In some examples, the front surface 930F may be substantially parallel to the outermost surface 905O of the striking face 905.

In an example where the front surface 930F and the interior surface 905I are angled relative to each other, a smallest distance between the front surface 930F and the interior surface 905I in a first portion of the front cavity 922 (e.g., a toe-ward portion of the front cavity 922 or a lower portion of the front cavity 922 proximal to the sole 910) is smaller than a smallest distance between front surface 930F and the interior surface 905I in a second portion of the front cavity 922 (e.g., a heel-ward portion of the front cavity 922 or an upper portion of the front cavity 922 proximal to the top portion 912). In this comparison example, it can be difficult or impossible to insert a prefabricated polymer at least partially into the first portion of the front cavity 922 due to the reduced space in the first portion caused by the angled orientations of the front surface 930F and the interior surface 905I relative to each other. However, in some examples of the present disclosure where the front surface 930F and the interior surface 905I are substantially parallel, the smallest distance between the front surface 930F and the interior surface 905I in the first portion of the front cavity 922 can be increased to improve the ease by which a prefabricated polymer can be inserted at least partially into the first portion of the front cavity 922. In some examples where the front surface 930F and the interior surface 905I are angled relative to each other, one or more corresponding wedge-shaped prefabricated polymer(s) may be used, or the polymer(s) may be injected before being cured.

In some examples, the body 902 includes a back portion 913 positioned rearward to the striking face 905 and extending from at least one of the sole 910 (e.g., the rearward portion 911 of the sole 910) or the top portion 912. In the depicted example, the back portion 913 extends from the sole 910 toward the top portion 912 and is separated from the top portion 912 such that the rear cavity 921 is exposed to the exterior of the golf club head 900 through a gap in the body 902 between the back portion 913 and the top portion 912. In some examples, the back portion 913 is entirely omitted. In some other examples, the back portion 913 is coupled (e.g., extends entirely) between the sole 910 and the top portion 912, for example, such that the rear cavity 921 is entirely sealed from the exterior of the golf club head 900 between the sole 910 and the top portion 912. In some examples, the rear cavity 921 is partially open to the exterior of the golf club head 900.

The intermediate wall 930 may have one or more openings defined therein. In the depicted example, the intermediate wall 930 has one opening (a first opening 931) defined therein. In some other examples, the intermediate wall 930 includes a plurality of openings. The one or more openings of the intermediate wall 930 may expose the front cavity 922 to the rear cavity 921. During the manufacture of the golf club head 900, one or more polymer materials may be disposed into the front cavity 922 through the one or more openings in the intermediate wall 930 and through a gap in the body 902 between the sole 910 and the top portion 912 (e.g., a gap in the back portion 913). In some other examples, including some examples described hereinbelow, the intermediate wall does not include any openings, and the front cavity 922 is entirely sealed or separated from the rear cavity 921 across the intermediate wall 930.

In some examples, the intermediate wall 930 spans between the sole 905 and the top portion 912 and also between the toe 903 and the heel 904. A total area of the one or more openings (e.g., the first opening 931) in the intermediate wall 930 may be more than about 20%, about 30%, about 40%, about 50%, or about 60% of the total area of the intermediate wall 930 (e.g., the total area of the front surface 930F of the intermediate wall 930). The total area of the one or more openings in the intermediate wall 930 may be less than about 70%, about 60%, about 50%, or about 40% of the total area of the intermediate wall 930.

The golf club head 900 may include at least one polymer material that at least partly fills (e.g., partly fills or entirely fills) the front cavity 922. The at least one polymer material may be added to the front cavity 922 during the manufacture of the golf club head 900, for example, by prefabricating a polymer and physically inserting the prefabricated polymer into the front cavity 922 (e.g., through the first opening 931) and/or by injecting a liquid polymer into the front cavity 922 (e.g., through the first opening 931) and curing the liquid polymer into a solid polymer.

The one or more polymer materials have material properties (e.g., hardness, etc.) that cause the golf club head 900 to have certain performance characteristics when striking a golf ball with the striking face 905 based on the selected volumes, positions, and orientations of the one or more polymer materials in the front cavity 922. For example, the one or more polymer materials can improve the sound made when hitting the golf ball, improve the feel felt by a golfer when hitting the golf ball, and/or reduce the stress experienced by the golf club head when hitting the golf ball. Uniformity of golf ball speed across the striking face can also be improved. Example golf club heads described herein include features that increase the number of ways in which one or more polymer materials can be inserted into, positioned, and oriented within a front cavity, thereby improving the selectivity of performance characteristics that a golf club head can be provided with. These example golf club heads also include various polymer configurations (e.g., number of polymers, volumes, positions, and orientations) that can improve certain performance characteristics.

In some examples, the one or more polymer materials are only provided in the front cavity 922. For example, the one or more polymer materials that fill at least part of the front cavity 922 do not fill any part of the rear cavity 921. In some examples, the one or more polymer materials that fill at least part of the front cavity 922 fill only part (e.g., less than about 30%) of the rear cavity 921.

In the depicted example of FIGS. 17-20, the golf club head 900 includes a first polymer 951 and a second polymer 952 in the front cavity 922. The first and second polymers 951 and 952 may include different polymer materials. For example, a polymer material of the first polymer 951 may be greater than a hardness of a polymer material of the second polymer 952.

The first polymer 951 may have a front surface 951F in contact with the interior surface 905I of the striking face 905. In some examples, the front surface 951F of the first polymer 951 engages or covers only a portion of the interior surface 905I. The second polymer 952 may engage or cover at least part of the first polymer 951. For example, the second polymer 952 may be in contact with, and cover, a different portion of the interior surface 905I of the striking face 905. The second polymer 952 may at least partially surround a perimeter of the front surface 951F of the first polymer 951. In some examples, the second polymer 952 engages or covers at least part of a rear surface of the first polymer 951 that faces away from the striking face 905. In some examples, the first polymer 951 may be entirely surrounded by the interior surface 905I of the striking face 905 and the second polymer 952.

In the depicted example, the first polymer 951 is depicted as having a disc shape. In some other examples, the first polymer 951 may have another cross-sectional shape, such as the shape of a square, a triangle, a star, an oval, etc. A thickness of the first polymer 951 (e.g., along a direction perpendicular to the outermost surface 905O of the striking face 905) may be uniform or variable across the rear surface of the first polymer 951. The first polymer 951 may be positioned at a center of the striking face 905. For example, the first polymer 951 may cover a geometric center of the striking face 905 and/or a center point of a third groove in the striking face 905 from the lower leading edge 906. In some other examples, the first polymer 951 may be positioned further toward the sole 910 or to the top portion 912 and/or may be positioned toe-ward or heel-ward. The position of the first polymer 951 (which may have a greater hardness than the second polymer 952) can be chosen to, for example, position the first polymer 951 behind a portion of the striking face 905 where a particular golfer tends to hit golf balls, and this can improve various performance characteristics of the particular golfer and/or the sound and feel of hitting a golf ball by the particular golfer.

In some examples, the first polymer 951 is adhered to the interior surface 905I of the striking face 905 via an adhesive, for example, via a layer of tape or a glue between the front surface 951F of the first polymer 951 and the interior surface 905I of the striking face 905. In some other examples, the first polymer 951 is maintained against the interior surface 905I of the striking face 905 by the second polymer 952 at least partially surrounding the first polymer 951. For example, the first polymer 951 may be partially suspended within the second polymer 952 while being in contact with the interior surface 905I of the striking face 905 and without being adhered to the interior surface 905I of the striking face 905.

In some examples, a volume of the first polymer 951 is greater than about 5%, about 10%, about 15%, about 20%, or about 25% of the volume of the front cavity 922. In some examples, the volume of the first polymer 951 is less than about 40%, about 35%, about 30%, about 25%, about 20%, or about 15% of the volume of the front cavity 922. A volume of the second polymer 952 may be greater than the volume of the first polymer 951. In some examples, the volume of the second polymer 952 may be greater than or equal to about 40%, about 50%, about 60%, about 70%, about 75%, or about 80% of the volume of the front cavity 922. The volume of the second polymer 952 may be less than about 90%, about 80%, about 70%, or about 60% of the volume of the front cavity 922. In some examples, the sum of the volumes of the first and second polymers 951 and 952 in the front cavity 922 may be about 100% of the volume of the front cavity 922. For example, the first and second polymers 951 and 952 may substantially entirely fill the front cavity 922. In some other examples, the sum of the volumes of first and second polymers 951 and 952 may be less than 100% of the volume of the front cavity 922.

During the manufacture of the golf club head 900, the first polymer 951 may be prefabricated and inserted (e.g., through the first opening 931 in the intermediate wall 930) into the front cavity 922. A liquid polymer material may then be injected into the front cavity 922 (e.g., through the first opening 931) and at least partially around and/or over the first polymer 951. The liquid polymer material can then be cured to form the second polymer 952.

Figure 21:
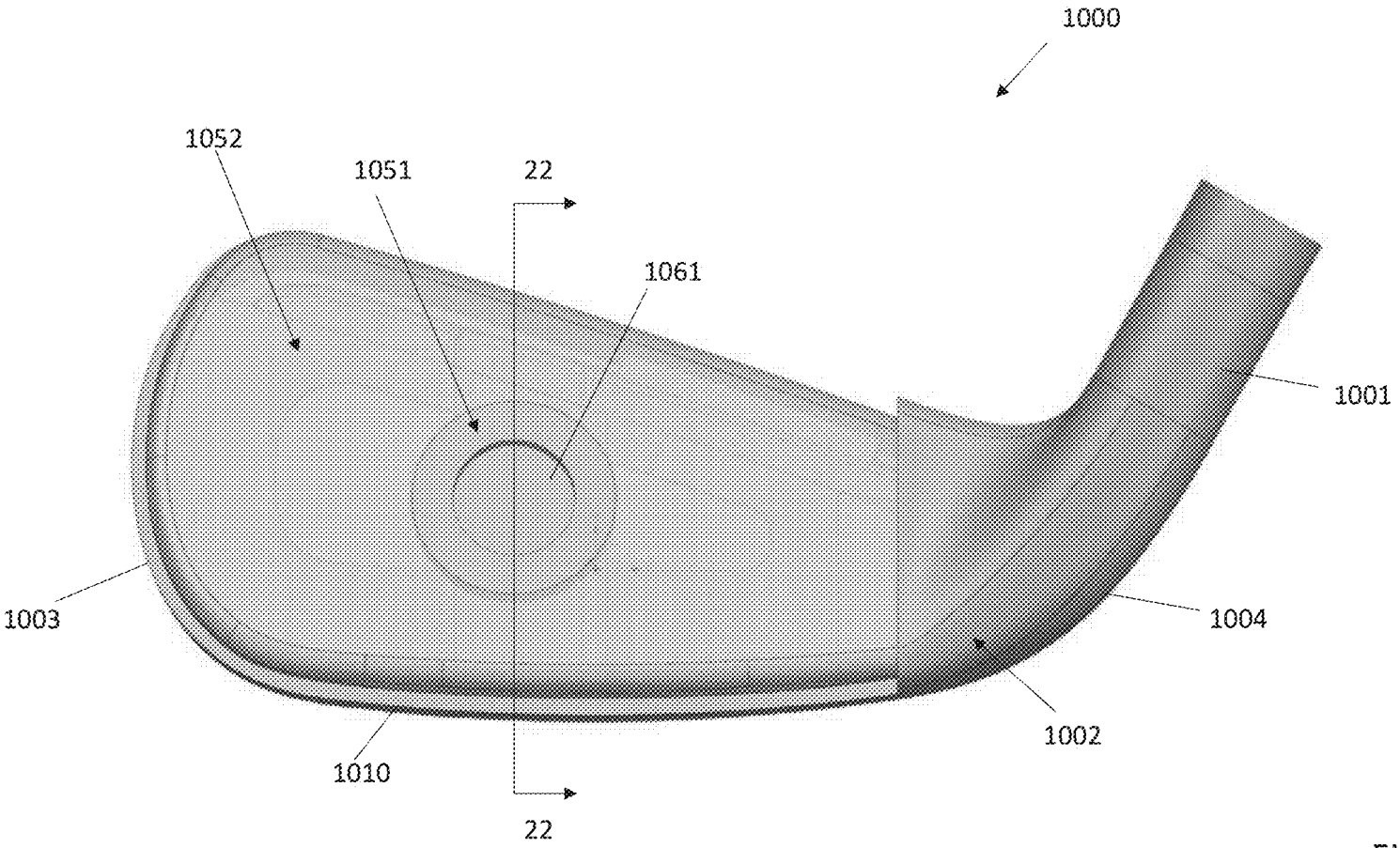
FIG. 21 of the accompanying drawings shows a front view of another golf club head without a striking face cup of the golf club head, according to some examples.
Figure 22:
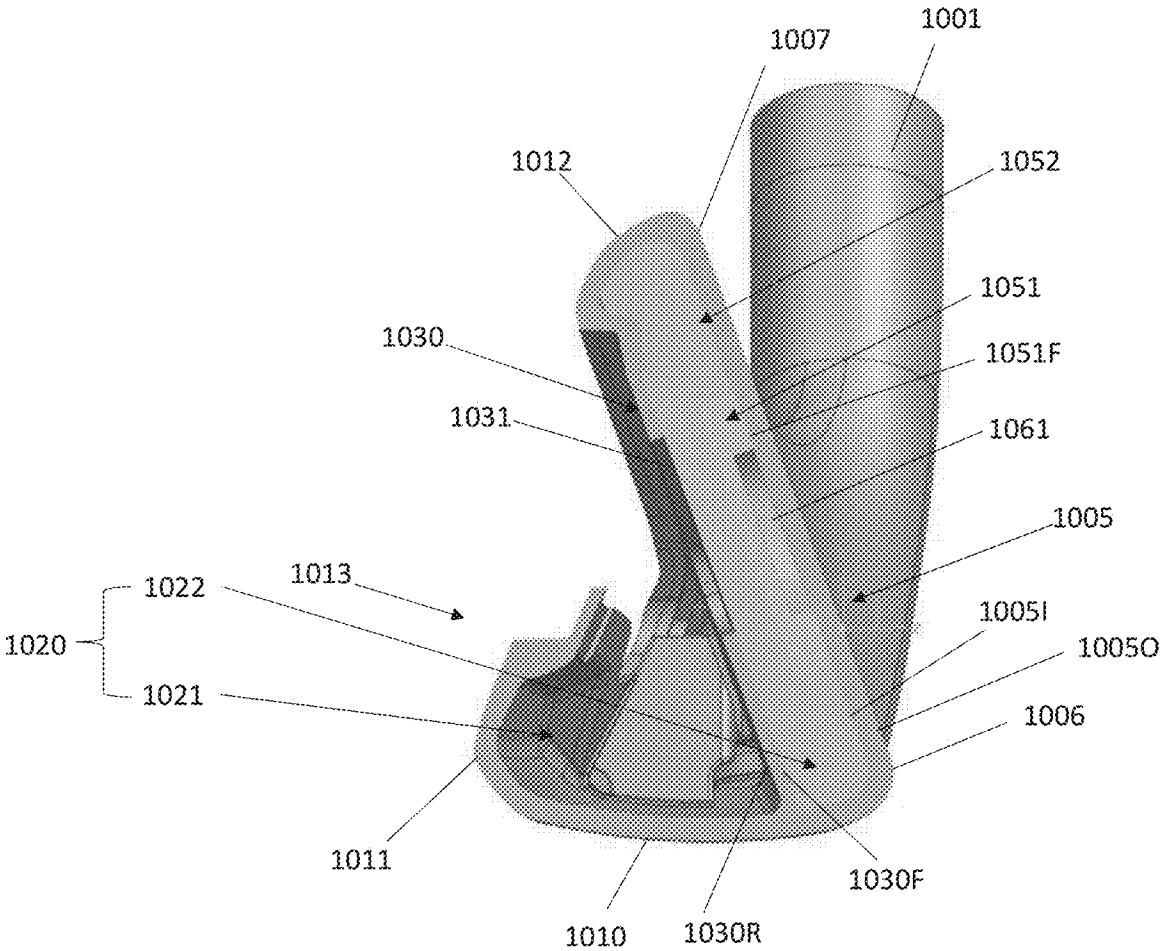
FIG. 22 of the accompanying drawings shows a cross-sectional view of the golf club head of FIG. 20 along line 22-22 in FIG. 21.

FIG. 21 of the accompanying drawings shows a front view of another golf club head 1000 without a striking face of the golf club head 1000, according to some examples. In the depicted example, the golf club head 1000 is an iron type golf club head. FIG. 22 of the accompanying drawings shows a cross-sectional view of the golf club head 1000 of FIG. 20 along line 22-22 in FIG. 21. The golf club head 1000 may include some features similar to, or the same as, features of other example golf club heads disclosed herein, including, without limitation, the golf club head 900. Therefore, redundant descriptions of some features may not be repeated.

Referring concurrently to FIGS. 21 and 22, the golf club head 1000 includes a body 1002 including a toe 1003, a heel 1004, a striking face 1005 extending between the toe 1003 and the heel 1004 and having a lower leading edge 1006 and an opposite upper topline edge 1007, a sole 1010 extending rearward from the lower leading edge 1006 to a rearward portion 1011, and a top portion 1012 extending rearward from the upper topline edge 1007. The striking face 1005 may include a substantially flat outermost surface 1005O and an opposite inner surface 1005I, and one or more grooves may be defined in the outermost surface 1005O. In some examples, the body 1002 also includes a back portion 1013 extending at least partly between the sole 1010 and the top portion 1012. The golf club head 1000 may include a hosel 1001 disposed at the heel 1004 and that is configured to attach to a golf club shaft.

The body 1002 may at least partly surround a primary cavity 1020, and the golf club head 1000 may include an intermediate wall 1030 that divides the primary cavity 1020 into a front cavity 1022 and a rear cavity 1021. The intermediate wall 1030 may have a front surface 1030F and an opposite rear surface 1030R, and the front surface 1030F may be substantially parallel to the interior surface 1005I of the striking face 1005. In some examples, the intermediate wall 1030 has a first opening 1031.

The golf club head 1000 may include a first polymer 1051 in the front cavity 1022 and having a front surface 1051F in contact with the interior surface 1005I of the striking face 1005, and a second polymer 1052 in the front cavity 1022 and at least partly engaging or covering the first polymer 1051.

An air gap 1061 may be defined between the interior surface 1005I of the striking face 1005 and the first polymer 1051. For example, the air gap 1061 may be at least partly (e.g., partly or entirely) surrounded by the interior surface 1005I of the striking face 1005 and the first polymer 1051. The first polymer 1051 may have an indent 1061 formed in the front surface 1051F and that partly defines the air gap 1061. Providing an air gap behind the striking face can improve the flexion and responsiveness of the striking face 1005 when hitting a golf ball, which can improve various aspects of a golfer's performance, including increasing ball speed.

In some examples, the first and second polymers 1051 and 1052 include first and second polymer materials that are different from each other. For example, the polymer material of the first polymer 1051 may have a hardness that is greater than or less than that of the polymer material of the second polymer 1052. In some other examples, the first and second polymers 1051 and 1052 may include a same material. When the first and second polymers 1051 and 1052 include the same material, the front cavity 1022 can be partially filled with a single polymer material while still providing the air gap 1061 between the single polymer material and the striking face 1005.

During manufacture of the golf club head 1000, the first polymer 1051 may be prefabricated and inserted into, and positioned and oriented within, the front cavity 1022. Then a polymer liquid may be injected into the front cavity 1022 to at least partly cover the first polymer 1051, and the polymer liquid may be cured to form the second polymer 1052.

Figure 23:
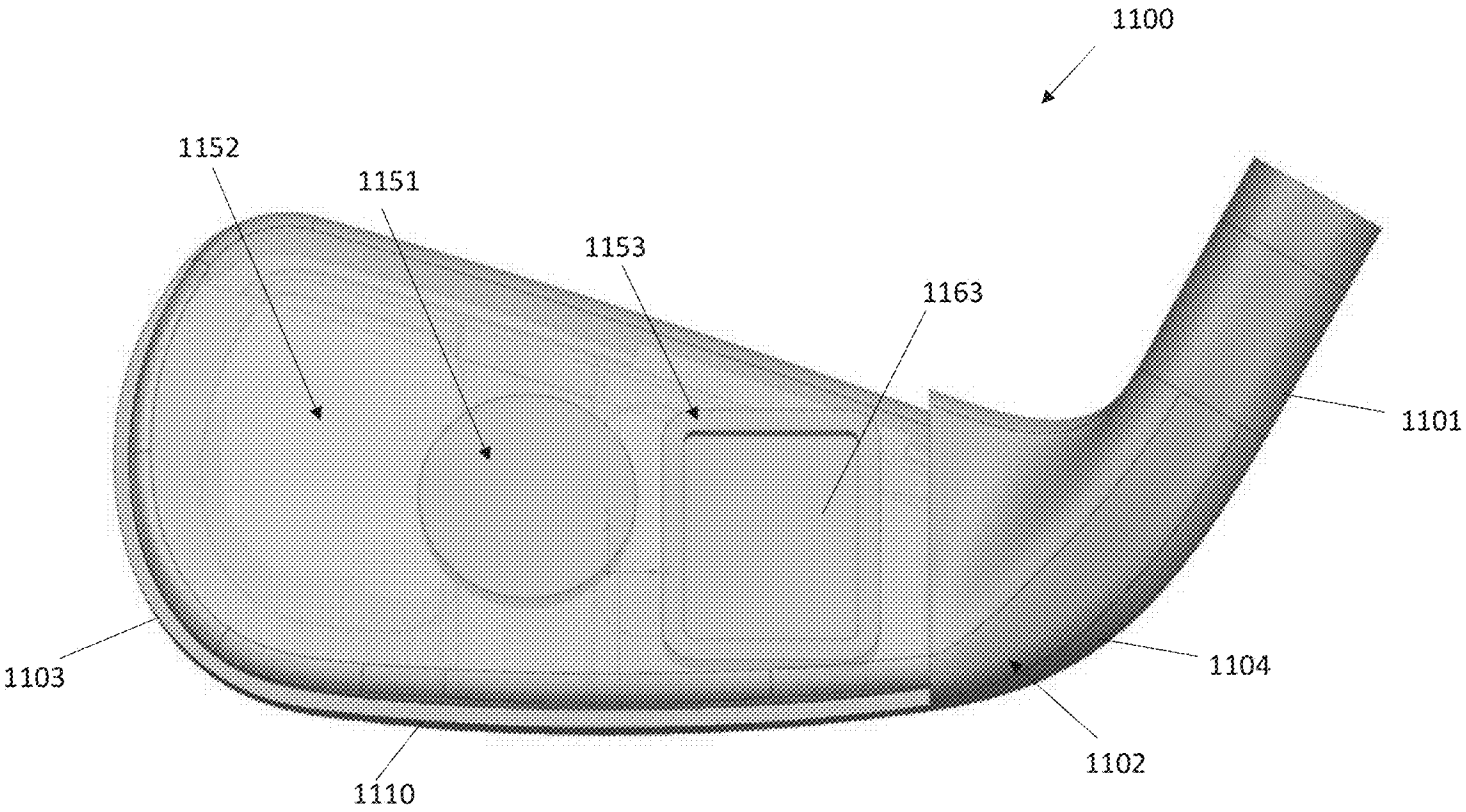
FIG. 23 of the accompanying drawings shows a front view of another golf club head without a striking face cup of the golf club head, according to some examples.
Figure 24:
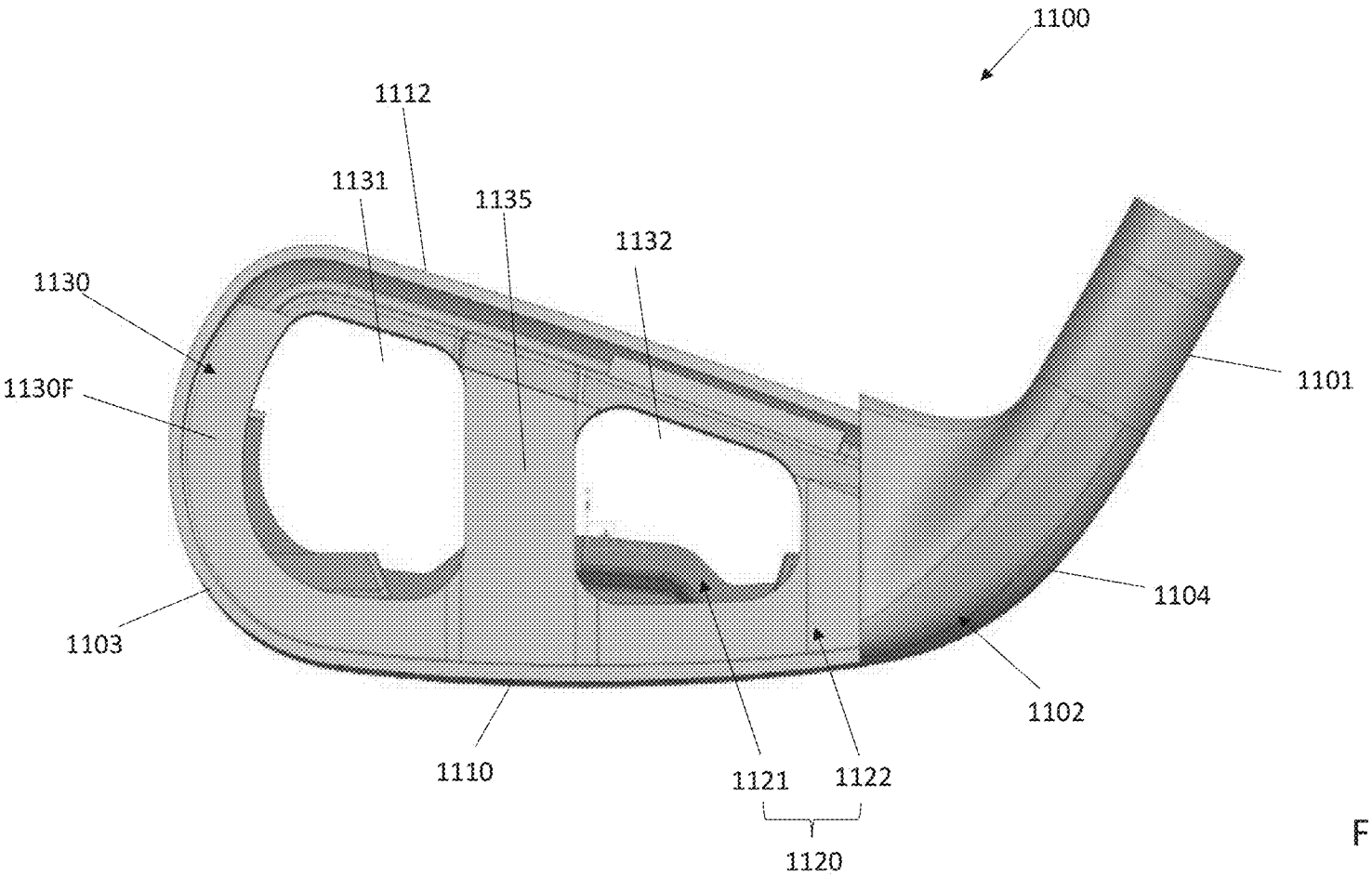
FIG. 24 of the accompanying drawings shows a front view of the golf club head 11 of FIG. 23 without the striking face cup of the golf club head and without any polymers in a front cavity of the golf club head 1100.

FIG. 23 of the accompanying drawings shows a front view of another golf club head 1100 without a striking face cup of the golf club head, according to some examples. In the depicted example, the golf club head 1100 is an iron type golf club head. FIG. 24 of the accompanying drawings shows a front view of the golf club head 11 of FIG. 23 without the striking face cup of the golf club head 1100 and without any polymers in a front cavity 1122 of the golf club head 1100. In FIG. 24, the second polymer 1152 is depicted as being partially transparent. The golf club head 1100 may include some features similar to, or the same as, features of other golf club heads described herein, including, without limitation, the golf club heads 900 and 1000. Therefore, redundant descriptions of some features may not be repeated.

Referring concurrently to FIGS. 23 and 24, the golf club head 1100 includes a body 1102 including a toe 1103, a heel 1104, a striking face extending between the toe 1103 and the heel 1104 and having a lower leading edge and an opposite upper topline edge, a sole 1110 extending rearward from the lower leading edge to a rearward portion, and a top portion 1112 extending rearward from the upper topline edge. The striking face may include a substantially flat outermost surface and an opposite inner surface, and one or more grooves may be defined in the outermost surface of the striking face. In some examples, the body 1102 also includes a back portion extending at least partly between the sole 1110 and the top portion 1111. The golf club head 1100 may also include a hosel 1101 disposed at the heel 1104 and that is configured to attach to a golf club shaft.

The body 1102 may at least partly surround a primary cavity 1120, and the golf club head 1100 may include an intermediate wall 1130 that divides the primary cavity 1120 into a front cavity 1122 and a rear cavity 1121. The intermediate wall 1130 may have a front surface 1130F and an opposite rear surface, and the front surface 1130F may be substantially parallel to the interior surface of the striking face. In some examples, the intermediate wall 1130 has a first opening 1131 and a second opening 1132. The intermediate wall 1130 may have a vertical support bar 1135, which may generally extend in a direction perpendicular to a toe-heel direction of the golf club head 1100 and between the first and second openings 1131 and 1132. In some examples, the vertical support bar 1135 extends at least partially between the sole 1110 and the top portion 1111. The vertical support bar 1135 can provide improved support of one or more polymers in the front cavity 1122, and can improve the stiffness of a center portion of the striking face.

The golf club head 1100 may include a first polymer 1151, a second polymer 1152, and a third polymer 1153 in the front cavity 1122.

The first and second polymers 1151 and 1152 may have some features similar to, or the same as, the first and second polymers 951 and 952 of the golf club head 900. For example, the first and second polymers 1151 and 1152 may include different polymer materials, and the first polymer 1151 may be in contact with the interior surface of the striking face, and may be positioned to cover a center of the striking face.

The third polymer 1153 may have some features similar to, or the same as, the first polymer 1051 of the golf club head 1000. For example, the third polymer 1153 may be in contact with the interior surface of the striking face, and the second polymer 1152 may at least partially engage or cover the third polymer 1153. The third polymer 1153 may have an indent such that an air gap 1163 is defined between the interior surface of the striking face and the third polymer 1153. The third polymer 1153 may include a polymer material that is the same as, or different than, the polymer material of the second polymer 1152. In some examples, the polymer material of the third polymer 1153 is the same as, or different from, the first polymer material 1151.

The third polymer 1153 may be positioned heel-ward within the front cavity 1122. For example, the center of the third polymer 1153 (or the entirety of the third polymer 1153) may be positioned between the heel 1104 and the center of the striking face. In some examples, the third polymer 1153 is positioned between the heel 1104 and the first polymer 1151. In some other examples, the third polymer 1153 is positioned toe-ward within the front cavity 1122. For example, the center of the third polymer 1153 (or the entirety of the third polymer 1153) may be positioned between the toe 1103 and the center of the striking face. In some examples, the third polymer 1153 is positioned between the toe 1103 and the first polymer 1151.

Figure 25:
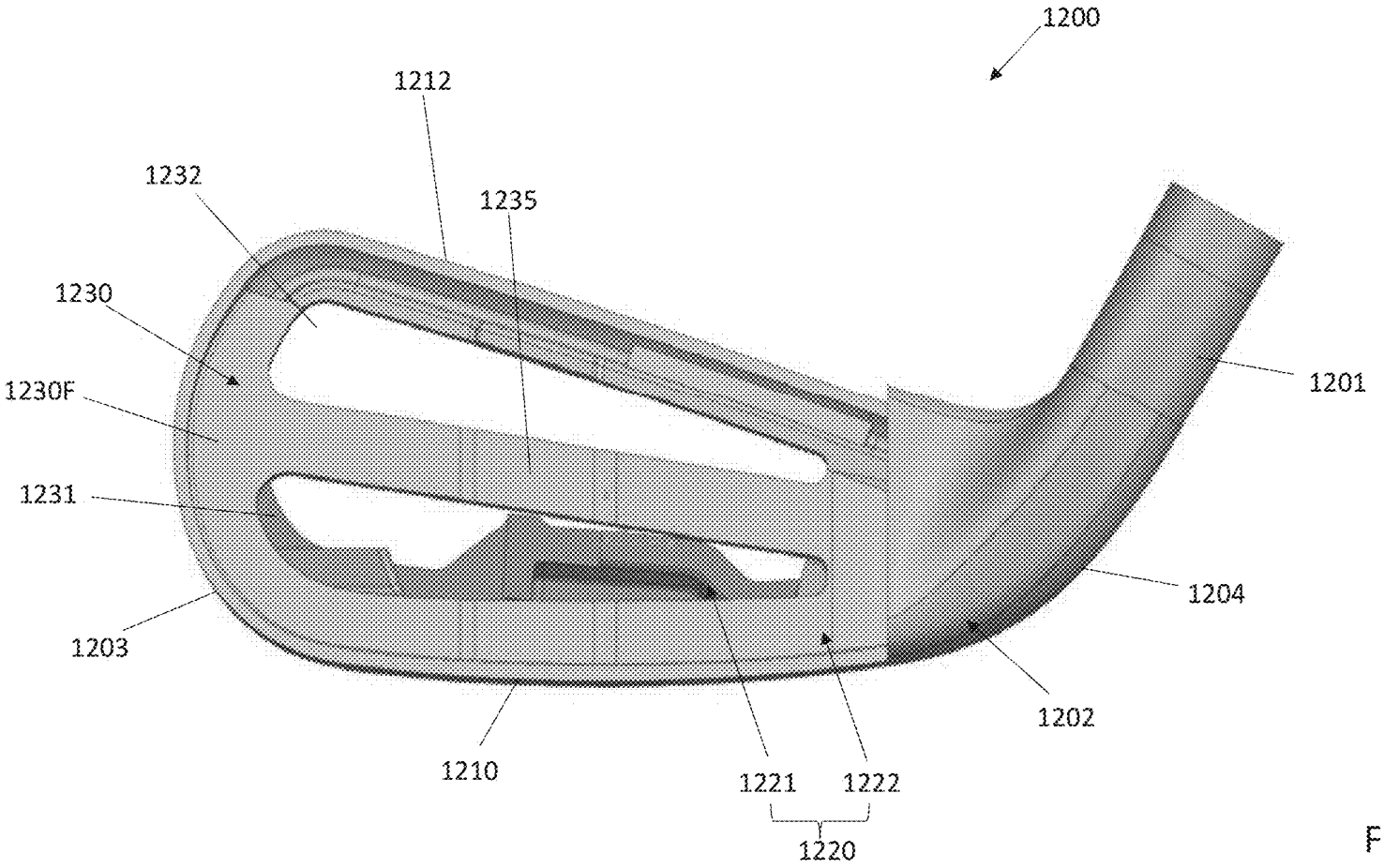
FIG. 25 of the accompanying drawings shows a front view of another golf club head without a striking face cup of the golf club head and without any polymers in a front cavity of the golf club head, according to some examples.

FIG. 25 of the accompanying drawings shows a front view of another golf club head 1200 without a striking face cup of the golf club head 1200 and without any polymers in a front cavity 1222 of the golf club head 1200, according to some examples. In the depicted example, the golf club head 1200 is an iron type golf club head. The golf club head 1200 may include some features similar to, or the same as, the features of other golf club heads disclosed herein, including, without limitation, the golf club heads 900, 1000, and 1100. Therefore, redundant descriptions of some features may not be repeated.

The golf club head 1200 includes a body 1202 including a toe 1203, a heel 1204, a striking face extending between the toe 1203 and the heel 1204 and having a lower leading edge and an opposite upper topline edge, a sole 1210 extending rearward from the lower leading edge to a rearward portion, and a top portion 1212 extending rearward from the upper topline edge. The striking face may have a substantially flat outermost surface and an opposite inner surface, and one or more grooves may be defined in the outermost surface of the striking face. In some examples, the body 1202 also includes a back portion extending at least partly between the sole 1210 and the top portion 1212. The golf club head 1200 may also include a hosel 1201 that is disposed at the heel 1204 and configured to attach to a golf club shaft.

The body 1202 may at least partly surround a primary cavity 1220, and the golf club head 1200 may include an intermediate wall 1230 that divides the primary cavity 1220 into a front cavity 1222 and a rear cavity 1221. The intermediate wall 1230 may have a front surface 1230F and an opposite rear surface, and the front surface 1230F may be substantially parallel to the interior surface of the striking face. In some examples, the intermediate wall 1230 has a first opening 1231 and a second opening 1232. The intermediate wall 1230 may have a horizontal support bar 1235, which may generally extend in a toe-heel direction of the golf club head 1200 and between the first and second openings 1231 and 1232. In some examples, the horizontal support bar 1235 extends at least partially between the toe 1203 and the heel 1204. The first opening 1231 may be positioned between the sole 1210 and the second opening 1232. The golf club head 1200 may include one or more polymer materials that at least partially fill the front cavity 1222.

Figure 26:
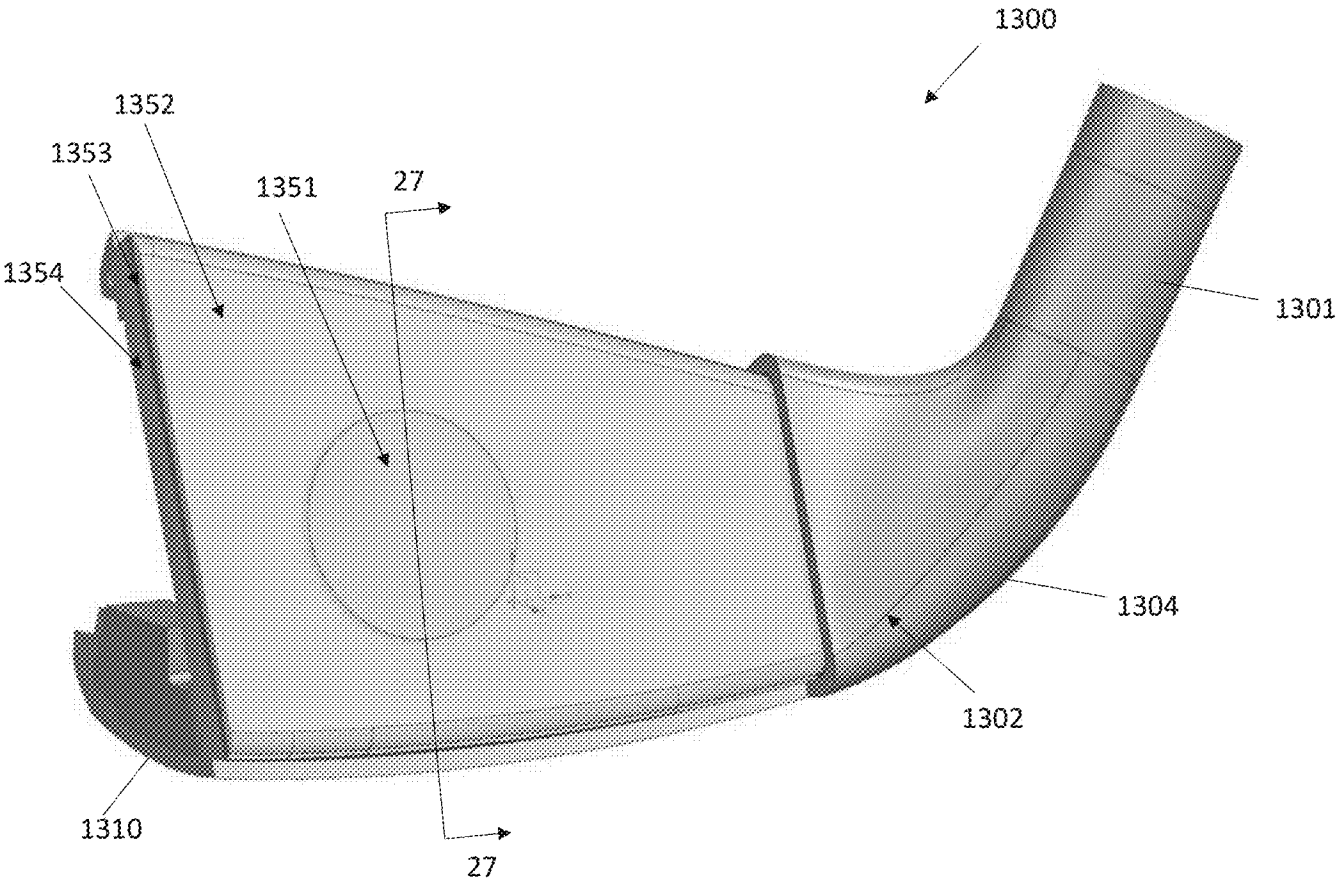
FIG. 26 of the accompanying drawings shows a front perspective view of part of another golf club head without a striking face cup of the golf club head, according to some examples.
Figure 27:
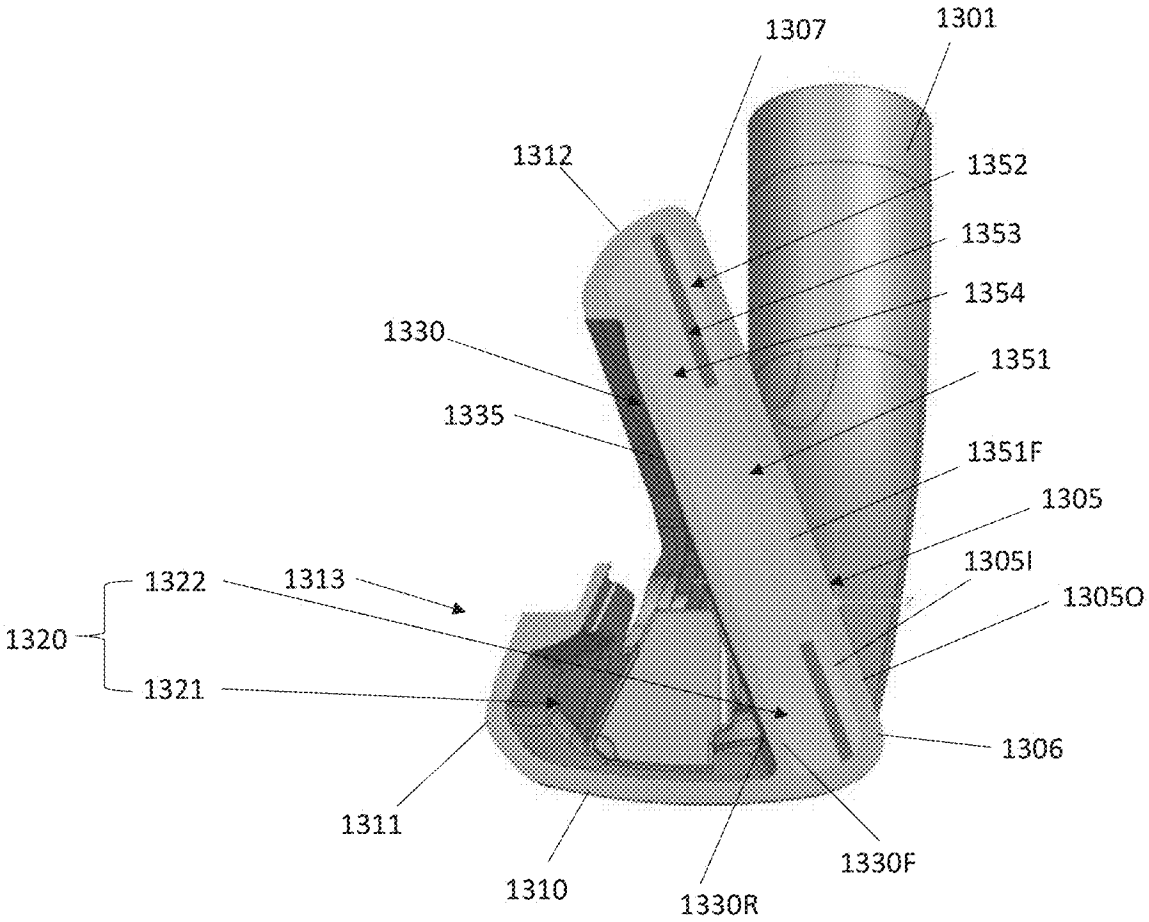
FIG. 27 of the accompanying drawings shows a cross-sectional view of the golf club head of FIG. 26 along line 27-27 in FIG. 26.

FIG. 26 of the accompanying drawings shows a front perspective view of part of another golf club head 1300 without a striking face cup of the golf club head 1300, according to some examples. In the depicted example, the golf club head 1300 is an iron type golf club head. FIG. 27 of the accompanying drawings shows a cross-sectional view of the golf club head 1300 of FIG. 26 along line 27-27 in FIG. 26. The golf club head 1300 may include some features similar to, or the same as, the features of other golf club heads disclosed herein, including, without limitation, the golf club heads 900, 1000, 1100, and 1200. Therefore, redundant descriptions of some features may not be repeated.

The golf club head 1300 includes a body 1302 including a toe 1303, a heel 1304, a striking face 1305 extending between the toe 1303 and the heel 1304 and having a lower leading edge 1306 and an opposite upper topline edge 1307, a sole 1310 extending rearward from the lower leading edge 1306 to a rearward portion 1311, and a top portion 1312 extending rearward from the upper topline edge 1307. The striking face 1305 may have a substantially flat outermost surface 1305O and an opposite inner surface 1305I, and one or more grooves may be defined in the outermost surface of the striking face 1305O. In some examples, the body 1302 also includes a back portion 1313 extending at least partly between the sole 1310 and the top portion 1312. The golf club head 1300 may also include a hosel 1301 disposed at the heel 1304 and that is configured to attach to a golf club shaft.

The body 1302 may at least partly surround a primary cavity 1320, and the golf club head 1300 may include an intermediate wall 1330 that divides the primary cavity 1320 into a front cavity 1322 and a rear cavity 1321. The intermediate wall 1330 may have a front surface 1330F and an opposite rear surface 1330R, and the front surface 1330F may be substantially parallel to the interior surface 1305I of the striking face 1305. In some examples, the intermediate wall 1330 has a first opening and a second opening on opposite sides of a vertical support bar 1335. In some other examples, the intermediate wall 1330 includes a horizontal support bar, similar to the horizontal support bar 1235 of the golf club head 1200.

The golf club head 1300 may include a first polymer 1351, a second polymer 1352, a third polymer 1353, and a fourth polymer 1354 that at least partially fill the front cavity 1322. The first polymer 1351 may include some features similar to, or the same as, the first polymer 951 of the golf club head 900 or of the first polymer 1051 of the golf club head 1000. For example, the first polymer 1351 may have a front surface 1351F in contact with, and covering, only a portion of the interior surface 1305I of the striking face 1305.

The second polymer 1352 may be in contact with a different portion of the interior surface 1305I of the striking face 1305 than the front surface 1351F of the first polymer 1351. The second polymer 1352 may surround at least part of the first polymer 951 (e.g., at least part of a perimeter of the front surface 1351F of the first polymer 1351). In some examples, a thickness of the second polymer 1352 (e.g., in a direction perpendicular to the interior surface 1305I of the striking face 1305) is different from (e.g., greater than or less than) a thickness of the first polymer 1351. In the depicted example, the thickness of the second polymer 1352 is less than the thickness of the first polymer 1351. In some other examples, the thickness of the second polymer 1352 may be greater than the thickness of the first polymer 1351, and the second polymer 1352 may cover at least part of the rear surface of the first polymer 1351.

The third polymer 1353 may be in contact with, and may cover at least part of, a rear surface of the second polymer 1352. In some examples, the third polymer 1353 at least partially surrounds the first polymer 1351 (e.g., a sidewall of the first polymer 1351) with or without covering at least part of the rear surface of the first polymer 1351. For example, a sum of the thicknesses of the second and third polymers 1352 and 1353 may be different from (e.g., greater than or less than), or the same as, the thickness of the first polymer 1351. In the depicted example, the sum of the thicknesses of the second and third polymers 1352 and 1353 is less than the thickness of the first polymer 1351 such that the third polymer 1353 surrounds at least part of a sidewall of the first polymer 1351 without covering the rear surface of the first polymer 1351.

In some other examples, the thickness of the second polymer 1352 is less than the thickness of the first polymer 1351, and the sum of the thicknesses of the second and third polymers 1352 and 1353 is greater than the thickness of the first polymer 1351 such that the third polymer 1353 surrounds at least part of the sidewall of the first polymer 1351 and also engages or covers at least part of the rear surface of the first polymer 1351. In some other examples, the thickness of the second polymer 1352 is greater than the thickness of the first polymer 1351 such that the second polymer 1352 engages or covers at least part of the rear surface of the first polymer 1351, and the third polymer 1353 is separated from the first polymer 1351 by the second polymer 1352.

The fourth polymer 1354 may be in contact with a rear surface of the third polymer 1353 and, in some examples, may also be in contact with the first polymer 1351. In the depicted example, the fourth polymer 1354 is in contact with the rear surface of the third polymer 1353, surrounds at least part of the sidewall of the first polymer 1351, and engages or covers at least part of the rear surface of the first polymer 1351. In some other examples, the second polymer 1352 or the third polymer 1353 engages or covers at least part of the rear surface of the first polymer 1351, and the fourth polymer 1354 is in contact with the rear surface of the third polymer 1353 and is separated from the first polymer 1351 by at least the third polymer 1353.

The first polymer 1351 may include a polymer material that is the same as, or different from, each of the second, third, and fourth polymers 1352, 1353, and 1354. For example, the first polymer 1351 and the second polymer 1352 may include a same polymer material so that a polymer layer of a single material is formed over the interior surface 1305I of the striking face 1305 with a non-uniform thickness (e.g., a thickness in a portion corresponding to the first polymer 1351 may be larger than a thickness in a portion corresponding to the second polymer 1352). In some examples, the first and fourth polymers 1351 and 1354 include a same polymer material, and the second and third polymers 1352 and 1353 each have another polymer material having a different hardness than the hardness of the polymer material of the first and fourth polymers 1351 and 1354. Other examples are also encompassed within the present disclosure.

During manufacture of the golf club head 1300, the first polymer 1351 may be prefabricated and inserted into, and positioned and oriented within, the front cavity 1322. Then a polymer liquid may be injected into the front cavity 1322 and cured to form the second polymer 1352. Another polymer liquid may then be injected into the front cavity 1322 and cured to form the third polymer 1353. Then another polymer liquid may be injected into the front cavity 1322 and cured to form the fourth polymer 1354.

Figure 28:
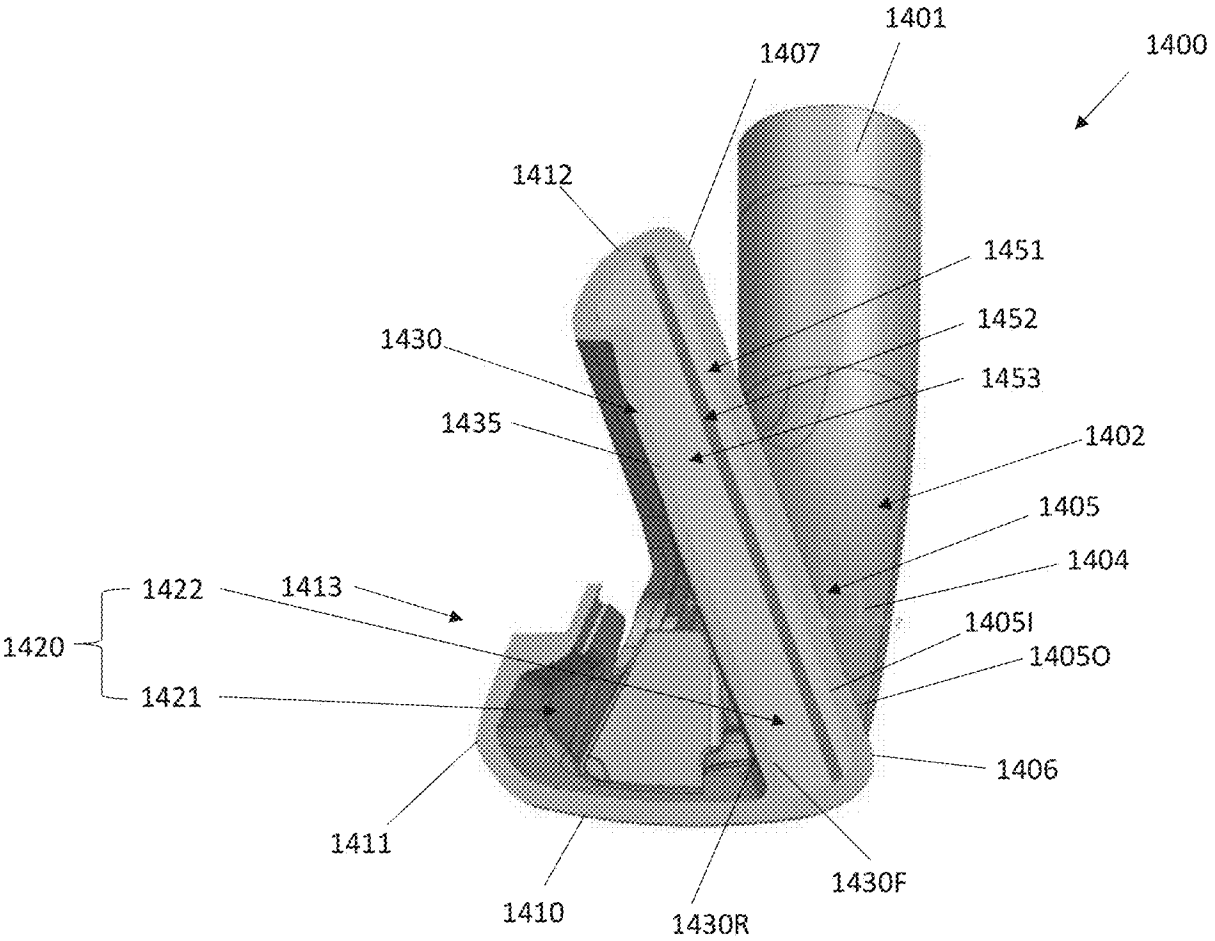
FIG. 28 of the accompanying drawings shows a cross-sectional view of another golf club head, according to some examples.

FIG. 28 of the accompanying drawings shows a cross-sectional view of another golf club head 1400, according to some examples. The cross-sectional view is in a heel-to-toe direction of the golf club head 1400 and along a plane that the toe-heel direction of the golf club head 1400 is generally perpendicular to. In the depicted example, the golf club head 1400 is an iron type golf club head. The golf club head 1400 may include some features similar to, or the same as, features of other golf club heads described herein, including, without limitation, the golf club heads 900, 1000, 1100, 1200, and 1300.

The golf club head 1400 includes a body 1402 including a toe, a heel 1404, a striking face 1405 extending between the toe and the heel 1404 and having a lower leading edge 1406 and an opposite upper topline edge 1407, a sole 1410 extending rearward from the lower leading edge 1406 to a rearward portion 1411, and a top portion 1412 extending rearward from the upper topline edge 1407. The striking face 1405 may have a substantially flat outermost surface 1405O and an opposite inner surface 1405I, and one or more grooves may be defined in the outermost surface 1405O of the striking face 1405. In some examples, the body 1402 also includes a back portion 1413 extending at least partly between the sole 1410 and the top portion 1412. The golf club head 1400 may also include a hosel 1401 disposed at the heel 1404 and that is configured to attach to a golf club shaft.

The body 1402 may at least partly surround a primary cavity 1420, and the golf club head 1400 may include an intermediate wall 1430 that divides the primary cavity 1420 into a front cavity 1422 and a rear cavity 1421. The intermediate wall 1430 may have a front surface 1430F and an opposite rear surface 1430R, and the front surface 1430F may be substantially parallel to the interior surface 1405I of the striking face 1405. In some examples, the intermediate wall 1430 has a first opening and a second opening on opposite sides of a vertical support bar 1435. In some other examples, the intermediate wall 1430 includes a horizontal support bar, similar to the horizontal support bar 1235 of the golf club head 1200.

The golf club head 1400 may include a first polymer 1451, a second polymer 1452, and a third polymer 1453 that at least partially fill the front cavity 1422. The first polymer 1451 may be in contact with, and cover, the entire interior surface 1405I of the striking face 1405. The second polymer 1452 may be in contact with, and cover, the entirety of a rear surface of the first polymer 1451. The third polymer 1453 may be in contact with, and cover, the entirety of a rear surface of the second polymer 1452. For example, the first, second, and third polymers 1451, 1452, and 1453 may be sequentially stacked in this order in the front cavity 1422 in a direction away from the striking face 1405.

The polymer material of the second polymer 1452 may be different from each of the polymer material of the first polymer 1451 and the polymer material of the third polymer 1453, and the polymer material of the third polymer 1453 may be the same as, or different from, the polymer material of the first polymer 1451. For example, the polymer materials of the first, second, and third polymers 1451, 1452, and 1453 may be mutually different such that the hardness of the first, second, and third polymers 1451, 1452, and 1453 gets progressively larger or progressively smaller in a direction away from the striking face 1405. In some examples, the hardness of the second polymer 1452 may be greater than or smaller than both of the first and third polymers 1451 and 1453.

In some examples, a volume of the first polymer 1451 is greater than about 5%, about 10%, about 15%, or about 20% of the volume of the front cavity 1422, and is less than about 50%, about 45%, about 40%, about 35%, or about 30% of the volume of the front cavity 1422. A volume of the second polymer may be greater than about 5%, about 10%, about 15%, or about 20% of the volume of the front cavity 1422, and may be less than about 50%, about 45%, about 40%, about 35%, or about 30% of the volume of the front cavity 1422. A volume of the third polymer 1453 may be greater than about 10%, about 20%, about 30%, or about 40% of the volume of the front cavity 1422, and may be less than about 80%, about 70%, about 60%, or about 50% of the volume of the front cavity 1422.

During the manufacture of the golf club head 1400, the golf club head 1400 may be laid flat on its striking face 1400, a first polymer liquid may be injected into the front cavity 1422 and cured to form the first polymer 1451. A second polymer liquid may then be injected into the front cavity 1422 and onto the first polymer 1451, and the second polymer liquid may be cured to form the second polymer 1452. A third polymer liquid may then be injected into the front cavity 1422 and onto the second polymer 1452, and the third polymer liquid may be cured to form the third polymer 1453.

Although three polymers are depicted in the example of FIG. 28, the present disclosure is not limited thereto. In some other examples, the golf club head 1400 may include two or four or more polymer layers stacked on the interior surface 1405I of the striking face 1405. For example, four or more polymer layers may be provided that have alternating polymer materials (e.g., alternating hard and soft polymer layers). In some examples, one or more layers of the polymers 1451, 1452, 1453 may be prefabricated.

Figure 29:
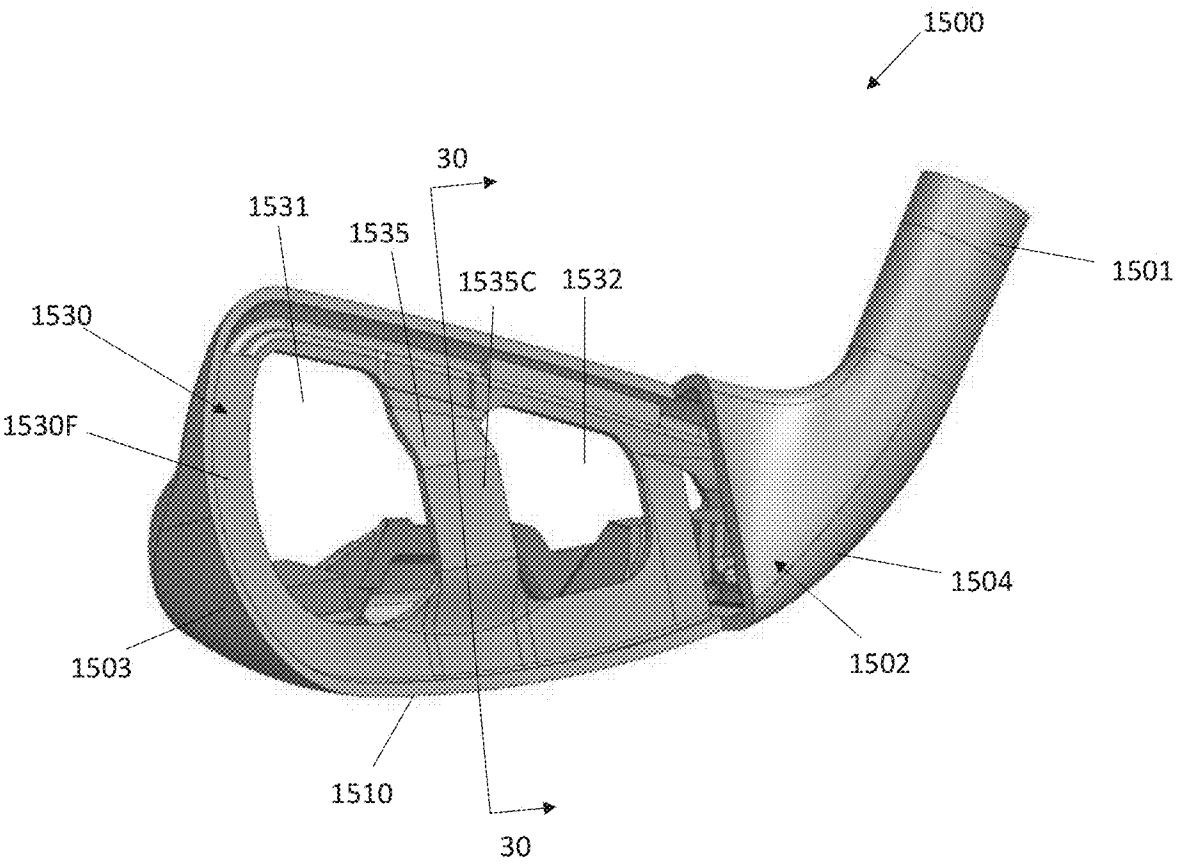
FIG. 29 of the accompanying drawings shows a front, perspective view of another golf club head without a striking face cup of the golf club head and any polymers in a front cavity of the golf club head, according to some examples.
Figure 30:
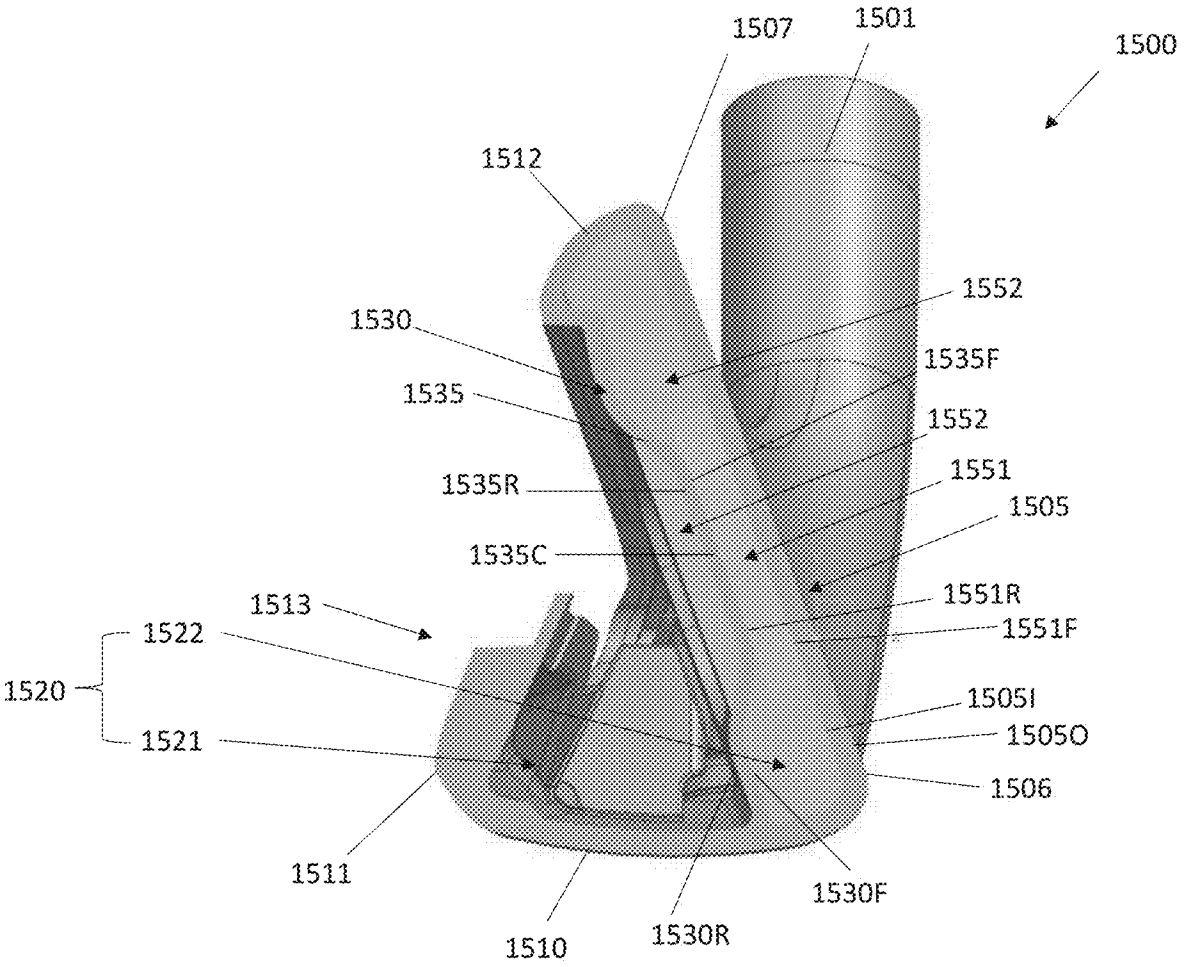
FIG. 30 of the accompanying drawings shows a cross-sectional view of the golf club head of FIG. 29 along line 30-30 in FIG. 29.

FIG. 29 of the accompanying drawings shows a front, perspective view of another golf club head 1500 without a striking face cup of the golf club head 1500 and without any polymers in a front cavity 1522 of the golf club head 1500, according to some examples. In the depicted example, the golf club head 1500 is an iron type golf club head. FIG. 30 of the accompanying drawings shows a cross-sectional view of the golf club head 1500 of FIG. 29 along line 30-30 in FIG. 29. The golf club head 1500 may include some features similar to, or the same as, the features of other golf club heads disclosed herein, including, without limitation, the golf club heads 900, 1000, 1100, 1200, 1300, and 1400.

The golf club head 1500 includes a body 1502 including a toe 1503, a heel 1504, a striking face 1505 extending between the toe 1503 and the heel 1504 and having a lower leading edge 1506 and an opposite upper topline edge 1507, a sole 1510 extending rearward from the lower leading edge 1506 to a rearward portion 1511, and a top portion 1512 extending rearward from the upper topline edge 1507. The striking face 1505 may have a substantially flat outermost surface 1505O and an opposite inner surface 1505I, and one or more grooves may be defined in the outermost surface 1505O of the striking face 1505. In some examples, the body 1502 also includes a back portion 1513 extending at least partly between the sole 1510 and the top portion 1512. The golf club head 1500 may also include a hosel 1501 disposed at the heel 1504 and that is configured to attach to a golf club shaft.

The body 1502 may at least partly surround a primary cavity 1520, and the golf club head 1500 may include an intermediate wall 1530 that divides the primary cavity 1520 into a front cavity 1522 and a rear cavity 1521. The intermediate wall 1530 may have a front surface 1530F and an opposite rear surface 1530R. In some examples, the intermediate wall 1530 has a first opening 1531 and a second opening 1532 on opposite sides of a vertical support bar 1535. A center portion 1535C of the vertical support bar 1535 may protrude forward toward the striking face 1505. For example, a smallest distance between the center portion 1535C and the interior surface 1505I of the striking face 1505 may be less than a smallest distance between another portion of the intermediate wall 1530 and the interior surface 1505I of the striking face 1505. In some other examples, the intermediate wall 1530 includes a horizontal support bar that protrudes forward toward the striking face 1505 at a center portion of the horizontal support bar.

The golf club head 1500 may include a first polymer 1551 and a second polymer 1552 that at least partially fill the front cavity 1522. In some examples, the first and second polymers 1551 and 1552 have some features similar to, or the same as, the features of the first and second polymers 951 and 952 of the golf club head 900 or of the first and second polymers 1051 and 1052 of the golf club head 1000.

In the golf club head 1500, the first polymer 1551 may be positioned between the interior surface 1505I of the striking face 1505 and the center portion 1535C of the vertical support bar 1535. For example, the first polymer 1551 may have a front surface 1551F in contact with at least part of the interior surface 1505I of the striking face 1505, and a rear surface 1551R in contact with at least part of the center portion 1535C of the vertical support arm 1535.

The second polymer 1552 may fill at least part of the remainder of the front cavity 1522. Because the center portion 1535C protrudes forward into the front cavity 1522, the second polymer 1552 may envelop at least part of the center portion 1535C of the vertical support bar 1535 such that second polymer 1552 is in contact with part of the rear surface 1530R of the intermediate wall 1530 corresponding to the center portion 1535C of the vertical support bar 1535. For example, the second polymer 1552 may fill part of the front cavity 1522 and at least part of the rear cavity 1521. By enveloping at least part of the vertical support bar 1535, the second polymer 1552 may be more securely anchored in its placed. Additionally, having the center portion 1535C of the vertical support arm 1535 protrude forward such that the first polymer 1551 is positioned between the striking face 1505 and the vertical support arm 1535 can increase the stiffness of the striking face 1505 when striking a golf ball and improve performance characteristics of the golf club head 1500.

Figure 31:
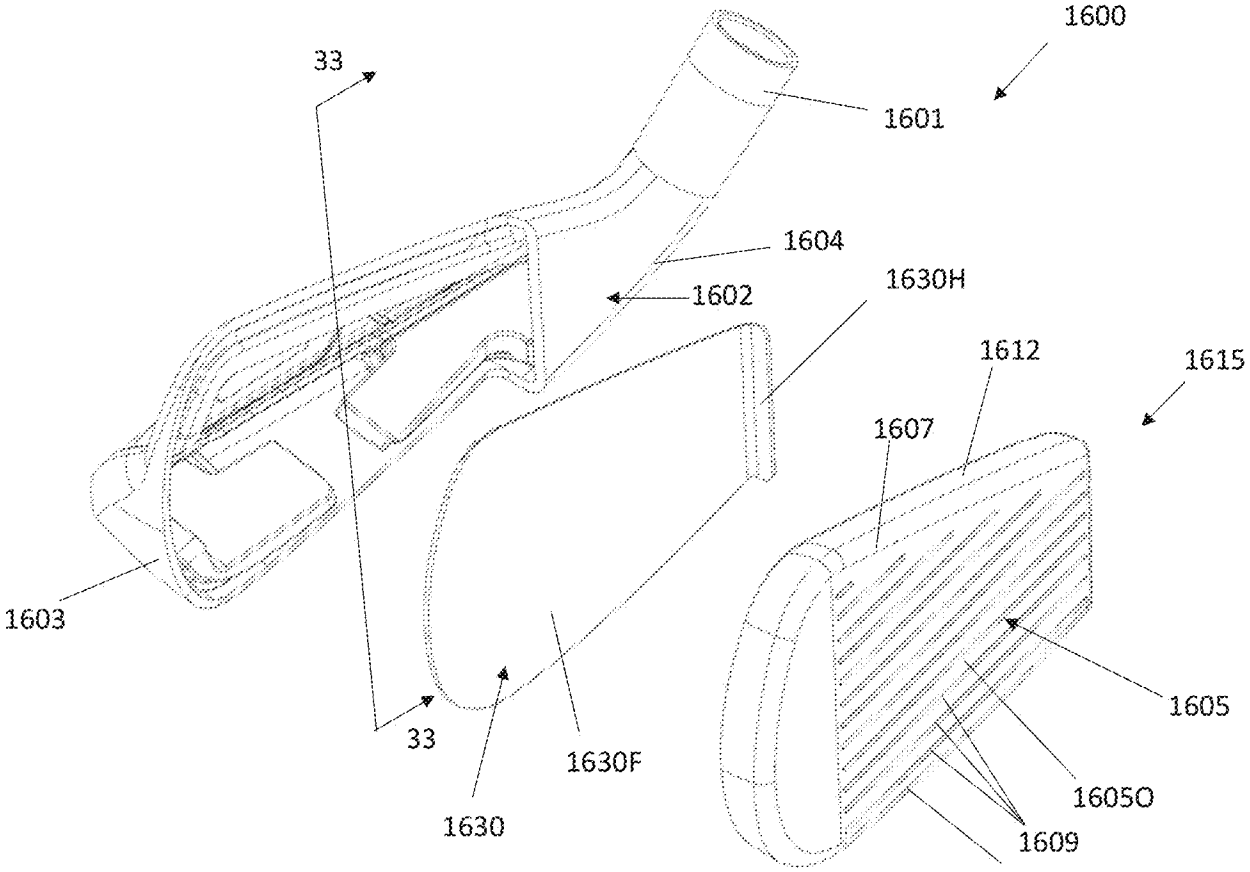
FIG. 31 of the accompanying drawings shows a partially exploded, perspective view of another golf club head, according to some examples.
Figure 32:
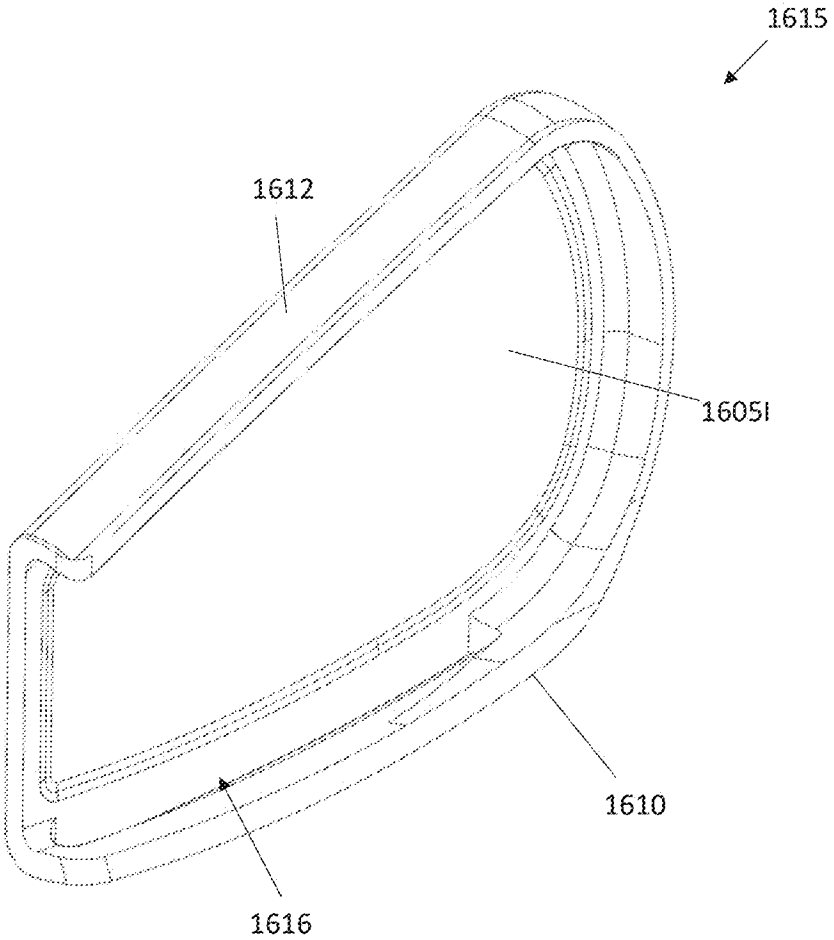
FIG. 32 of the accompanying drawings shows a rear, perspective view of a striking face cup of the golf club head of FIG. 31.
Figure 33:
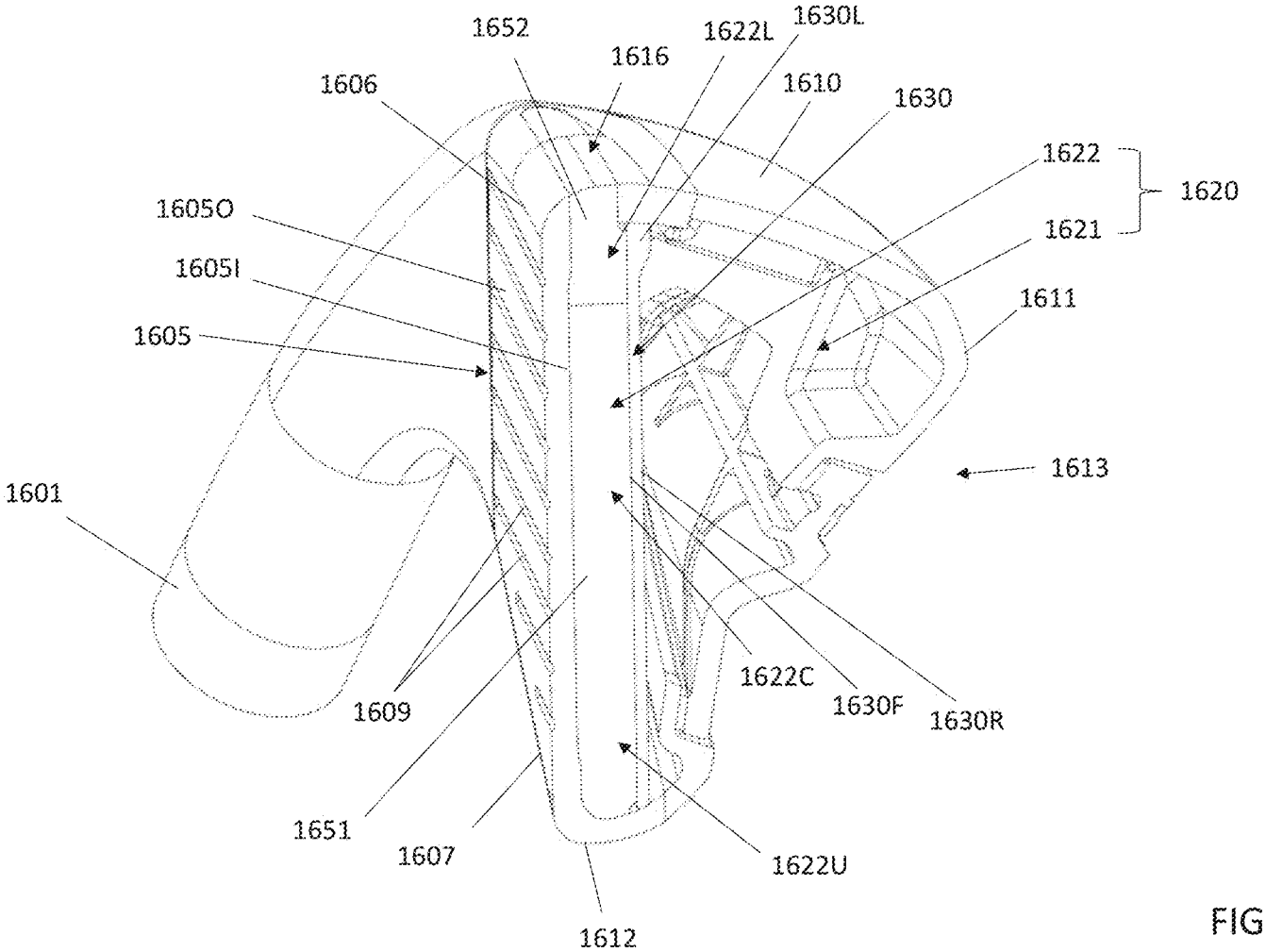
FIG. 33 of the accompanying drawings shows an upside down, cross-sectional view of the golf club head of FIG. 31 along line 33-33 in FIG. 31.

FIG. 31 of the accompanying drawings shows a partially exploded, perspective view of another golf club head 1600, according to some examples. In the depicted example, the golf club head 1600 is an iron type golf club head. FIG. 32 of the accompanying drawings shows a rear, perspective view of a striking face cup 1615 of the golf club head 1600 of FIG. 31. FIG. 33 of the accompanying drawings shows an upside down, cross-sectional view of the assembled golf club head 1600 of FIG. 31 along line 33-33 in FIG. 31. The golf club head 1600 may include some features similar to, or the same as, features of other golf club heads described herein, including, without limitation, the golf club heads 900, 1000, 1100, 1200, 1300, 1400, and 1500. Therefore, redundant descriptions of some features may not be repeated.

The golf club head 1600 includes a body 1602 including a toe 1603, a heel 1604, a striking face 1605 extending between the toe 1603 and the heel 1604 and having a lower leading edge 1606 and an opposite upper topline edge 1607, a sole 1610 extending rearward from the lower leading edge 1606 to a rearward portion 1611, and a top portion 1612 extending rearward from the upper topline edge 1607. The striking face 1605 may have a substantially flat outermost surface 1605O and an opposite inner surface 1605I, and one or more grooves 1609 may be defined in the outermost surface 1605O of the striking face 1605. In some examples, the body 1602 also includes a back portion 1613 extending at least partly between the sole 1610 and the top portion 1612. In the depicted example, the back portion 1613 is coupled between the sole 1610 and the top portion 1612 such that a rear cavity 1621 of the golf club head 1600 is entirely sealed from the exterior of the golf club head 1600 between the sole 1610 and the top portion 1612. The golf club head 1600 may also include a hosel 1601 that is disposed at the heel 1604 and that is configured to attach to a golf club shaft. The golf club head 1600 may include a striking face cup 1615 that defines at least part of the striking face 1605 and at least one of at least part of the top portion 1612, at least part of the sole 1610, or at least part of the toe 1603.

The body 1602 may at least partly surround a primary cavity 1620, and the golf club head 1600 may include an intermediate wall 1630 that divides the primary cavity 1620 into a front cavity 1622 and a rear cavity 1621. The intermediate wall 1630 may have a front surface 1630F and an opposite rear surface 1630R, and the front surface 1630F may be substantially parallel to the interior surface 1605I of the striking face 1605. In the depicted example, the intermediate wall 1630 is solid such that the rear cavity 1621 is entirely sealed off from the front cavity 1622 at the intermediate wall 1630. For example, there may be no openings in the intermediate wall 1630 in some examples. The rear cavity 1621 may be entirely surrounded by the intermediate wall 1630 and part of the body 1602.

The intermediate wall 1630 shown here in FIG. 31 may have a heel tab 1630H that bends forward to substantially seal the front cavity 1622 on heel end of the golf club head 1600. The heel tab 1630H separates the internal heel portion of the body 1602 from being a part of the front cavity 1622, eliminating the extraneous portion of the interior cavity from being included in the front cavity 1622 intended to be at least partially filled with a polymer.

The intermediate wall 1630 may include a lower portion 1630L proximal to the sole 1610 that has a greater thickness (e.g., along a direction perpendicular to the outermost surface 1605O of the striking face 1605) than another portion (e.g., the remainder) of the intermediate wall 1630 that is adjacent to the lower portion 1630L and separated from the sole 1610 by at least the lower portion 1630L. Increasing the thickness of the lower portion 1630L of the intermediate layer 1630 can increase the stiffness of the striking face 1605 near the sole 1610, which can improve the sound and feel of a golf swing and can improve certain performance characteristics of the golf club head 1600.

The body 1602 may have one or more openings exposing the front cavity 1622 to the exterior of the golf club head 1600. For example, the body 1602 may include at least one of one or more openings in the sole 1610, one or more openings in the top portion 1612, or one or more openings in the toe 1603. In some examples, the one or more openings exposing the front cavity 1622 may be at least partially in the striking face cup 1615. In some other examples, the one or more openings exposing the front cavity 1622 may be at least partially in the remainder of the body 1602 besides the striking face cup 1615. In the depicted example, the body 1602 has a sole opening 1616 (e.g., a sole slot) in the sole 1610 and in the striking face cup 1615.

The one or more openings exposing the front cavity 1622 can be used as one or more respective access points to inject one or more polymer materials into the front cavity 1622. For example, during the manufacture of the golf club head 1600, the intermediate wall 1630, the striking face cup 1615, and the remainder of the body 1602 may be welded together, and one or more polymer liquids may be sequentially injected into the front cavity 1622 through the one or more openings exposing the front cavity 1622 and cured to form one or more polymers within the front cavity 1622.

The golf club head 1600 may include a first polymer 1651 and a second polymer 1652 that at least partially the front cavity 1622. The second polymer 1652 may fill at least part of a lower portion 1622L of the front cavity proximal to the sole 1610. In some examples, the second polymer 1652 fills the sole opening 1616 and has a surface exposed to the exterior of the golf club head 1600 that is level (e.g., forming a continuous surface with) the exterior surface of the sole 1610. In some other examples, the sole opening 1616 may be plugged with a plug made of, for example, a same material as the rest of the sole 1610. The first polymer 1651 may fill a different portion of the front cavity 1622 that is separated from the sole 1610 by the second polymer 1652. For example, the first polymer 1651 may fill at least part of a center portion 1622C and, in some examples, also at least part of an upper portion 1622U of the front cavity 1622. The first polymer 1651 may be engaged with the second polymer 1652.

The first and second polymers 1651 and 1652 may include different polymer materials. For example, the first polymer 1651 may include a polymer material that is softer or harder than the polymer material of the second polymer 1652. In some examples, the polymer material of the second polymer 1652 has a greater hardness than the polymer material of the first polymer 1651, which can provide greater stiffness in the striking face 1605 near the sole 1610 compared to if the polymer material of the second polymer 1652 had a hardness less than the polymer material of the first polymer 1651. Because many golfers strike a golf ball at the lower portion of the striking face near the sole, increasing the stiffness of the striking face 1605 near the sole 1610 can improve the sound and feel of the golf club when hitting a golf ball, and can improve certain performance characteristics.

In some examples, a volume of the first polymer 1651 is greater than about 50%, about 60%, about 65%, about 70%, about 75%, about 80%, or about 85% of the volume of the front cavity 1622. The volume of the first polymer 1651 may be less than about 90%, about 85%, about 80%, about 75%, or about 70% of the volume of the front cavity 1622. In some examples, a volume of the second polymer 1652 may be greater than about 5%, about 10%, about 15%, about 20%, or about 25% of the volume of the front cavity 1622. The volume of the second polymer 1652 may be less than about 40%, about 35%, about 30%, about 25%, about 20%, or about 15% of the volume of the front cavity 1622.

Although the golf club head 1600 is depicted as including two polymers, the present disclosure is not limited thereto. For example, the golf club head 1600 could include three or more polymers in the front cavity 1822 and arranged with each other (e.g., stacked) in a direction from the sole 1610 toward the top portion 1612.

Figure 34:
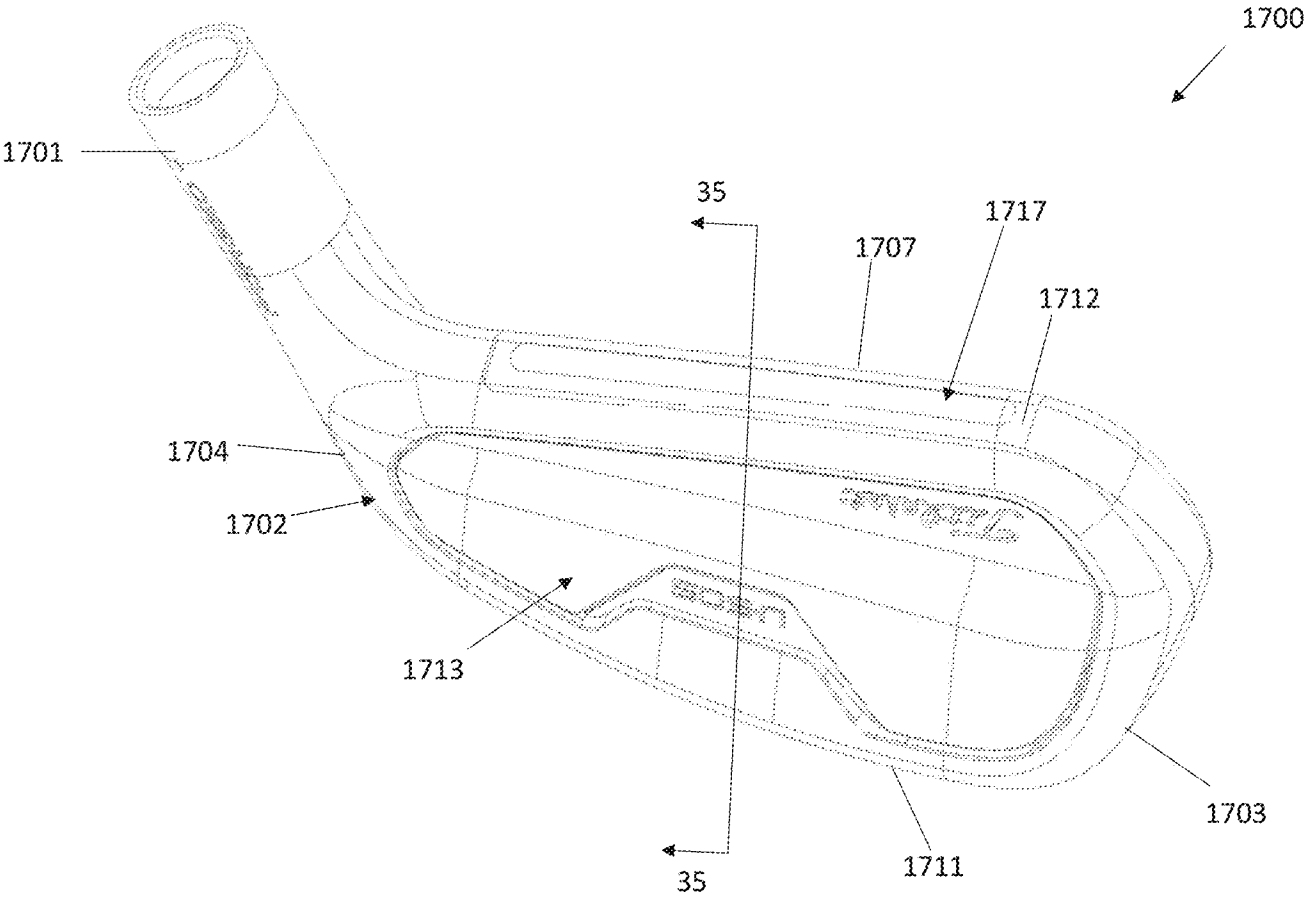
FIG. 34 of the accompanying drawings shows a rear, perspective view of another golf club head, according to some examples.
Figure 35:
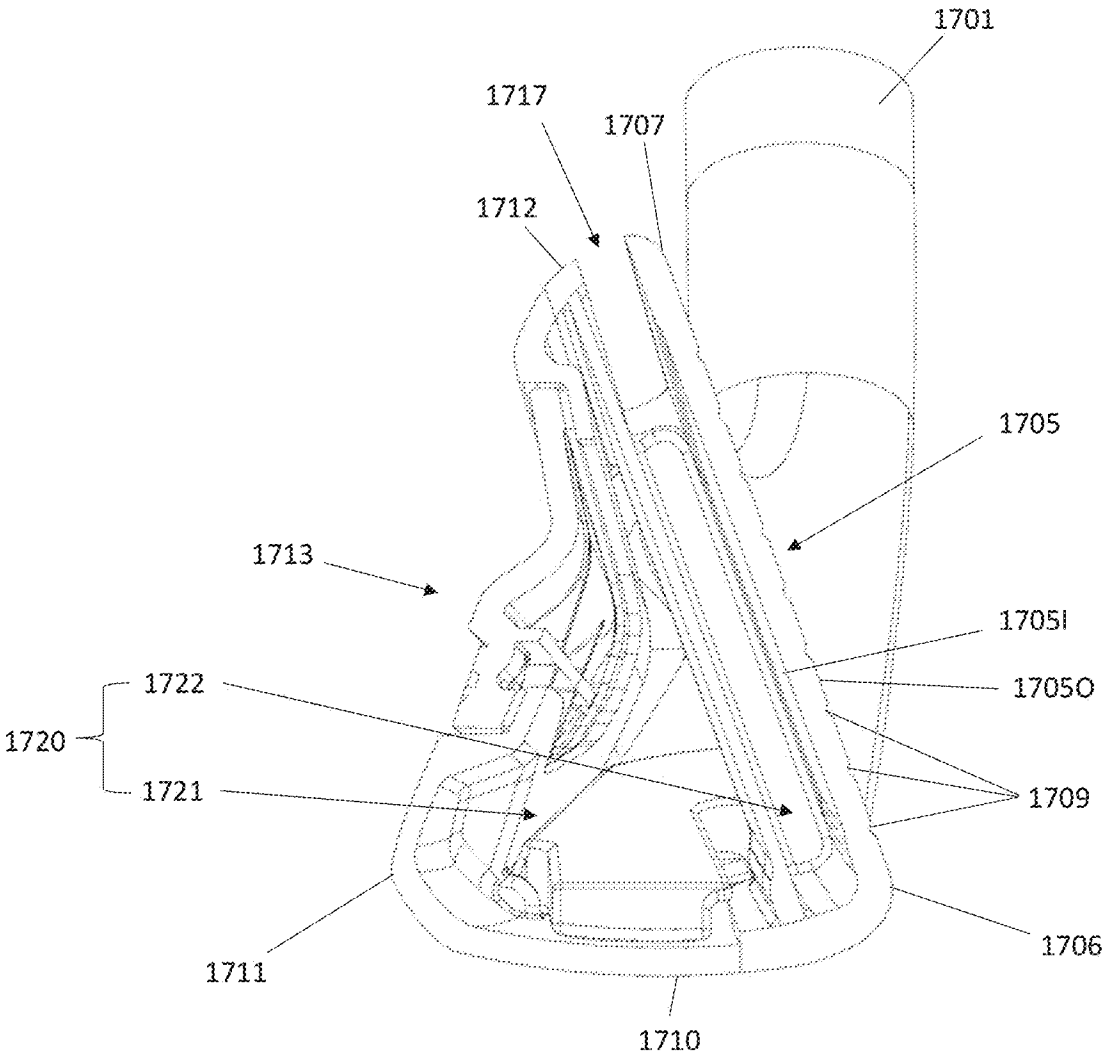
FIG. 35 of the accompanying drawings shows a cross-sectional view of the golf club head of FIG. 34 along line 35-35 in FIG. 34, and without any polymers in a front cavity of the golf club head.
Figure 36:
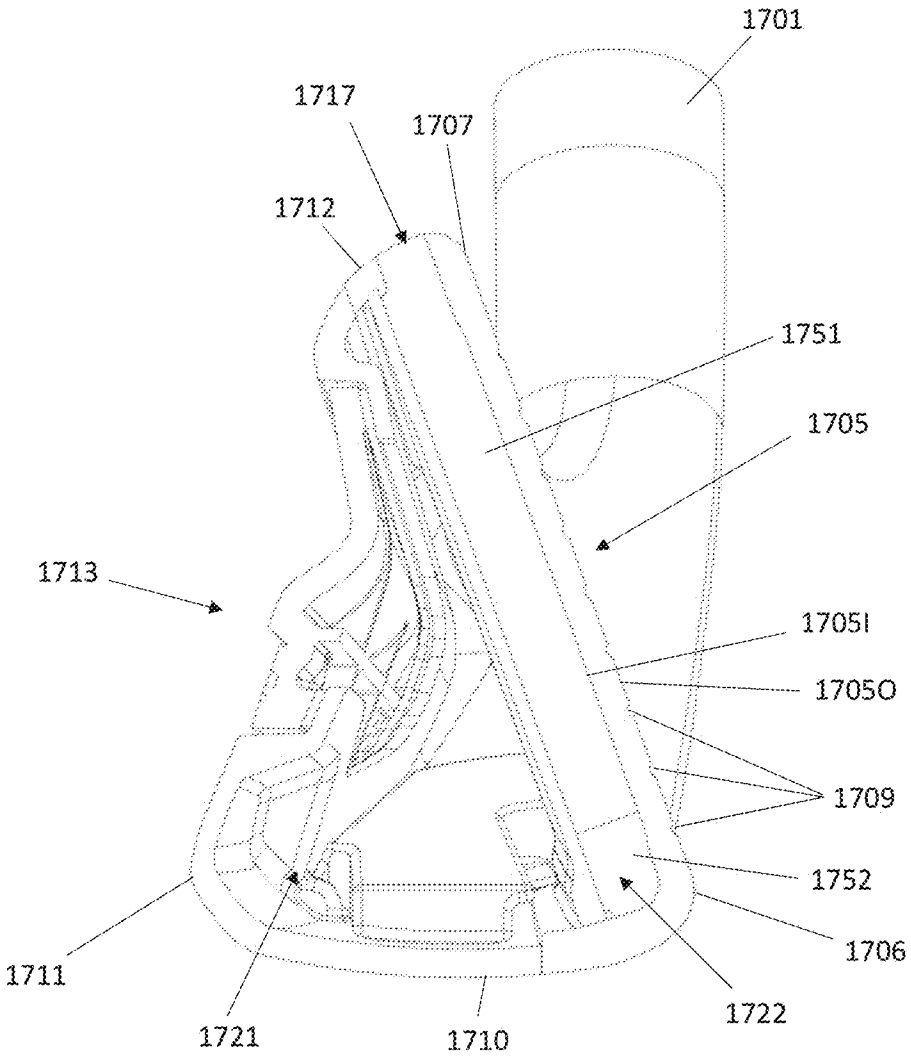
FIG. 36 of the accompanying drawings shows another cross-sectional view of the golf club head of FIG. 34 along the line 35-35, and with polymers in the front cavity of the golf club head.

FIG. 34 of the accompanying drawings shows a rear, perspective view of another golf club head 1700, according to some examples. In the depicted example, the golf club head 1700 is an iron type golf club head. FIG. 35 of the accompanying drawings shows a cross-sectional view of the golf club head 1700 of FIG. 34 along line 35-35 in FIG. 34, and without any polymers in a front cavity 1722 of the golf club head 1700. FIG. 36 of the accompanying drawings shows another cross-sectional view of the golf club head 1700 of FIG. 34 along the line 35-35, and with polymers in the front cavity 1722 of the golf club head 1700. The golf club head 1700 may include some features similar to, or the same as, features of other golf club heads described herein, including, without limitation, the golf club heads 900, 1000, 1100, 1200, 1300, 1400, 1500, and 1600. Therefore, redundant descriptions of some features may not be repeated.

The golf club head 1700 includes a body 1702 including a toe 1703, a heel 1704, a striking face 1705 extending between the toe 1703 and the heel 1704 and having a lower leading edge 1706 and an opposite upper topline edge 1707, a sole 1710 extending rearward from the lower leading edge 1706 to a rearward portion 1711, a top portion 1712 extending rearward from the upper topline edge 1707, and a back portion 1713 coupled between the sole 1710 and the top portion 1712. The striking face 1705 may have a substantially flat outermost surface 1705O and an opposite inner surface 1705I, and one or more grooves 1709 may be defined in the outermost surface 1705O of the striking face 1705. The golf club head 1700 may also include a hosel 1701 that is disposed at the heel 1704 and that is configured to attach to a golf club shaft.

The body 1702 may at least partly surround a primary cavity 1720, and the golf club head 1700 may include an intermediate wall 1730 that divides the primary cavity 1720 into a front cavity 1722 and a rear cavity 1721. The intermediate wall 1730 may have a front surface 1730F and an opposite rear surface 1730R, and the front surface 1730F may be substantially parallel to the interior surface 1705I of the striking face 1705.

The body 1702 may have a top opening 1717 (e.g., a top slot) in the top portion 1712 and exposing the front cavity 1722. The golf club head 1700 may include a first polymer 1751 and a second polymer 1752 that fill at least part of the front cavity 1722. In the depicted example, the second polymer 1752 fills a portion of the front cavity 1722 proximal to the sole 1710, while the first polymer 1751 fills another portion of the front cavity 1722 above the second polymer 1752 that is separated from the sole 1710 by the second polymer 1752. The first polymer 1751 may be engaged with the second polymer 1752. In some examples, the first polymer 1751 fills the top opening 1717. For example, a surface of the first polymer 1751 facing the exterior of the golf club head 1700 may be continuous with at least part of an exterior surface of the top portion 1712. In some other examples, the top opening 1717 may be filled with a plug made, for example, from the same material as the remainder of the top portion 1712.

The first and second polymers 1751 and 1752 may include different polymer materials. For example, the polymer material of the second polymer 1752 may be harder or softer than the polymer material of the first polymer 1752.

In some examples, a volume of the first polymer 1751 is greater than about 50%, about 60%, about 65%, about 70%, about 75%, about 80%, or about 85% of the volume of the front cavity 1722. The volume of the first polymer 1751 may be less than about 90%, about 85%, about 80%, about 75%, or about 70% of the volume of the front cavity 1722. In some examples, a volume of the second polymer 1752 may be greater than about 5%, about 10%, about 15%, about 20%, or about 25% of the volume of the front cavity 1722. The volume of the second polymer 1752 may be less than about 40%, about 35%, about 30%, about 25%, about 20%, or about 15% of the volume of the front cavity 1722.

During the manufacture of the golf club head 1700, a polymer liquid may be injected into the front cavity 1722 through the top opening 1717 and cured to form the second polymer 1752, and then another polymer liquid may be injected into the front cavity 1722 onto the second polymer 1752 and cured to form the first polymer 1751.

Figure 37:
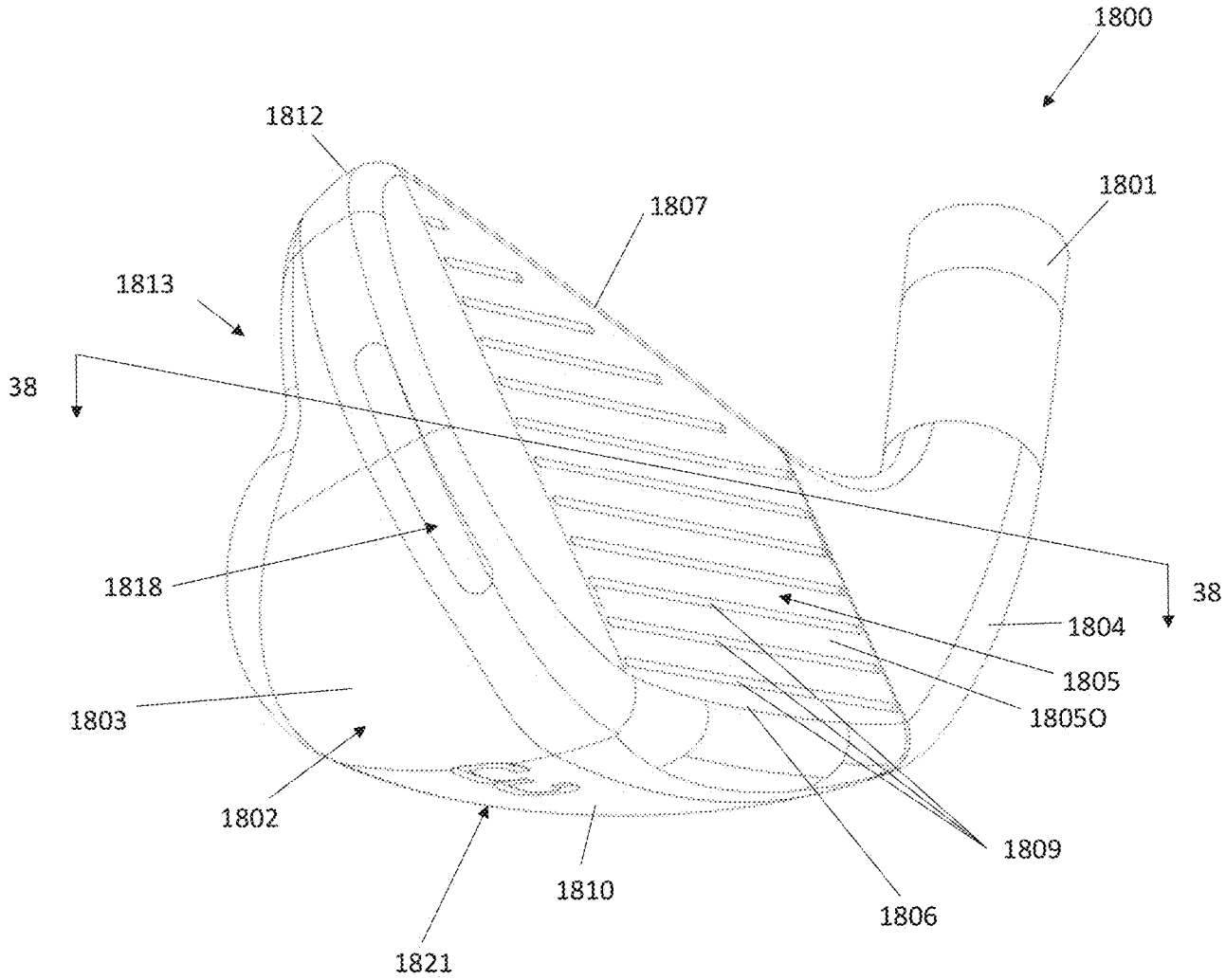
FIG. 37 of the accompanying drawings shows a toe, perspective view of another golf club head, according to some examples.
Figure 38:
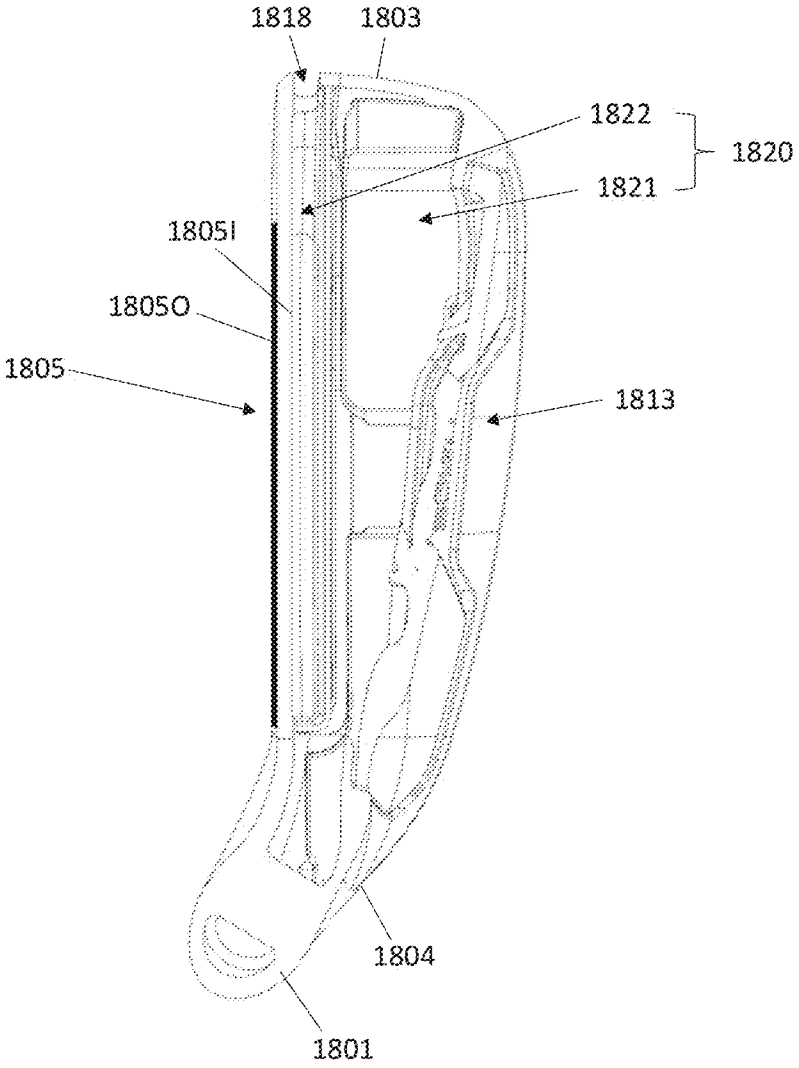
FIG. 38 of the accompanying drawings shows a cross-sectional view of the golf club head of FIG. 37 along line 38-38 in FIG. 37, and without any polymers in a front cavity of the golf club head.
Figure 39:
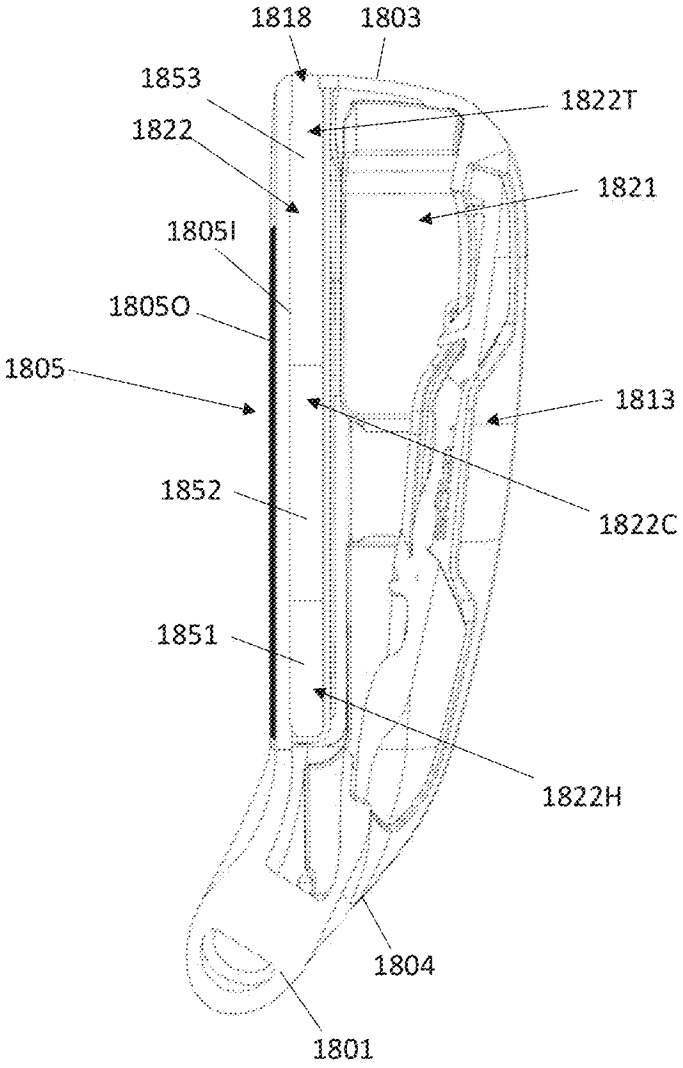
FIG. 39 of the accompanying drawings shows another cross-sectional view of the golf club head of FIG. 37 along the line 38-38, and with polymers in the front cavity of the golf club head.

FIG. 37 of the accompanying drawings shows a toe, perspective view of another golf club head 1800, according to some examples. In the depicted example, the golf club head 1800 is an iron type golf club head. FIG. 38 of the accompanying drawings shows a cross-sectional view of the golf club head 1800 of FIG. 37 along line 38-38 in FIG. 37, and without any polymers in a front cavity 1822 of the golf club head 1800. FIG. 39 of the accompanying drawings shows another cross-sectional view of the golf club head 1800 of FIG. 37 along the line 38-38, and with polymers in the front cavity 1822 of the golf club head 1800. The golf club head 1800 may include some features similar to the features of other golf club heads described herein, including, without limitation, the golf club heads 900, 1000, 1100, 1200, 1300, 1400, 1500, 1600, and 1700. Therefore, redundant descriptions of some features may not be repeated.

The golf club head 1800 includes a body 1802 including a toe 1803, a heel 1804, a striking face 1805 extending between the toe 1803 and the heel 1804 and having a lower leading edge 1806 and an opposite upper topline edge 1807, a sole 1810 extending rearward from the lower leading edge 1806 to a rearward portion 1811, a top portion 1812 extending rearward from the upper topline edge 1807, and a back portion 1813 coupled between the sole 1810 and the top portion 1812. The striking face 1805 may have a substantially flat outermost surface 1805O and an opposite inner surface 1805I, and one or more grooves 1809 may be defined in the outermost surface 1805O of the striking face 1805. The golf club head 1800 may also include a hosel 1801 that is disposed at the heel 1804 and that is configured to attach to a golf club shaft.

The body 1802 may at least partly surround a primary cavity 1820, and the golf club head 1800 may include an intermediate wall 1830 that divides the primary cavity 1820 into a front cavity 1822 and a rear cavity 1821. The front cavity 1822 may include a toe-ward portion 1822T, a heel-ward portion 1822H, and a center portion 1822C between the toe-ward portion 1822T and the heel-ward portion 1822H. The intermediate wall 1830 may have a front surface 1830F and an opposite rear surface 1830R, and the front surface 1830F may be substantially parallel to the interior surface 1805I of the striking face 1805.

The body 1802 may have a toe opening 1818 (e.g., a toe slot) in the toe 1803 and exposing the front cavity 1822. The golf club head 1800 may include a first polymer 1851, a second polymer 1852, and a third polymer 1853 that fill at least part of the front cavity 1822. In the depicted example, the first polymer 1851 fills at least part of the heel-ward portion 1822H, the second polymer 1852 fills at least part of the center portion 1822C, and the third polymer 1853 fills at least part of the toe-ward portion 1822T. For example, the first, second, and third polymers 1851, 1852, and 1853 may be stacked in a heel-to-toe direction within the front cavity 1822. The second polymer 1852 may be engaged with the first polymer 1851 and/or the third polymer 1853. In some examples, the third polymer 1853 fills the toe opening 1818. For example a surface of the third polymer 1852 facing the exterior of the golf club head 1800 may be continuous with at least part of an exterior surface of the toe 1803. In some other examples, the toe opening 1818 is plugged with a plug made of, for example, a same material as the material of the toe 1803. Although the golf club head 1800 is depicted as including three polymers, the present disclosure is not limited thereto. For example, the golf club head 1800 could have two or four or more polymers in the front cavity 1822 and arranged with each other along the toe-heel direction.

During the manufacture of the golf club head 1800, a polymer liquid may be injected into the front cavity 1822 through the toe opening 1818 and cured to form the first polymer 1851. Another polymer liquid may then be injected into the front cavity 1822 (through the toe opening 1818) onto the first polymer 1851 and cured to form the second polymer 1852. Then another polymer liquid may be injected into the front cavity 1822 (through the toe opening 1818) onto the second polymer 1852 and cured to form the third polymer 1853.

The second polymer 1852 may include a different polymer material from each of the first and third polymers 1851 and 1853, and the third polymer 1853 may include a polymer material that is the same as, or different from, the polymer material of the first polymer 1851. For example, the first, second, and third polymers 1851, 1852, and 1853 may have progressively greater or lesser hardness in the heel-to-toe direction. In some examples, the second polymer has a greater or lesser hardness than each of the first and third polymers 1851 and 1853.

A volume of the first polymer 1851 may be greater than about 5%, about 10%, about 15%, or about 20% of the volume of the front cavity 1822, and may be less than about 60%, about 50%, or about 40% of the volume of the front cavity 1822. A volume of the second polymer 1852 may be greater than about 5%, about 10%, about 15%, or about 20% of the volume of the front cavity 1822, and may be less than about 60%, about 50%, or about 40% of the volume of the front cavity 1822. A volume of the third polymer 1853 may be greater than about 5%, about 10%, about 15%, or about 20% of the volume of the front cavity 1822, and may be less than about 60%, about 50%, or about 40% of the volume of the front cavity 1822.

Figure 40:
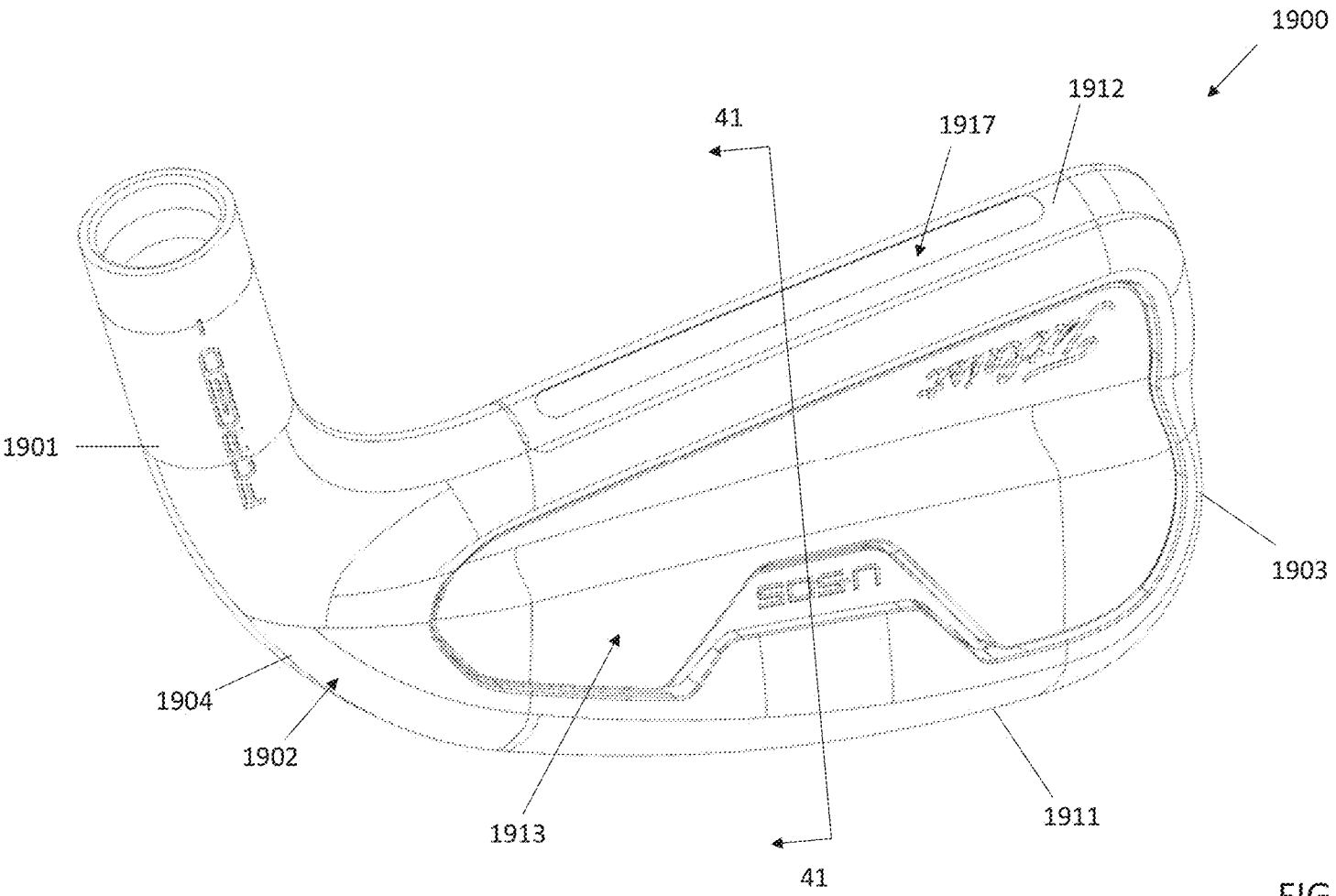
FIG. 40 of the accompanying drawings shows a rear, perspective view of another golf club head, according to some examples.
Figure 41:
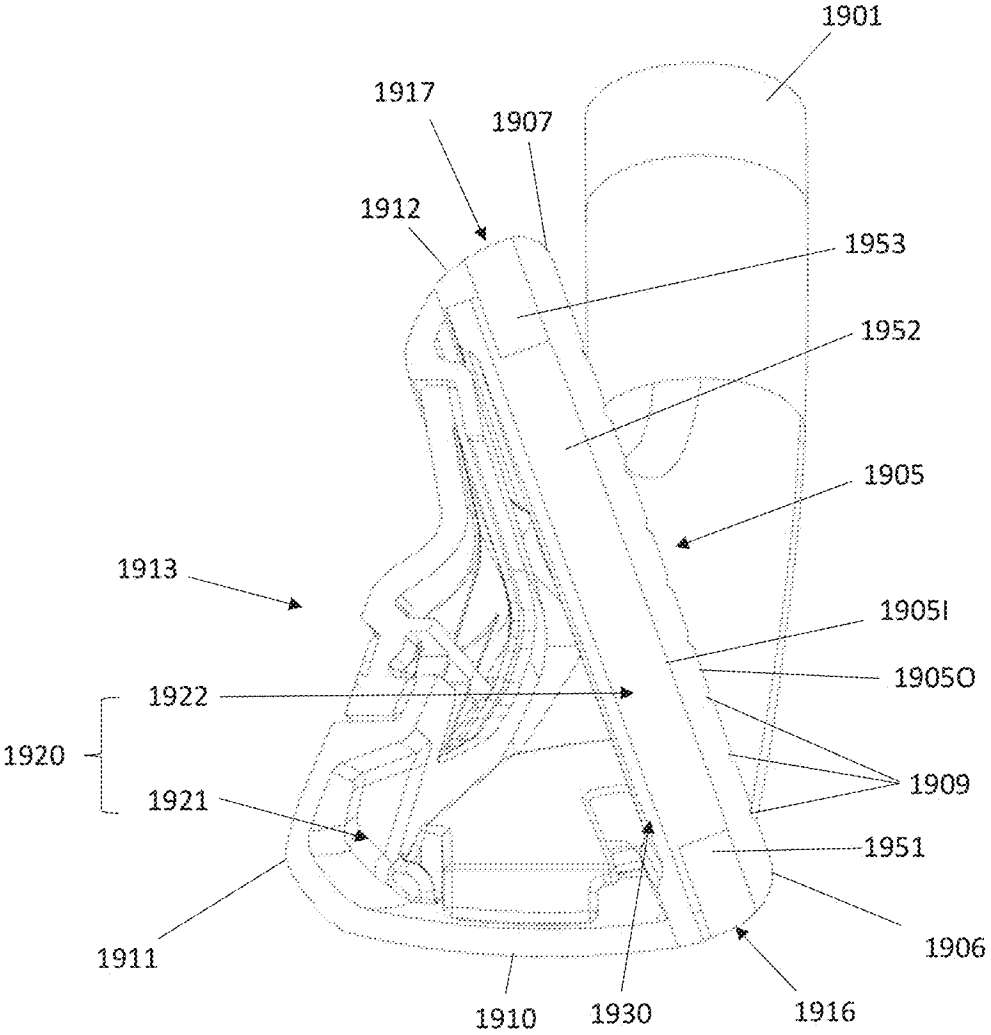
FIG. 41 of the accompanying drawings shows a cross-sectional view of the golf club head of FIG. 40 alone line 41-41.

FIG. 40 of the accompanying drawings shows a rear, perspective view of another golf club head 1900, according to some examples. In the depicted example, the golf club head 1900 is an iron type golf club head. FIG. 41 of the accompanying drawings shows a cross-sectional view of the golf club head 1900 of FIG. 40 alone line 41-41. The golf club head 1900 may include some features similar to, or the same as, the features of other golf club heads disclosed herein, including, without limitation, the golf club heads 900, 1000, 1100, 1200, 1300, 1400, 1500, 1600, 1700, and 1800. Therefore, redundant descriptions of some features may not be repeated.

The golf club head 1900 includes a body 1902 including a toe 1903, a heel 1904, a striking face 1905 extending between the toe 1903 and the heel 1904 and having a lower leading edge 1906 and an opposite upper topline edge 1907, a sole 1910 extending rearward from the lower leading edge 1906 to a rearward portion 1911, a top portion 1912 extending rearward from the upper topline edge 1907, and a back portion 1913 coupled between the sole 1910 and the top portion 1912. The striking face 1905 may have a substantially flat outermost surface 1905O and an opposite inner surface 1905I, and one or more grooves 1909 may be defined in the outermost surface 1905O of the striking face 1905. The golf club head 1900 may also include a hosel 1901 that is disposed at the heel 1904 and that is configured to attach to a golf club shaft.

The body 1902 may at least partly surround a primary cavity 1920, and the golf club head 1900 may include an intermediate wall 1930 that divides the primary cavity 1920 into a front cavity 1922 and a rear cavity 1921. The intermediate wall 1930 may have a front surface 1930F and an opposite rear surface 1930R, and the front surface 1930F may be substantially parallel to the interior surface 1905I of the striking face 1905.

The body 1902 may have a sole opening 1916 (e.g., a sole slot) in the sole 1910 and a top opening 1917 (e.g., a top slot) in the top portion 1912. The sole opening 1916 and the top opening 1917 may expose the front cavity 1922. The golf club head 1900 may include a first polymer 1951, a second polymer 1952, and a third polymer 1953 that fill at least part of the front cavity 1922. In the depicted example, the first polymer 1951 fills a portion of the front cavity 1922 proximal to the sole 1910, the third polymer 1953 fills another portion of the front cavity 1922 proximal to the top portion 1912, and the second polymer 1952 fills another portion of the front cavity 1922 between the first and third polymers 1951 and 1953. The second polymer 1852 may be engaged with the first polymer 1951 and/or the third polymer 1953.

During the manufacture of the golf club head 1900, the first polymer 1951 may be prefabricated and inserted at least partially into the front cavity 1922 through the sole opening 1916. The prefabricated first polymer 1951 can act as a plug to fluidically seal the sole opening 1916. A polymer liquid can then be injected into the front cavity 1922 through the top opening 1917 and onto the first polymer 1951, and the polymer liquid can be cured to form the second polymer 1952. The third polymer 1953 may be prefabricated and inserted at least partially into the front cavity 1922 through the top opening 1917. The prefabricated third polymer 1953 can act as a plug to fluidically seal the top opening 1917. In some other examples, the third polymer 1953 may be formed by pouring a polymer liquid into the front cavity 1922 through the top opening 1917 and onto the second polymer 1952, and then curing the polymer liquid to form the third polymer 1953.

Other examples are also encompassed within the present disclosure. For example, a reverse process of including the first, second, and third polymers 1951, 1952, and 1953 may be performed during the manufacture of the golf club head 1900, wherein the third polymer 1953 is prefabricated and inserted at least partially into the front cavity 1922, the second polymer 1952 is formed in the front cavity 1922, and the first polymer 1951 is inserted at least partly into the front cavity 1922 through the sole opening 1916.

The second polymer 1952 may include a different polymer material from each of the first and third polymers 1951 and 1953, and the third polymer 1953 may include a polymer material that is the same as, or different from, the polymer material of the first polymer 1951. For example, the first, second, and third polymers 1951, 1952, and 1953 may have progressively greater or lesser hardness in a direction from the sole opening 1916 toward the top opening 1917. In some examples, the second polymer has a greater or lesser hardness than each of the first and third polymers 1951 and 1953.

A volume of the first polymer 1951 may be greater than about 5%, about 10%, about 15%, or about 20% of the volume of the front cavity 1922, and may be less than about 50%, about 45%, or about 40% of the volume of the front cavity 1922. A volume of the second polymer 1952 may be greater than about 20%, about 30%, about 40%, or about 50% of the volume of the front cavity 1922, and may be less than about 80%, about 70%, or about 60% of the volume of the front cavity 1922. A volume of the third polymer 1953 may be greater than about 5%, about 10%, about 15%, or about 20% of the volume of the front cavity 1922, and may be less than about 50%, about 45%, or about 40% of the volume of the front cavity 1922. A height of the first and third polymers 1951 and 1953 (e.g., along the direction from the sole opening 1916 toward the top opening 1917) may affect a coefficient of restitution (COR) of the striking face 1905 and, thus, can be selected to achieve a desired COR among other things, including other mechanical characteristics of the golf club head 1900.

Figure 42:
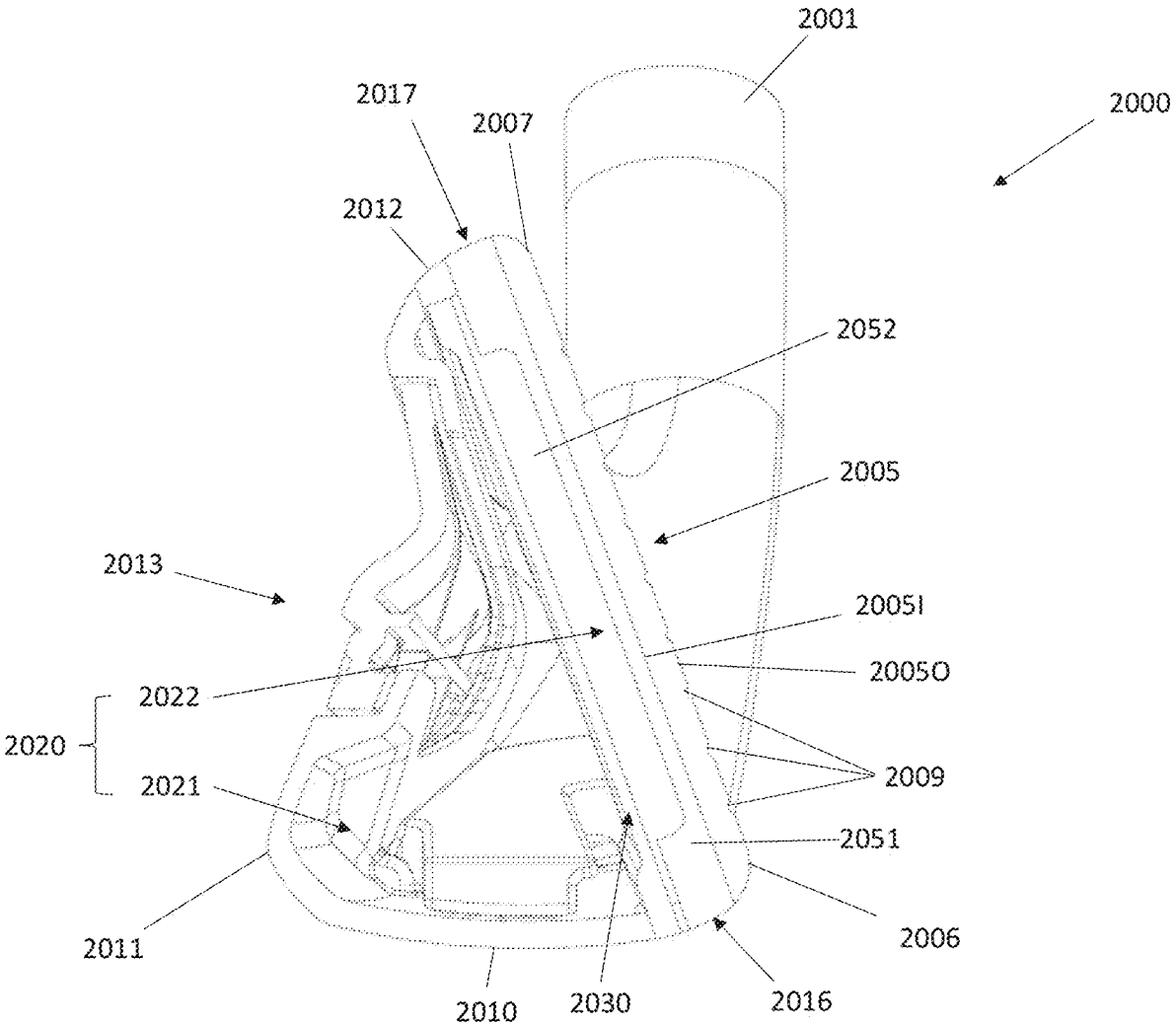
FIG. 42 of the accompanying drawings shows a cross-sectional view of another golf club head, according to some examples.

FIG. 42 of the accompanying drawings shows a cross-sectional view of another golf club head 2000, according to some examples. In the depicted example, the golf club head 2000 is an iron type golf club head. The golf club head 2000 may include some features similar to, or the same as, the features of some of the other golf club heads described herein, including, without limitation, the golf club heads 900, 1000, 1100, 1200, 1300, 1400, 1500, 1600, 1700, 1800, and 1900.

The golf club head 2000 includes a body 2002 including a toe 2003, a heel 2004, a striking face 2005 extending between the toe 2003 and the heel 2004 and having a lower leading edge 2006 and an opposite upper topline edge 2007, a sole 2010 extending rearward from the lower leading edge 2006 to a rearward portion 2011, a top portion 2012 extending rearward from the upper topline edge 2007, and a back portion 2013 coupled between the sole 2010 and the top portion 2012. The striking face 2005 may have a substantially flat outermost surface 2005O and an opposite inner surface 2005I, and one or more grooves 2009 may be defined in the outermost surface 2005O of the striking face 2005. The golf club head 2000 may also include a hosel 2001 that is disposed at the heel 2004 and that is configured to attach to a golf club shaft.

The body 2002 may at least partly surround a primary cavity 2020, and the golf club head 2000 may include an intermediate wall 2030 that divides the primary cavity 2020 into a front cavity 2022 and a rear cavity 2021. The intermediate wall 2030 may have a front surface 2030F and an opposite rear surface 2030R, and the front surface 2030F may be substantially parallel to the interior surface 2005I of the striking face 2005.

The body 2002 may have a sole opening 2016 (e.g., a sole slot) in the sole 2010 and a top opening 2017 (e.g., a top slot) in the top portion 2012. The sole opening 2016 and the top opening 2017 may expose the front cavity 2022.

The golf club head 2000 may include a first polymer 2051 and a second polymer 2052 that fill at least part of the front cavity 2022. In the depicted example, the first polymer 2051 extends between the sole opening 2016 and the top opening 2017. For example, a lower portion of the first polymer 2051 may fill at least part of the sole opening 2016, an upper portion of the first polymer 2051 may fill at least part of the top opening 2017, and a center portion of the first polymer 2051 may extend between the upper and lower portions of the first polymer 2051.

A thickness of the center portion of the first polymer 2051 may be thinner than the thicknesses of the upper and lower portions of the first polymer 2051. For example, in the depicted example, the first polymer 2051 has a recess at the center portion of the first polymer 2051 and in a rear surface of the first polymer 2051 such that a space is defined between the intermediate wall 2030 and the rear surface of the first polymer 2051. In some other examples, the recess may be in the front surface of the first polymer 2051 such that the space is defined between the striking face 2005 and the front surface of the first polymer 2051. In some other examples, the first polymer 2051 may have a recess in each of the front and rear surfaces of the first polymer 2051.

The second polymer 2052 may fill the space defined between the intermediate wall 2030 and the rear surface of the first polymer 2051. The second polymer 2052 may be engaged with the first polymer 2051, and may cover at least part of a rear surface of the first polymer 2051. Although only one polymer (the second polymer 2052) is illustrated as filling this space, in some other examples, two or more different polymer materials may fill this space.

During the manufacture of the golf club head 2000, the first polymer 2051 may be prefabricated and inserted at least partially into the front cavity 2022 through the sole opening 2016 or through the top portion 2017. A polymer liquid may then be injected into the front cavity 2022 to fill at least part of the space defined between the intermediate wall 2030 and the first polymer 2051, and the polymer liquid may be cured to form the second polymer 2052. The polymer liquid may be injected through various potential openings. These may include at least one of an opening in the toe 2003, a portion of the toe opening 2016 that was not filled by the first polymer 2051, a portion of the top opening 2017 that was not filled by the first polymer 2051, or an opening formed through part of the first polymer 2051 to provide an access opening.

The first and second polymers 2051 and 2052 may include different polymer materials. A volume of the first polymer 2051 may be greater than about 30%, about 40%, about 50%, or about 60% of the volume of the front cavity 2022, and may be less than about 80%, about 70%, or about 60% of the volume of the front cavity 2022. A volume of the second polymer 2052 may be greater than about 10%, about 20%, or about 30%, of the volume of the front cavity 2022, and may be less than about 60%, about 50%, or about 40% of the volume of the front cavity 2022.

Figure 43:
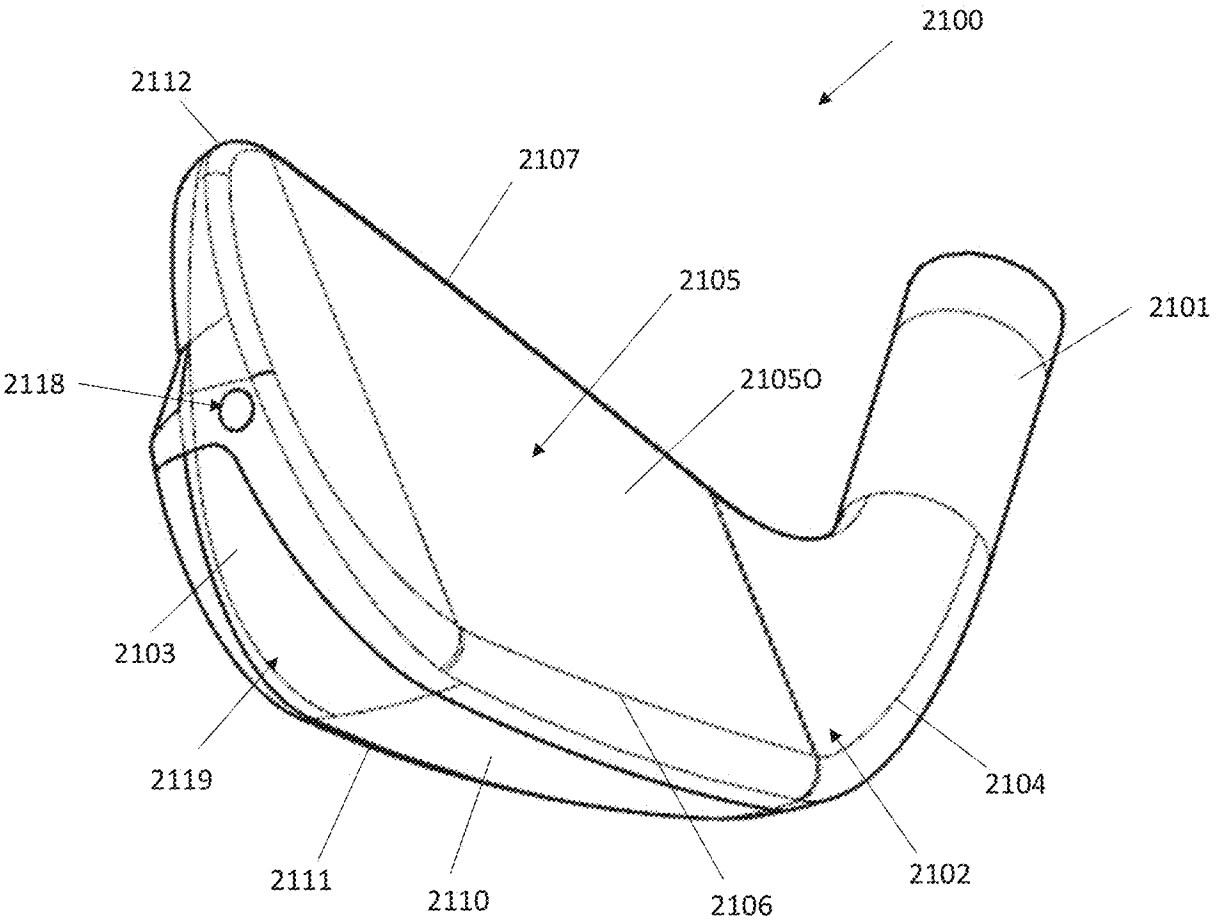
FIG. 43 of the accompanying drawings shows a toe-side perspective view of another golf club head, according to some examples.
Figure 44:
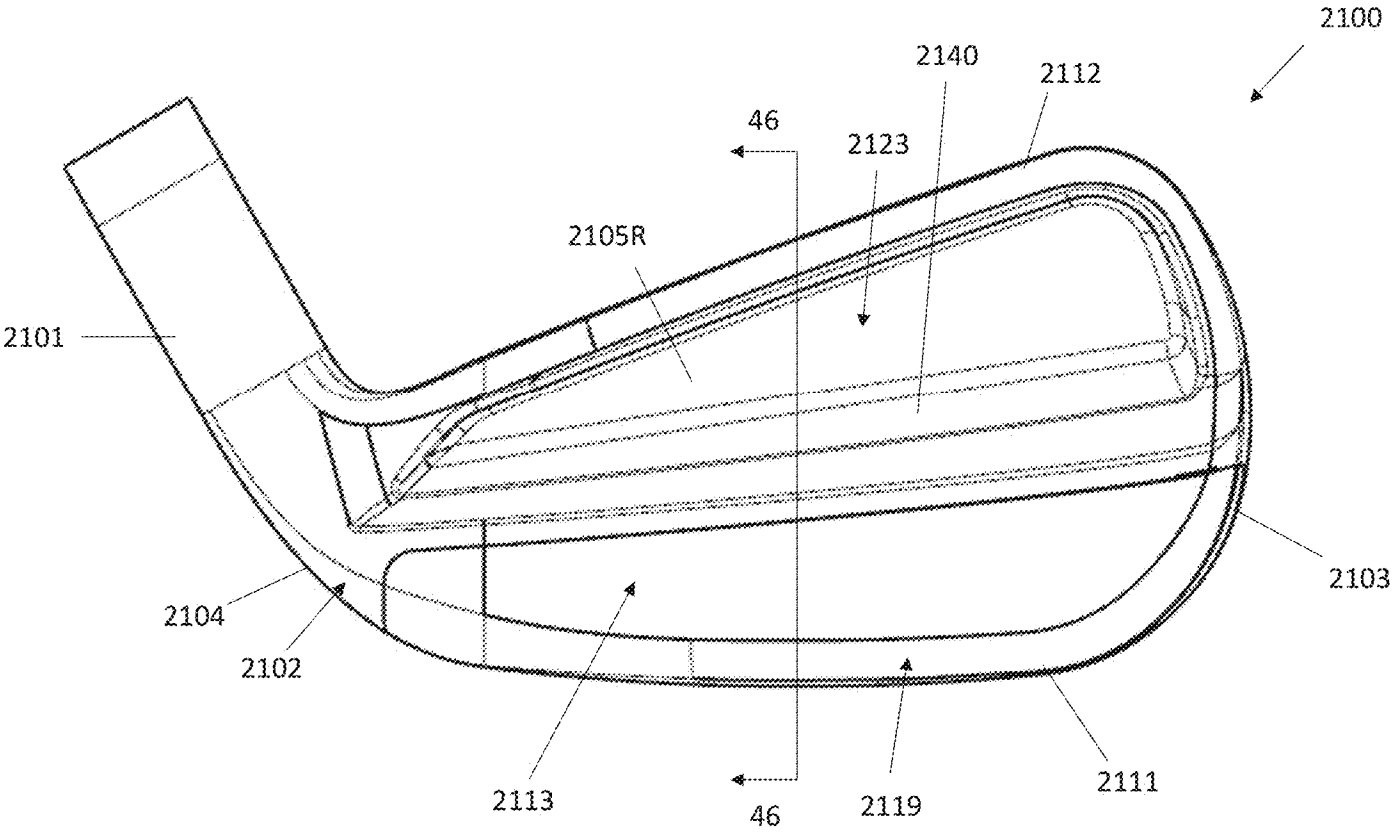
FIG. 44 of the accompanying drawings shows a back view of the golf club head of FIG. 43.
Figure 45:
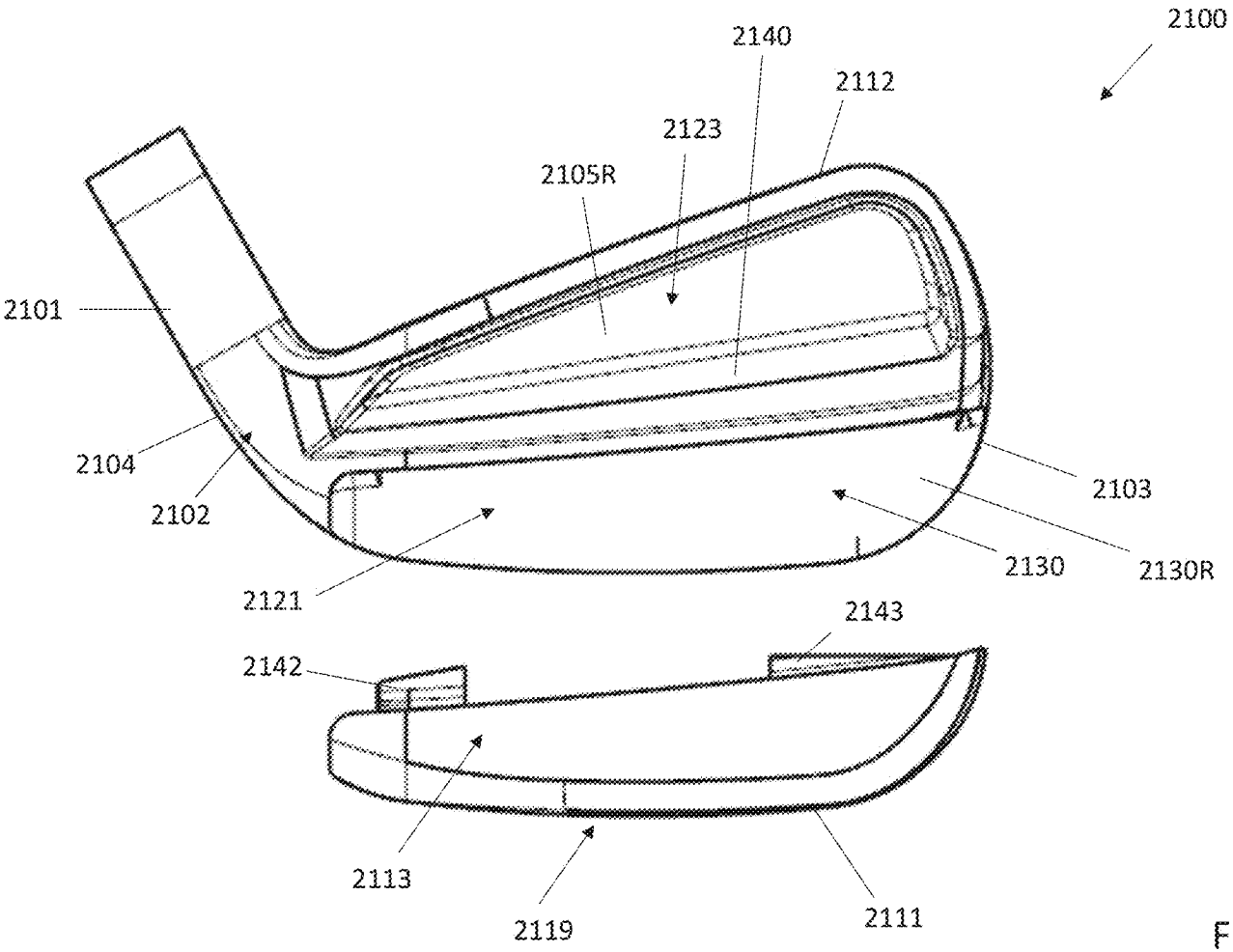
FIG. 45 of the accompanying drawings shows a partially exploded back view of the golf club head of FIG. 43.
Figure 46:
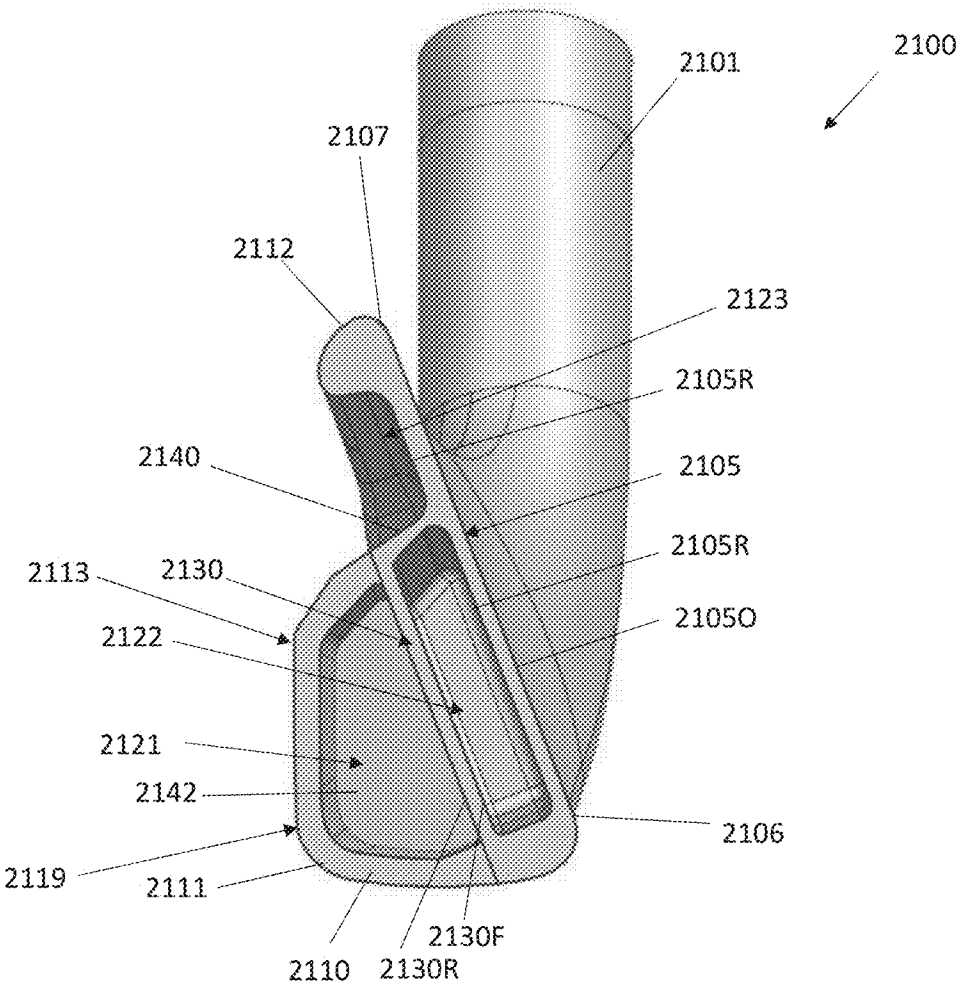
FIGS. 46 and 47 of the accompanying drawings each shows a cross-sectional view of the golf club head of FIG. 43 along the line 46-46 in FIG. 44, and without any polymer material in a front cavity of the golf club head.
Figure 47:
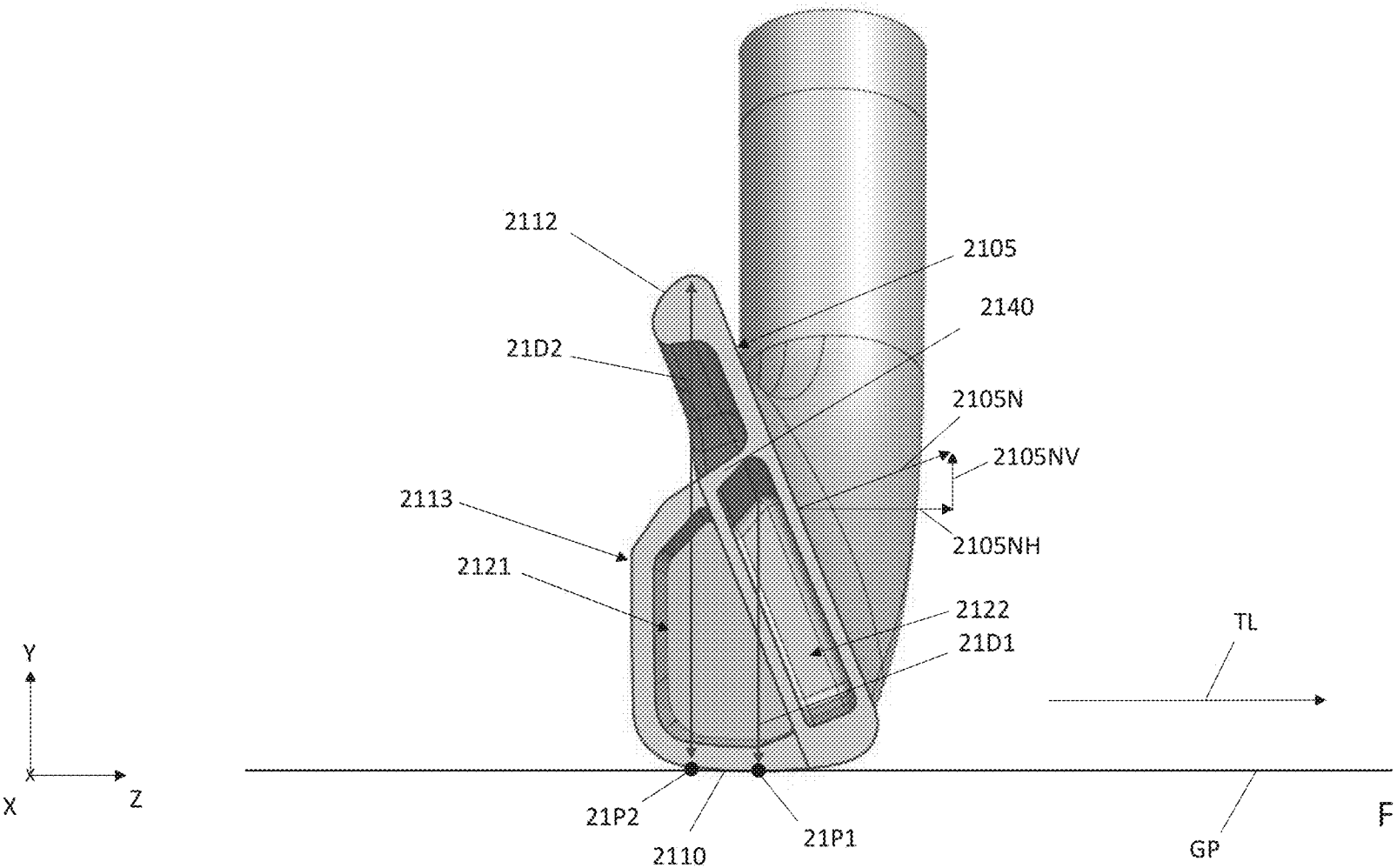
Figure 48:
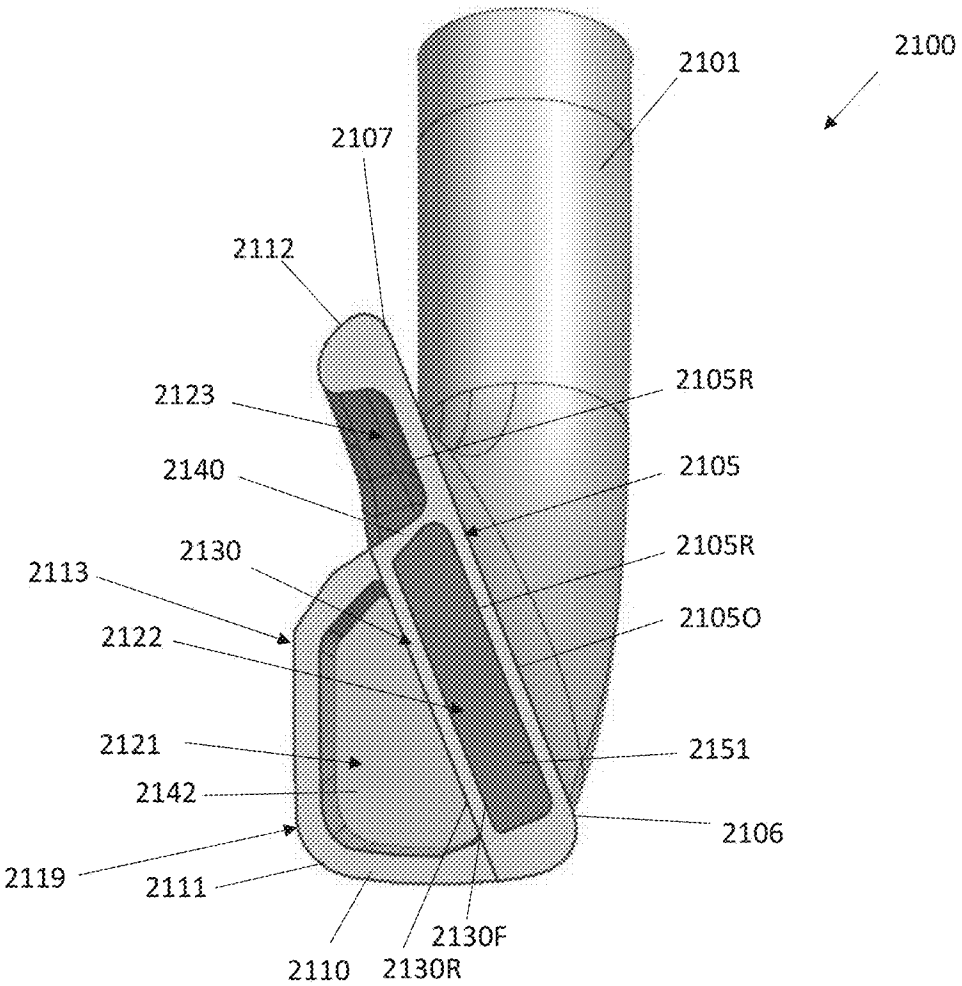
FIG. 48 of the accompanying drawings shows another cross-sectional view of the golf club head of FIG. 43 along the line 46-46 in FIG. 44, and with a first polymer material in the front cavity.

FIG. 43 of the accompanying drawings shows a toe-side perspective view of another golf club head 2100, according to some examples. In the depicted example, the golf club head 2100 is an iron type golf club head. FIG. 44 of the accompanying drawings shows a back view of the golf club head 2100 of FIG. 43. FIG. 45 of the accompanying drawings shows a partially exploded back view of the golf club head 2100 of FIG. 43. FIGS. 46 and 47 of the accompanying drawings each shows a cross-sectional view of the golf club head 2100 of FIG. 43 along the line 46-46 in FIG. 44, and without any polymer material in a front cavity 2122 of the golf club head 2100. FIG. 48 of the accompanying drawings shows another cross-sectional view of the golf club head 2100 head of FIG. 43 along the line 46-46 in FIG. 44, and with a first polymer 2151 in the front cavity 2122. The golf club head 2100 may include some features similar to the features of other golf club heads described herein. Therefore, redundant descriptions of some features may not be repeated.

Referring concurrently to FIGS. 43-48, the golf club head 2100 includes a body 2102 including a toe 2103, a heel 2104, a striking face 2105 extending between the toe 2103 and the heel 2104 and having a lower leading edge 2106 and an opposite upper topline edge 2107, a sole 2110 extending rearward from the lower leading edge 2106 to a rearward portion 2111, a back portion 2113 coupled to the rearward portion 2111 of the sole 2110, a top portion 2112 extending rearward from the upper topline edge 2107, and a support bar 2140 that protrudes rearwardly from the striking face 2105. The striking face 2105 may have a substantially flat outermost surface 2105O and an opposite rear surface 2105R, and one or more grooves (not shown) may be defined in the outermost surface 2105O of the striking face 2105. The golf club head 2100 may include a hosel 2101 that is disposed at the heel 2104 and that is configured to attach to a golf club shaft.

A rear portion of the body 2102 may be defined by a cradle 2119 that is attached (e.g., during the manufacturing of the golf club head 2100) to a front portion of the body 2102. The cradle 2119 may define at least part of the sole 2110 and at least part of the back portion 2113.

The golf club head 2100 may include an intermediate wall 2130 that extends from the sole 2110 to the support bar 2140 (or to the back portion 2113). The intermediate wall 2130 may have a front surface 2130F and an opposite rear surface 2130R, and the front surface 2130F may be substantially parallel to the rear surface 2105R of the striking face 2105.

In some examples, the golf club head 2100 has a front cavity 2122 positioned rearward to the striking face 2105 and defined at least in part by the striking face 2105, the support bar 2140, and the intermediate wall 2130. In some examples, such as the non-limiting example depicted in FIGS. 43-48, the front cavity 2122 is partly defined in part by the sole 2110.

The golf club head 2100 may further have a rear cavity 2121 positioned reward to the front cavity 2122 and defined at least in part by the intermediate wall 2130 and the back portion 2113. In some examples, such as the non-limiting example depicted in FIGS. 43-48, the rear cavity 2121 may be defined in part by the sole 2110. One or more weights may be positioned at least partially in the rear cavity 2121 to, for example, control the weight and/or center of gravity of the golf club head 2100, which can allow for various performance characteristics of the golf club head 2100 to be selectively adjusted based on, for example, the number, size, material, position, and orientation of the one or more weights. In the non-limiting example depicted, the golf club head 2100 includes first and second tungsten weights 2142 and 2143 respectively positioned at a heel end of the rear cavity 2121 and at a toe end of the rear cavity 2121.

The golf club head 2100 may further have an upper cavity 2123 positioned rearward to the striking face 2105 and between the front cavity 2122 and the top portion 2112. For example, at least part (e.g., part or all) of the front cavity 2122 may be spaced apart from the top portion 2112 by the upper cavity 2123. The upper cavity 2123 may be defined at least in part by the striking face 2105, the support bar 2140, and the top portion 2112. In some examples, the upper cavity 2123 is open to the outside of the golf club head 2100 at the back of the upper cavity 2123 (e.g., at a back side of the upper cavity 2123 opposite to the striking face 2105). For example, the upper cavity 2123 may be an indent or recession in the rear of the golf club head 2100.

The front cavity 2122 may have a volume of less than 8,500 $mm^3$, 8,000 $mm^3$, 7,500 $mm^3$, 7,000 $mm^3$, 6,500 $mm^3$, 6,000 $mm^3$, 5,500 $mm^3$, 5,000 $mm^3$, or 4,500 $mm^3$. The volume of the front cavity 2122 may be greater than 3,000 $mm^3$, 3,500 $mm^3$, 4,000 $mm^3$, 4,500 $mm^3$, or 5,000 $mm^3$.

The rear cavity 2121 may have a volume of less than 13,000 $mm^3$, 12,000 $mm^3$, 11,000 $mm^3$, 10,500 $mm^3$, 10,000 $mm^3$, 9,500 $mm^3$, or 9,000 $mm^3$. The volume of the rear cavity 2121 may be greater than 5,000 $mm^3$, 5,500 $mm^3$, 6,000 $mm^3$, 6,500 $mm^3$, 7,000 $mm^3$, 7,500 $mm^3$, or 8,000 $mm^3$.

The front cavity 2122 may extend only part way up along the striking face 2105 (e.g., along the rear surface 2105R of the striking face 2105) from the sole 2110 toward the top portion 2112. For example, the golf club head 2100 may be configured (e.g., shaped and sized) such that, when the golf club head 2100 is in an address position on the ground plane GP, the top portion 2112 is positioned higher up from a ground plane GP than a top of the front cavity 2122 along a direction perpendicular to the ground plane GP. The address position, as defined by the current application, sets up the golf club head 2100 at an orientation that has a lie angle of 60 degrees similar to the requirements of the USGA. Once the lie angle is set at 60 degrees, the face angle of the golf club head is set to be square, which is defined as having a face angle of 0 degrees. The face angle is defined as the angle that the target line TL forms to a horizontal component 2105NH of a normal line 2105N that is normal to the outermost surface 2105O of the striking face 2105.

Referring to FIG. 47, the golf club head 2100 is depicted as being on the ground plane GP in the address position. An X-Y-Z coordinate system is depicted in FIG. 47, in which the plane of the page is parallel to the Y-Z plane, and the X-axis is perpendicular to both the Y- and Z-axes and points into the plane of the page. In FIG. 47, the ground plane GP is parallel to the X-Z plane, and the target line TL of the address position of the golf club head 2100 is parallel to the Z-axis. The normal line 2105N can be defined as the vector sum of a horizontal component 2105NH that is parallel to the X-Z plane and a vertical component 2105NV that is parallel to the Y-axis. Because the golf club head 2100 is square, the normal line 2105N is in the Y-Z plane, and the horizontal component 2105NH is parallel to the Z-axis.

In some examples, when the golf club head 2100 is in the address position on the ground plane GP, a greatest cavity height distance 21D1 of the front cavity 2122 in a cross-sectional plane (e.g., the Y-Z plane in FIG. 47) is less than 80%, 75%, 70%, 65%, 60%, 55%, or 50% of a greatest club height distance 21D2 in the cross-sectional plane. In some examples, the greatest cavity height distance 21D1 is greater than 30%, 35%, 40%, 45%, or 50% of the greatest club height distance 21D2. The cross-sectional plane may be perpendicular to the ground plane GP and parallel to the target line TL. In some examples, the cross-sectional plane may be perpendicular to the ground plane GP and perpendicular to a toe-heel direction of the golf club head 2100. The greatest cavity height distance 21D1 may be measured along a first direction (the Y-axis direction in FIG. 47) perpendicular to the ground plane GP and from first point 21P1 on the ground plane GP to the top of the front cavity 2122 (e.g., to a point of a surface defining a top of the front cavity 2122). The greatest club height distance 21D2 may be measured along the first direction and from a second point 21P2 on the ground plane GP to the top portion 2112.

In some examples, the cross-sectional plane may extend through a center of the striking face 2105, also known as the "Face Center". "Face Center", when referring to an iron, does not actually refer to the geometric center of the golf club head, but rather an arbitrary location intended to simulate the optimal impact location for hitting an iron. This optimal impact location is defined as a location that is 15 mm from the ground plane GP along the Y-axis, which roughly equals the third scoreline on the striking face 2105 of the golf club head 2100. In addition to the vertical location along the Y-axis, the location of the "Face Center" along the X-axis, as defined by the present invention, is defined as the midpoint of the (full length) scorelines, wherein the scorelines are intended to replicate the impact region of the golf club head. Finally, the Z-axis location of the "Face Center" is defined by the outermost surface 2105O of the striking face 2105. In some other examples, the cross-sectional plane may extend, for example, through a heel end of the front cavity 2122 or through a toe end of the front cavity 2122.

In some examples, when the golf club head 2100 is in the address position on the ground plane GP, a greatest cavity height distance of the front cavity 2122, in all cross-sectional planes perpendicular to the ground plane GP and parallel to the target line TL (or perpendicular to the toe-heel direction) and as measured along the first direction and from the ground plane GP to a top of the front cavity 2122, is less than 80%, 75%, 70%, 65%, 60%, 55%, or 50% of a greatest club height distance, in all of the cross-sectional planes and as measured along the first direction and from the ground plane GP to the top portion 2112. In some examples, the greatest cavity height distance is greater than 30%, 35%, 40%, 45%, or 50% of the greatest club height distance.

In some examples, when the golf club head 2100 is in the address position on the ground plane GP, a smallest cavity height distance of the front cavity 2122, in all of the cross-sectional planes and as measured along the first direction and from the ground plane GP to the top of the front cavity 2122, is less than 80%, 75%, 70%, 65%, 60%, 55%, or 50% of a smallest club height distance, in all of the cross-sectional planes and as measured along the first direction and from the ground plane GP to the top portion 2112. In some examples, the smallest cavity height distance is greater than 30%, 35%, 40%, 45%, or 50% of the smallest club height distance.

By shaping and sizing the front cavity 2122 such that it extends only part way up the striking face 2105 from the sole 2110, the volume of the front cavity 2122 can reduced (e.g., to less than 8,500 $mm^3$) so that the material needed for forming the golf club head 2100 is reduced. This can reduce the cost and environmental footprint of manufacturing the golf club head 2100. Furthermore, because the support bar 2140 may protrude from the striking face 2105 so that the support bar 2140 encloses part of the front cavity 2122, support and stiffness of the striking face 2105 can be increased, which can improve the feel of the golf club head 2100 when striking a golf ball with the striking face 2105. In contrast, in an example where the front cavity extends all the way up to the top portion, the volume of the front cavity may be increased and the support bar may not be included behind the striking face, which can increase the cost and environmental impact of manufacturing the golf club head, and reduce the stiffness and support of the striking face.

The golf club head 2100 may include one or more polymer materials that at least partially fill the front cavity 2122. In the non-limiting example depicted, the golf club head 2100 includes a first polymer 2151 of a first polymer material that entirely fills the front cavity 2122. In some other examples, the golf club head may include a plurality of different polymers respectively of different polymer materials in the front cavity 2122. For example, the golf club head 2100 may include two or more polymers of different polymer materials and arranged from a bottom portion of the front cavity 2122 closest to the sole 2110 toward the top portion of the front cavity 2122 closest to the top portion 2112, or arranged from the top portion of the front cavity 2122 toward the bottom portion of the front cavity 2122. In some other examples, the golf club head 2100 may include two or more polymers of different polymer materials and arranged in a toe-heel direction in the front cavity 2122. In some examples, the one or more polymer materials may only fill part the front cavity 2122, while another part of the front cavity 2122 is void (not filled with any solid material). In some examples, the golf club head 2100 does not include any polymer materials in the front cavity 2122. For example, the entire front cavity 2122 may be void.

The body 2102 may have a toe opening 2118 (e.g., a hole or a slot) in the toe 2103 that exposes the front cavity 2122. The one or more polymer materials may be input into the front cavity 2122 through the toe opening 2118. For example, the one or more polymer materials may be injected as liquids into the front cavity 2122 through the toe opening 2118 and then cured to form one or more corresponding solid polymers. In some other examples, the toe opening 2118 is an elongated slot, and the one or more polymer materials are prefabricated and then inserted into the front cavity 2122. The toe opening 2118 may be at least partially filled with a plug, which may, for example, be a polymer that is integrally formed with at least one polymer in the front cavity 2122. In some examples, the plug may be prefabricated and inserted into the toe opening 2118. For example, the plug may include a different material than at least one of the one or more polymers in the front cavity 2122. For example, the plug may include a different polymer material than at least one (e.g., all) of the one or more polymers in the front cavity 2122, or the plug may include a nonpolymer material, such as a metal.

During fabrication of the golf club head 2100, the cradle 2119 may be fabricated separately from the front portion of the body 2102, the one or more weights may be placed in the rear cavity 2121 (e.g., within the cradle 2119 or on the rear surface 2130R of the intermediate wall 2130), and the cradle 2119 may be attached (e.g., by welding, one or more fasteners, an adhesive, etc.) to the front portion of the body 2102. For example, the cradle 2119 may be attached to at least one of the support bar 2140, the sole 2110, or the striking face 2105. After the cradle 2119 is attached to the front portion of the body 2102, the one or more polymer materials may be put into the front cavity 2122. The one or more polymer materials may also be used to fill the toe opening 2118.

In some examples, the intermediate wall 2130 may be fabricated with the front portion of the body 2102 such that the front cavity 2122 is partially enclosed by the intermediate wall 2130 before the cradle 2119 is attached to the front portion of the body 2102. In some other examples, the intermediate wall 2130 is fabricated with the cradle 2119 such that the front cavity 2122 is exposed at the rear until the cradle 2119 is attached to the front portion of the body 2102.

Figure 49:
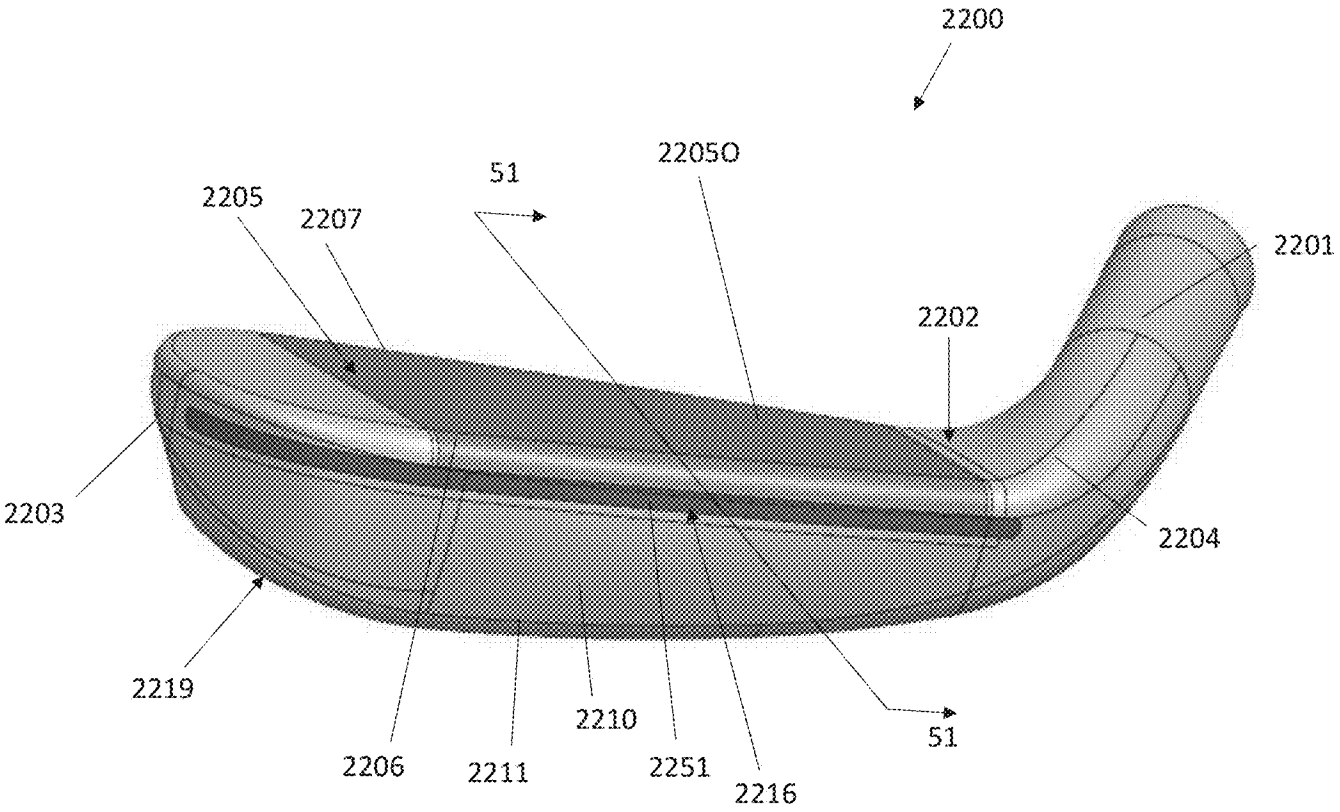
FIG. 49 of the accompanying drawings shows a bottom perspective view of another golf club head, according to some examples.
Figure 50:
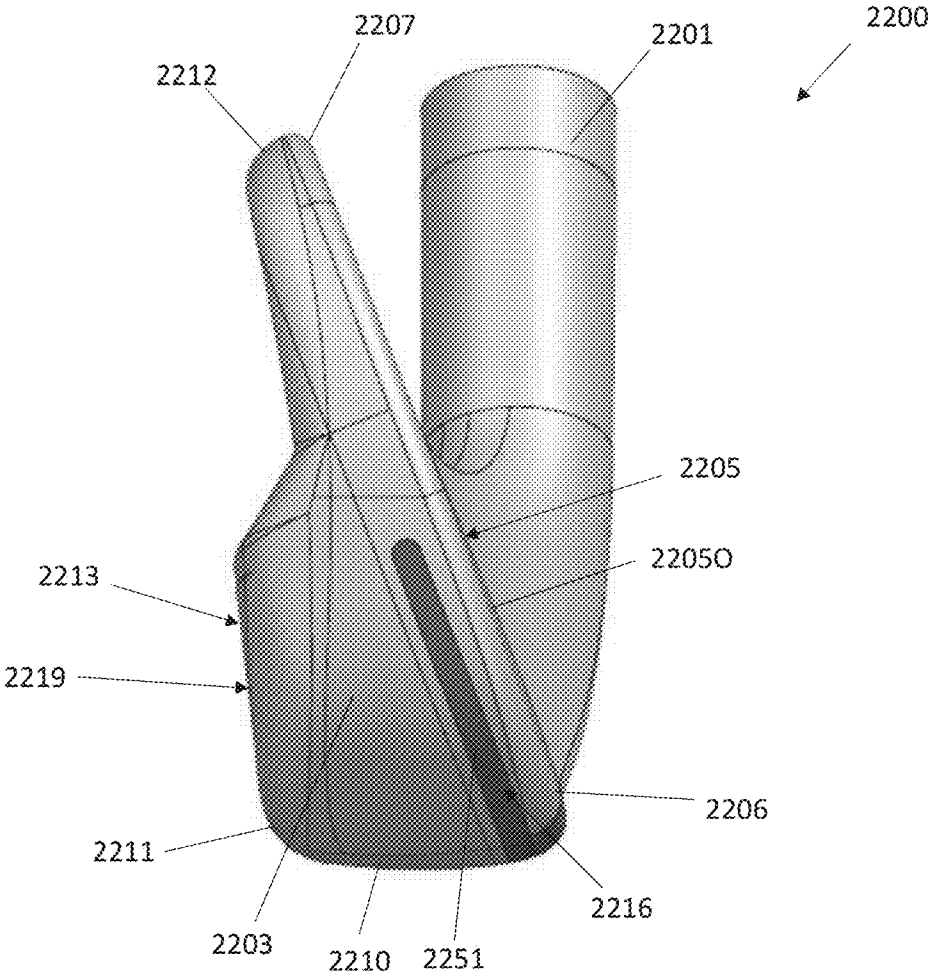
FIG. 50 of the accompanying drawings shows a toe side view of the golf club head of FIG. 49.
Figure 51B:
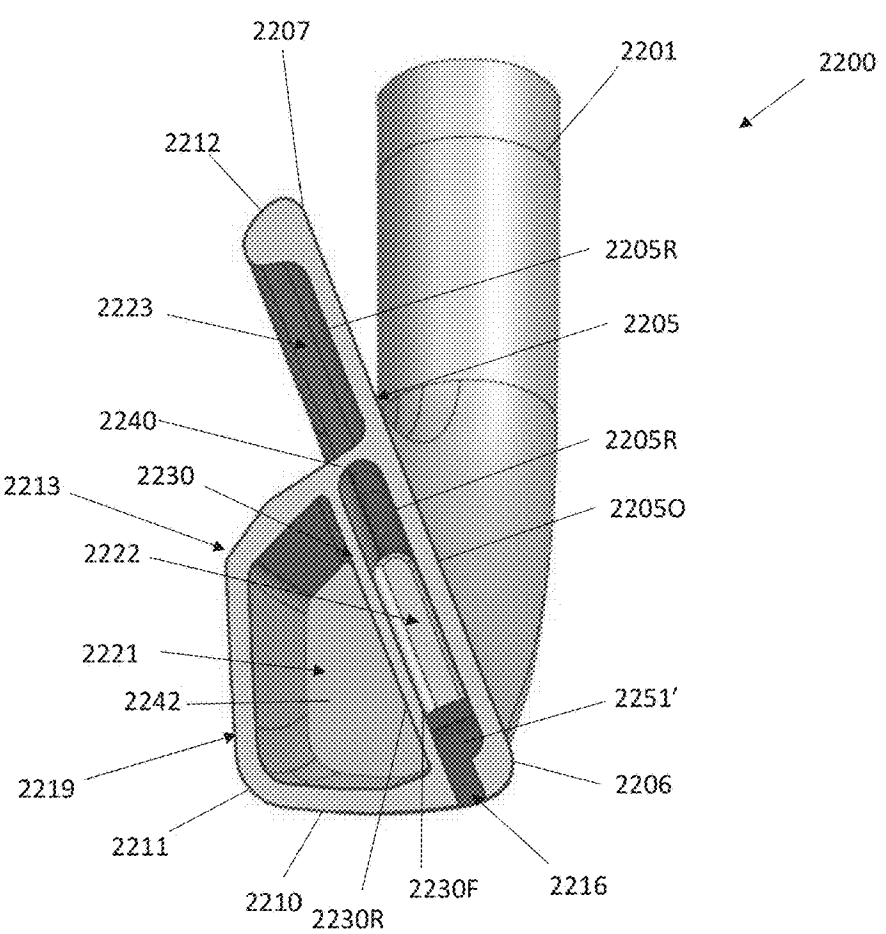
FIG. 51B of the accompanying drawings shows another cross-sectional view of the golf club head of FIG. 49 along the line 51-51 in FIG. 49, according to some examples.
Figure 51A:
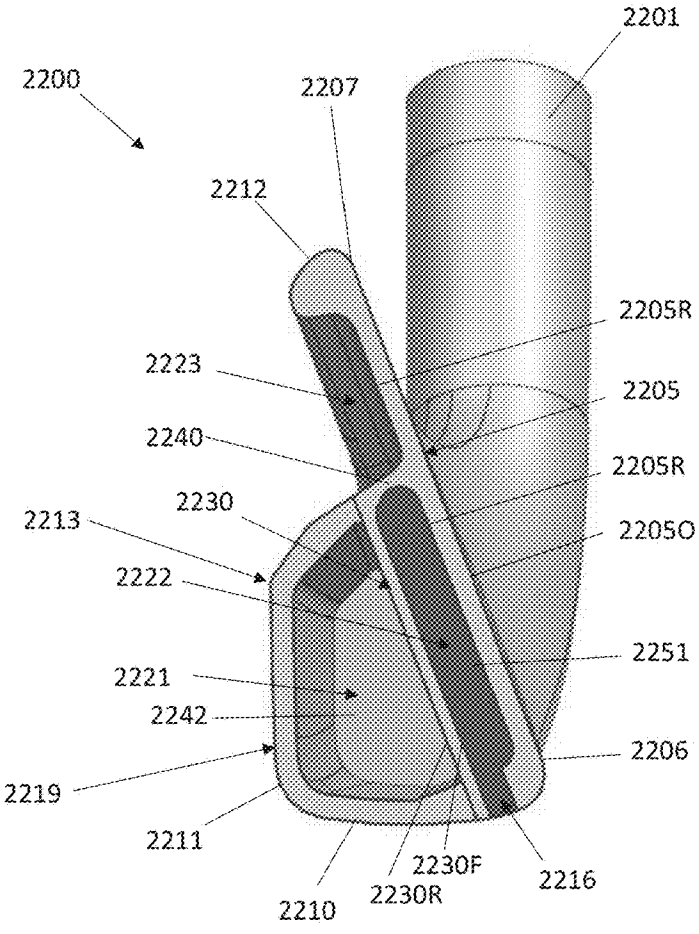
FIG. 51A of the accompanying drawings shows a cross-sectional view of the golf club head of FIG. 49 along the line 51-51 in FIG. 49, according to some examples.

FIG. 49 of the accompanying drawings shows a bottom perspective view of another golf club head 2200, according to some examples. FIG. 50 of the accompanying drawings shows a toe side view of the golf club head 2200 of FIG. 49. FIG. 51A of the accompanying drawings shows a cross-sectional view of the golf club head 2200 of FIG. 49 along the line 51-51 in FIG. 49, according to some examples. FIG. 51B of the accompanying drawings shows another cross-sectional view of the golf club head 2200 of FIG. 49 along the line 51-51 in FIG. 49, according to some examples. The golf club head 2200 may include some features similar to the features of other golf club heads described herein, including, without limitation, the golf club head 2100. Therefore, redundant descriptions of some features may not be repeated.

Referring concurrently to FIGS. 49-51B, the golf club head 2200 includes a body 2202 including a toe 2203, a heel 2204, a striking face 2205 extending between the toe 2203 and the heel 2204 and having a lower leading edge 2206 and an opposite upper topline edge 2207, a sole 2210 extending rearward from the lower leading edge 2206 to a rearward portion 2211, a back portion 2213 coupled to the rearward portion 2211 of the sole 2210, a top portion 2212 extending rearward from the upper topline edge 2207, and a support bar 2240 that protrudes rearwardly from the striking face 2205. The striking face 2205 may have a substantially flat outermost surface 2205O and an opposite rear surface 2205R, and one or more grooves (not shown) may be defined in the outermost surface 2205O of the striking face 2205. A rear portion of the body 2202 may be defined by a cradle 2219 that is attached (e.g., during the manufacturing process of the golf club head 2200) to a front portion of the body 2202. The golf club head 2200 may include a hosel 2201 that is disposed at the heel 2204 and that is configured to attach to a golf club shaft.

The golf club head 2200 may include an intermediate wall 2230 that extends from the sole 2210 to the support bar 2240 (or to the back portion 2213). The intermediate wall 2230 may have a front surface 2230F and an opposite rear surface 2230R, and the front surface 2230F may be substantially parallel to the rear surface 2205R of the striking face 2205.

The golf club head 2200 may have a front cavity 2222 positioned between the striking face 2205 and the intermediate wall 2230, a rear cavity 2221 positioned between the intermediate wall 2230 and the back portion 2213, and an upper cavity 2223 positioned rearward to the striking face 2205 and between the support bar 2240 and the top portion 2212. The front cavity 2222, the rear cavity 2221, and the upper cavity 2223 may respectively have features similar to, or the same as, the features of the front cavity 2122, the rear cavity 2121, and the upper cavity 2123 of the golf club head 2100.

The golf club head 2200 may include one or more polymer materials that at least partially fill the front cavity 2222, and the body 2202 may have a sole opening 2216 (e.g., a hole or a slot) defined at least partially in the sole 2210 and exposing the front cavity 2222. In the non-limiting example depicted, the sole opening 2216 extends in a toe-heel direction along at least part of the sole 2210 and also along part of the toe 2203. In some other examples, the sole opening 2216 may be formed only in the sole 2210.

The sole opening 2216 may allow the one or more polymer materials to be inserted into the front cavity 2222. For example, one or more polymer liquids may be injected into the front cavity 2222 through the sole opening 2216, and then cured to form one or more corresponding solid polymers. In some other examples, one or more solid polymers may be prefabricated and inserted into the front cavity 2222 through the sole opening 2216. The sole opening 2216 may be at least partially filled with a plug, which may, for example, include a polymer integrally formed with at least one of the one or more polymer materials that at least partially fills the front cavity 2222. In some examples, the plug may be prefabricated and inserted into the sole opening 2216. For example, the plug may include a different material than at least one of the one or more polymers in the front cavity 2222. For example, the plug may include a different polymer material than at least one (e.g., all) of the one or more polymers in the front cavity 2222, or the plug may include a nonpolymer material, such as a metal.

In the example depicted in FIG. 51A, the golf club head 2200 includes a first polymer 2251 that entirely fills the front cavity 2222 and also fills the sole opening 2216.

The example depicted in FIG. 51B is identical to the example depicted in FIG. 51A, except that a first polymer 2251' fills only part of the front cavity 2222 and also fills the sole opening 2216. In the example depicted in FIG. 51B, part of the front cavity 2222 is void (not filled with any solid materials). This void can allow the striking face 2205 to bend more when striking a golf ball, e.g., so that ball speed is increased. In some examples, a volume of the void may be less than 95%, 90%, 85%, or 80% of the volume of the front cavity 2222, and the volume of the void may be greater than 40%, 50%, 60%, or 70% of the volume of the front cavity 2222. The first polymer 2251' may fill between 1% and 40% of the volume of the front cavity 2222.

In some other examples, the golf club head 2200 may include a plurality of different polymers respectively of different polymer materials in the front cavity 2222. For example, the golf club head 2200 may include two or more polymers of different polymer materials and arranged from a bottom portion of the front cavity 2222 closest to the sole 2210 toward the top portion of the front cavity 2222 closest to the top portion 2212, or arranged from the top portion of the front cavity 2222 toward the bottom portion of the front cavity 2222. In some other examples, the golf club head 2200 may include two or more polymers of different polymer materials and arranged in a toe-heel direction in the front cavity 2222. In some examples, the one or more polymer materials may only fill part the front cavity 2222 while another part of the front cavity 2222 is void (not filled with any solid material). In some examples, the golf club head 2200 does not include any polymer materials in the front cavity 2222. For example, the entire front cavity 2222 may be void.

Figure 52:
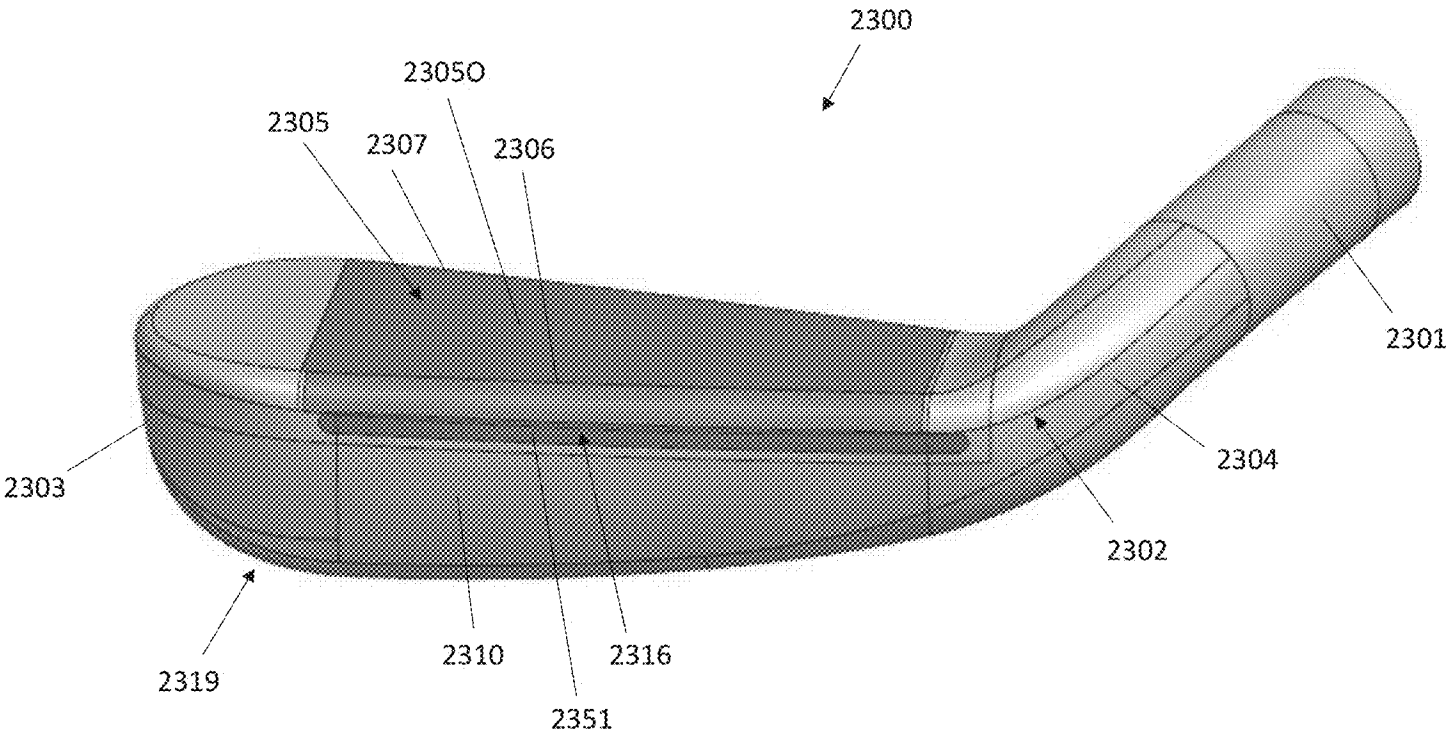
FIG. 52 of the accompanying drawings shows a bottom perspective view of another golf club head, according to some examples.
Figure 53:
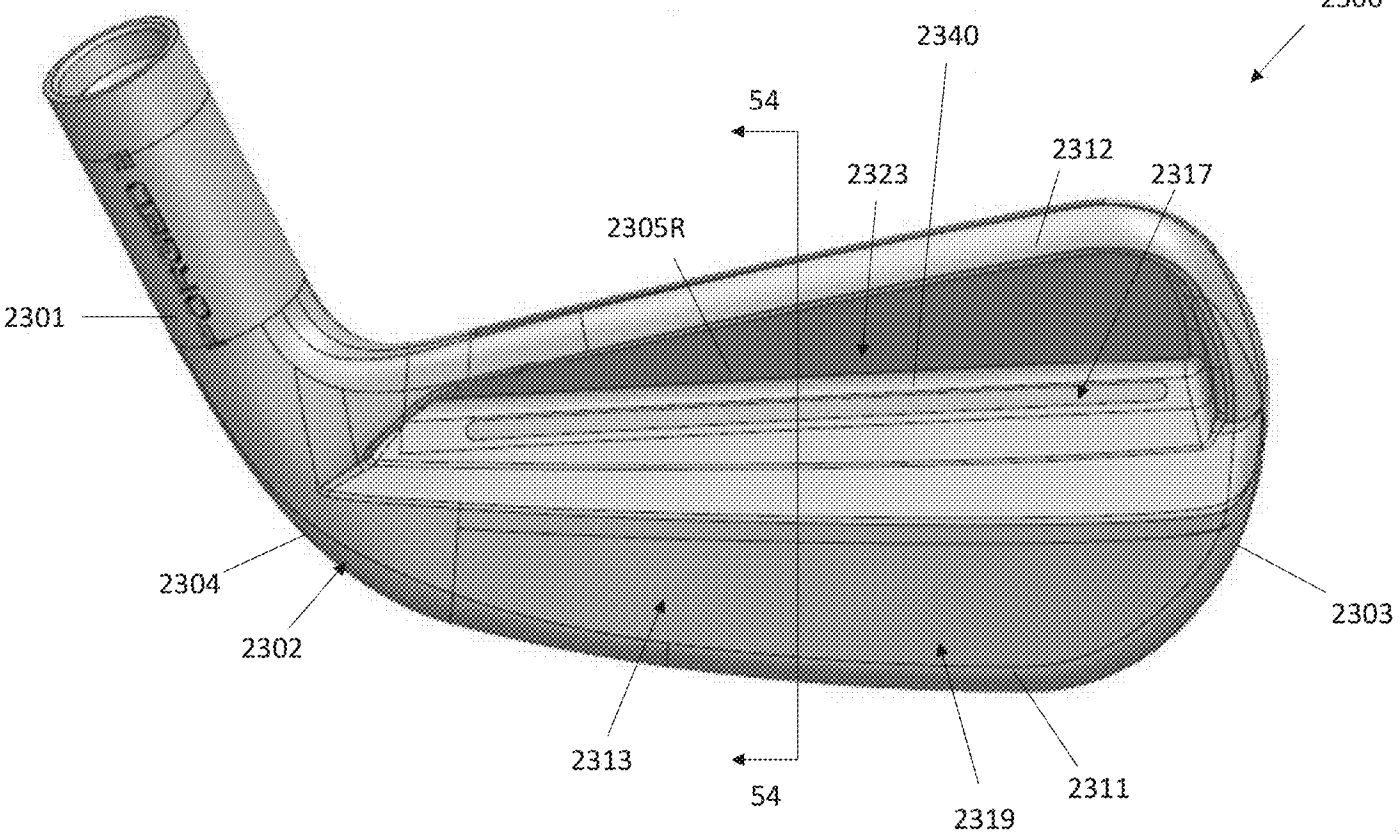
FIG. 53 of the accompanying drawings shows a back view of the golf club head of FIG. 52.
Figure 54B:
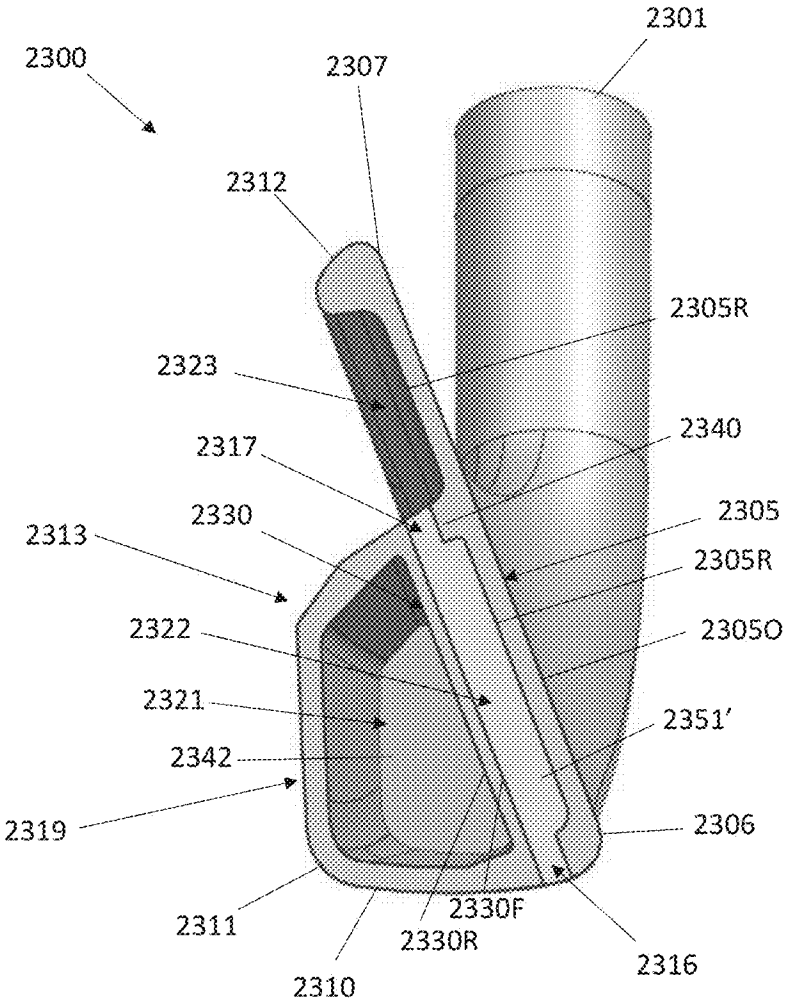
FIG. 54B of accompanying drawings shows another cross-sectional view of the golf club head of FIG. 52 along the line 54-54 in FIG. 52, according to some examples.
Figure 54A:
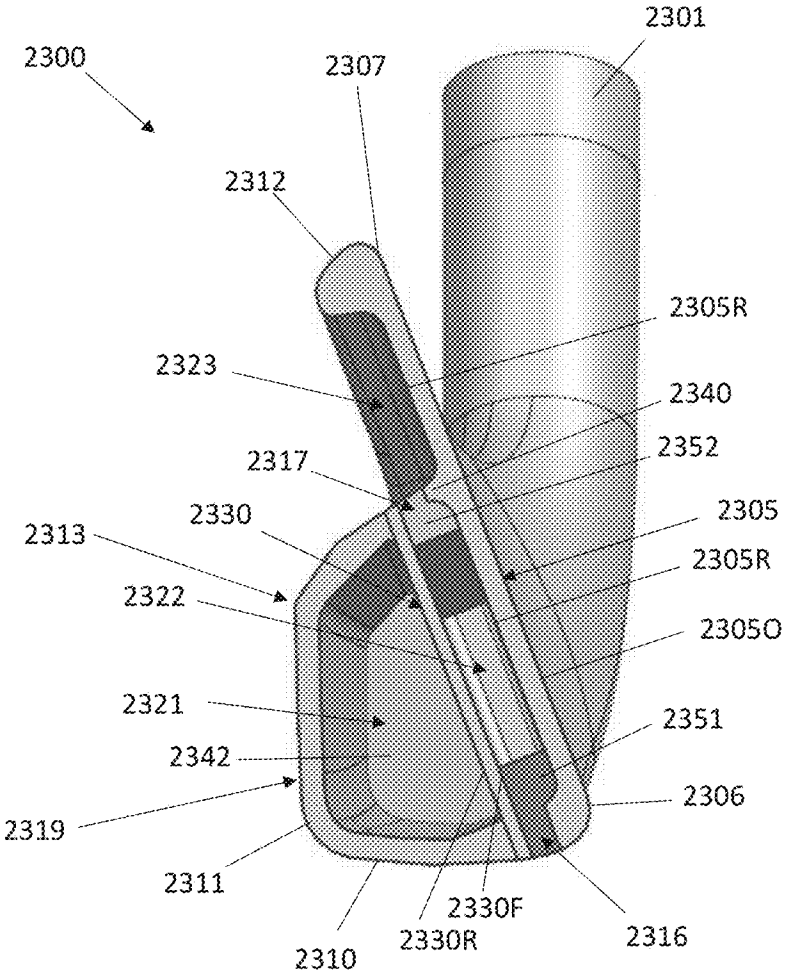
FIG. 54A of the accompanying drawings shows a cross-sectional view of the golf club head of FIG. 52 along the line 54-54 in FIG. 52, according to some examples.

FIG. 52 of the accompanying drawings shows a bottom perspective view of another golf club head 2300, according to some examples. FIG. 53 of the accompanying drawings shows a back view of the golf club head 2300 of FIG. 52. FIG. 54A of the accompanying drawings shows a cross-sectional view of the golf club head 2300 of FIG. 52 along the line 54-54 in FIG. 52, according to some examples. FIG. 54B of accompanying drawings shows another cross-sectional view of the golf club head 2300 of FIG. 52 along the line 54-54, according to some examples. The golf club head 2300 may include some features similar to the features of other golf club heads described herein, including, without limitation, the golf club heads 2100 and 2200. Therefore, redundant descriptions of some features may not be repeated.

Referring concurrently to FIGS. 52-54B, the golf club head 2300 includes a body 2302 including a toe 2303, a heel 2304, a striking face 2305 extending between the toe 2303 and the heel 2304 and having a lower leading edge 2306 and an opposite upper topline edge 2307, a sole 2310 extending rearward from the lower leading edge 2306 to a rearward portion 2311, a back portion 2313 coupled to the rearward portion 2311 of the sole 2310, a top portion 2312 extending rearward from the upper topline edge 2307, and a support bar 2340 that protrudes rearwardly from the rearward surface 2305R of the striking face 2305. The striking face 2305 may have a substantially flat outermost surface 2305O and an opposite rear surface 2305R, and one or more grooves (not shown) may be defined in the outermost surface 2305O of the striking face 2305. At least part of a rear portion of the body 2302 may be defined by a cradle 2319 that is attached (e.g., during the manufacturing process of the golf club head 2300) to a front portion of the body 2302. The golf club head 2300 may include a hosel 2301 that is disposed at the heel 2304 and that is configured to attach to a golf club shaft.

The golf club head 2300 may include an intermediate wall 2330 that extends from the sole 2310 to the support bar 2340 (or to the back portion 2313). The intermediate wall 2330 may have a front surface 2330F and an opposite rear surface 2330R, and the front surface 2330F may be substantially parallel to the rear surface 2305R of the striking face 2305.

The golf club head 2300 may have a front cavity 2322 positioned between the striking face 2305 and the intermediate wall 2330, a rear cavity 2321 positioned between the intermediate wall 2330 and the back portion 2313, and an upper cavity 2323 positioned rearward to the striking face 2305 and between the support bar 2340 and the top portion 2312. The front cavity 2322, the rear cavity 2321, and the upper cavity 2323 may respectively have features similar to, or the same as, the features of the front cavity 2122, the rear cavity 2121, and the upper cavity 2123 of the golf club head 2100.

The golf club head 2300 may include one or more polymer materials that at least partially fill the front cavity 2322. The body 2302 may have a sole opening 2316 (e.g., a hole or a slot) defined at least partially in the sole 2310 and a top opening 2317 (e.g., a hole or a slot) defined at least partially in the support bar 2340. Each of the sole opening 2316 and the top opening 2317 may expose the front cavity 2322. In the non-limiting example depicted, each of the sole opening 2316 and the top opening 2317 extend in a toe-heel direction.

The sole and top openings 2316 and 2317 may allow the one or more polymer materials to be inserted into the front cavity 2322. For example, one or more polymer liquids may be injected into the front cavity 2322 through one or both of the sole and top openings 2316 and 2317, and then cured to form one or more corresponding solid polymers. In some other examples, one or more solid polymers are prefabricated and inserted into the front cavity 2322 through one or both of the sole and top openings 2316 and 2317. One or both of the sole and top openings 2316 and 2317 may be at least partially filled with a plug, which may, for example, include a polymer integrally formed with at least one of the one or more polymer materials that at least partially fill the front cavity 2322. In some examples, one or both of the plugs may be prefabricated and inserted into the sole and top openings 2316 and 2317. For example, one or both of the plugs may include a different material than at least one of the one or more polymers in the front cavity 2322. For example, one or both of the plugs may include a different polymer material than at least one (e.g., all) of the one or more polymers in the front cavity 2322, or one or both of the plugs may include a nonpolymer material, such as a metal.

In the example depicted in FIG. 54A, the golf club head 2300 includes a first polymer 2351 that partially fills the front cavity 2322 (e.g., that fills a bottom portion of the front cavity 2322) and also fills the sole opening 2316, and the golf club head 2300 includes a second polymer 2352 that partially fills the front cavity 2322 (e.g., that fills a top portion of the front cavity 2322) and also fills the top opening 2317. The first and second polymers 2351 and 2352 may include the same material. In some other examples, the first polymer 2351 includes a first material, and the second polymer 2352 includes a second material different from the first material. In the example depicted in FIG. 54A, a middle portion of the front cavity 2322 is void (not filled with any solid material). In some examples, a volume of the void may be less than 95%, 90%, 85%, or 80% of the volume of the front cavity 2322, and the volume of the void may be greater than 40%, 50%, 60%, or 70% of the volume of the front cavity 2322. Each of the first and second polymers 2151 and 2152 may fill between 1% and 40% of the volume of the front cavity 2322.

The example depicted in FIG. 54B is identical to the example of FIG. 54A, except that the golf club head 2300 includes a first polymer 2351' that fills the entire front cavity 2322, the sole opening 2316, and the top opening 2317.

In some examples, the golf club head 2300 may include a plurality of different polymers respectively of different polymer materials in the front cavity 2322. For example, the golf club head 2300 may include two or more polymers of different polymer materials and arranged from a bottom portion of the front cavity 2322 closest to the sole 2310 toward the top portion of the front cavity 2322 closest to the top portion 2312, or arranged from the top portion of the front cavity 2322 toward the bottom portion of the front cavity 2322. In some other examples, the golf club head 2300 may include two or more polymers of different polymer materials and arranged in a toe-heel direction in the front cavity 2322. In some examples, the one or more polymer materials may only fill part the front cavity 2322 while another part of the front cavity 2322 is void (not filled with any solid material). In some examples, the golf club head 2300 does not include any polymer materials in the front cavity 2322. For example, the entire front cavity 2322 may be void.

Other than in the operating example, or unless otherwise expressly specified, all of the numerical ranges, amounts, values, and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

As used herein, the term "and/or" includes any and all combinations of one or more of the associated listed items.

It should be understood, of course, that the foregoing relates to exemplary embodiments of the present invention and that modifications may be made without departing from the spirit and scope of the invention as set forth in the following claims.

What is claimed is:

1. An iron type golf club head, comprising:

a striking face having a substantially flat outermost surface, and having a lower leading edge and an opposite upper topline edge;

a top portion extending rearward from the upper topline edge;

a sole extending rearward from the lower leading edge;

a support bar protruding rearwardly from the striking face and extending in a toe-heel direction of the golf club head;

an intermediate wall extending between the sole and the support bar; and a front cavity defined at least in part by the striking face, the intermediate wall, the support bar, and the sole, wherein, when the golf club head is in an address position on a ground plane, a greatest cavity height distance in a cross-sectional plane, as measured along a first direction perpendicular to the ground plane and from the ground plane to a top of the front cavity closest to the top portion is less than 70% of a greatest club height distance in the cross-sectional plane, as measured along the first direction and from the ground plane to the top portion, wherein the cross-sectional plane is perpendicular to the ground plane and taken at Face Center, wherein a sole slot is defined at least partly in the sole and exposes the front cavity to an exterior of the golf club head, wherein the sole slot is at least partially filled with a first polymer material, wherein a top slot is defined at least partly in the support bar and exposes the front cavity to the exterior of the golf club head, and wherein the top slot is at least partially filled with the first polymer material or a second polymer material different from the first polymer material.

2. The iron type golf club head of claim 1, further comprising one or more polymer materials at least partially filling the front cavity.

3. The iron type golf club head of claim 1, wherein a volume of the front cavity is less than 8,500 $mm^3$.

4. The iron type golf club head of claim 3, wherein the volume of the front cavity is less than 7,000 $mm^3$.

5. The iron type golf club head of claim 1, further comprising:

a rear portion defining at least part of the sole; and a rear cavity positioned rearward to the front cavity, and defined at least partially by the rear portion and the intermediate wall, wherein the intermediate wall fluidically separates the front and rear cavities.

6. The iron type golf club head of claim 1, wherein an opening is defined in a toe or a heel of the golf club head and exposes the front cavity to an exterior of the golf club head, and wherein the opening is at least partially filled with a first polymer material.

7. An iron type golf club head, comprising:

a striking face having a lower leading edge and an upper topline edge;

a top portion extending rearward from the upper topline edge;

a sole extending rearward from the lower leading edge;

a support bar protruding rearwardly from the striking face, extending in a toe-heel direction of the golf club head, and positioned between the sole and the top portion;

an intermediate wall extending between the sole and the support bar; and a front cavity defined at least in part by the striking face, the intermediate wall, the support bar, and the sole, and having a volume of less than 8,500 $mm^3$, wherein a sole slot is defined at least partly in the sole that exposes the front cavity to an exterior of the golf club head, wherein a top slot is defined in the support bar and exposes a top of the front cavity to the exterior of the golf club head, and wherein the top slot is at least partially filled with a first polymer material.

8. The iron type golf club head of claim 7, wherein the volume of the front cavity is less than 7,000 $mm^3$.

9. The iron type golf club head of claim 7, wherein the support bar covers an entire top of the front cavity.

10. The iron type golf club head of claim 7, wherein the sole slot is at least partially filled with a second polymer material different from the first polymer material.

11. The iron type golf club head of claim 7, wherein the sole slot is filled with the first polymer material.

12. The iron type golf club head of claim 7, further comprising one or more polymer materials at least partially filling the front cavity.

13. The iron type golf club head of claim 12, wherein the front cavity is partially filled by the one or more polymer materials, and part of the front cavity is void.

* * * * *